United States Patent [19]

Yokoyama et al.

[11] Patent Number: 5,038,176

[45] Date of Patent: Aug. 6, 1991

[54] IMAGE FORMING APPARATUS HAVING PLURAL MAGNETIC BRUSH DEVELOPING DEVICES

[75] Inventors: Tomoaki Yokoyama; Kunio Toda; Taisuke Nagao, all of Osaka, Japan

[73] Assignee: Minolta Camera Kabushiki Kaisha, Osaka, Japan

[21] Appl. No.: 362,091

[22] Filed: Jun. 6, 1989

[30] Foreign Application Priority Data

| | | | |
|---|---|---|---|
| Jun. 7, 1988 | [JP] | Japan | 63-139887 |
| Jun. 7, 1988 | [JP] | Japan | 63-139888 |
| Jun. 23, 1988 | [JP] | Japan | 63-157549 |
| Jun. 23, 1988 | [JP] | Japan | 63-157550 |
| Jun. 23, 1988 | [JP] | Japan | 63-157551 |
| Jun. 23, 1988 | [JP] | Japan | 63-157552 |
| Jul. 11, 1988 | [JP] | Japan | 63-172452 |
| Jul. 20, 1988 | [JP] | Japan | 63-182283 |
| Aug. 12, 1988 | [JP] | Japan | 63-202495 |
| Sep. 1, 1988 | [JP] | Japan | 63-219570 |

[51] Int. Cl.[5] ..... G03G 15/09; G03G 15/01

[52] U.S. Cl. ..... 355/251; 355/246; 355/326; 118/657

[58] Field of Search ..... 355/326, 327, 251, 253, 355/245, 259, 246; 118/656, 657, 261

[56] References Cited

U.S. PATENT DOCUMENTS

| | | | |
|---|---|---|---|
| 4,282,827 | 8/1981 | Andrews . | |
| 4,398,817 | 8/1983 | Nishimura et al. | 355/326 |
| 4,591,261 | 5/1986 | Saruwatari et al. | 355/251 |
| 4,816,869 | 3/1989 | Kasai et al. | 355/326 X |
| 4,910,535 | 3/1990 | Yoshino et al. | 355/327 X |

FOREIGN PATENT DOCUMENTS 57-661 1/1982 Japan .

*Primary Examiner*—R. L. Moses

*Attorney, Agent, or Firm*—Burns, Doane, Swecker & Mathis

[57] ABSTRACT

An image forming apparatus having plural developing devices, comprising: a photosensitive member arranged rotatably in one direction and holding an electrostatic latent image corresponding to an original image; a developing sleeve rotatably arranged in each developing device at a position confronting said photosensitive member to transport a developer; a device for simultaneously driving for rotation of each of said developing sleeves in said developing devices; and an adjusting mechanism for adjusting operation of said developing devices so that in a region where said developing sleeves confront with said photosensitive member, a developer packaged density (F) in said developing device arranged at an upstream side in a rotational direction of said member is larger than that of said developing device arranged at a downstream side in the rotational direction of said member, which is $$F = Vd/Ds,$$

where Vd is an amount of the developer passing between said developing sleeve and said photosensitive member per hour, and Ds is a distance between said developing sleeve of said developing device and said photosensitive member. Then, a high quality image may be reproduced by the apparatus, which has improved reproducibility RSI of density of a reproduced solid obtained by the upstream device and improved reproducibility RLI of density of a reproduced line image obtained by the downstream device.

27 Claims, 29 Drawing Sheets

*Fig. 11*

Standard Mode

| Developing Condition | RSI | RLI |
|---|---|---|
| I | 0.8 1.0 1.2 1.4 | 0.3 0.6 0.9 1.2 |

*Fig. 12*

Line Reproduction Mode

| Developing Condition | RSI | RLI |
|---|---|---|
| II | 0.8 1.0 1.2 1.4 | 0.3 0.6 0.9 1.2 |

*Fig. 13*

High Qnality Image Mode

| Developing Condition | RSI<br>0.8 1.0 1.2 1.4 | RLI<br>0.3 0.6 0.9 1.2 |
|---|---|---|
| III | | |
| IV | | |
| V | | |

Fig. 24
Fig. 24b
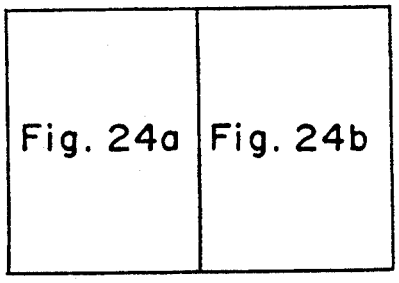
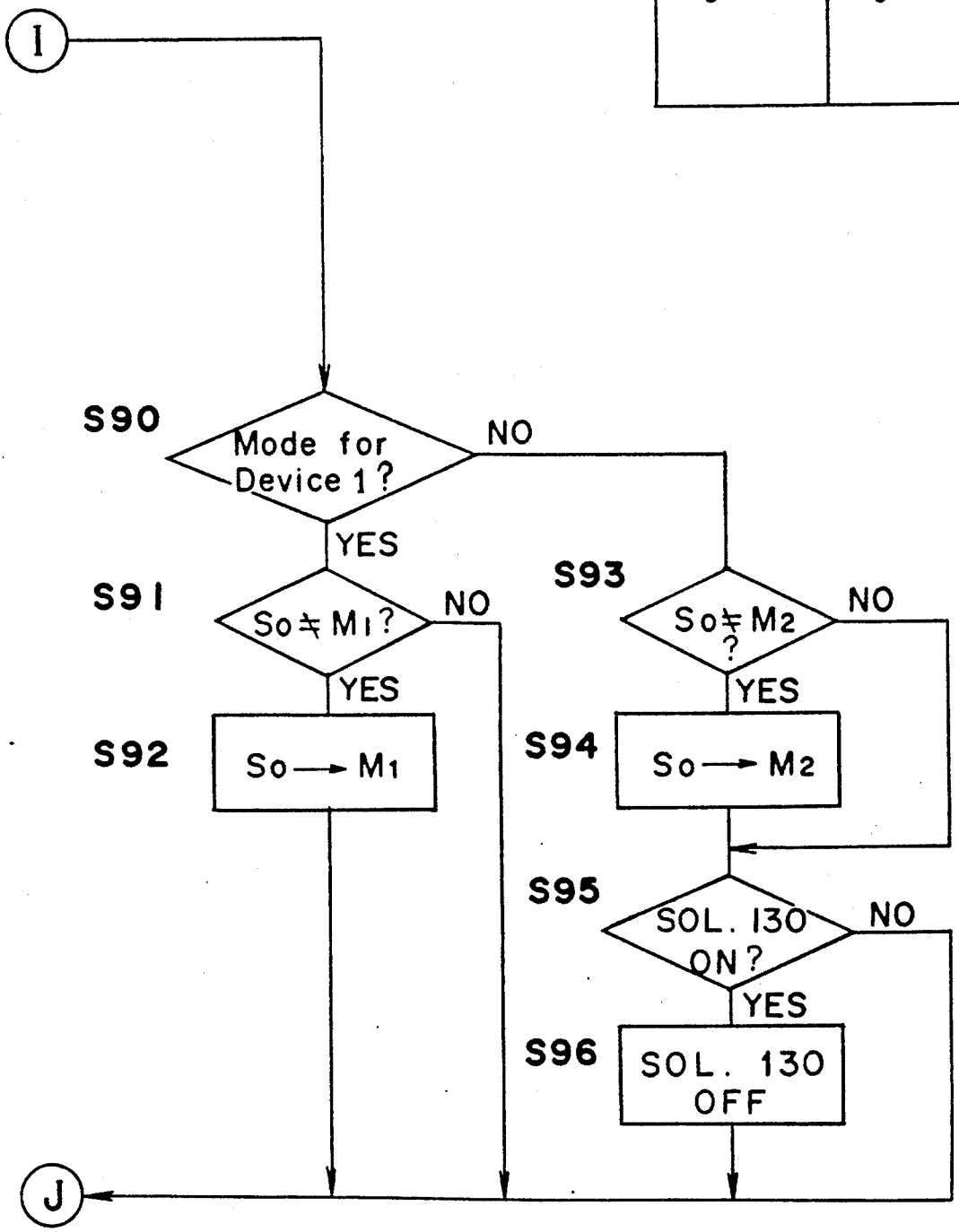

IMAGE FORMING APPARATUS HAVING PLURAL MAGNETIC BRUSH DEVELOPING DEVICES

BACKGROUND OF THE INVENTION

The present invention generally relates to an image forming apparatus having plural magnetic brush type developing devices arranged near the surface of a photosensitive member.

Conventionally, as one example of an image forming apparatuses as referred to above, there has been proposed an arrangement as described below. In the arrangement, plural magnetic brush type developing devices are detachably arranged at the side of a photosensitive member and a toner with different colors are accommodated in each of the devices, whereby the device with the toner in the color selected by an operator is selectively driven to form an image in black or the other color except for black.

In the apparatus, a developer including the toner and a carrier, which is held on the surface of a developing sleeve, contacts with the surface of the photosensitive member so as to develop an electrostatic latent image formed onto the surface of the member into a visible toner image by the magnetic brush type developing device. In the developing operation, since reproducibility RSI of density of a reproduced solid image conflicts with reproducibility RLI of density of a reproduced line image with each other, the higher reproducibility RSI of the density of the solid image results in the lower reproducibility RLI of the density of the line image, while the lower reproducibility RSI of the density of the solid image results in the higher reproducibility RLI of the density of the line image.

In a developing region where the photosensitive member confronts with the developing sleeve, if a large amount of the developer per hour contact the photosensitive member, the electrostatic latent image is developed to form a visual toner image with high density by supplying a sufficient amount of the toner thereto. However, since the toner which formed the toner image is simply and electrically put onto the surface of the photosensitive member, it is conceivable that the toner is scrapped off from the surface thereof by an external force such as a contact force of the magnetic brush. The toner put on an electrostatic latent image of a line image intends to easily scrapped off than that put on an electrostatic latent image of a solid toner image with some width. Therefore, it causes the following problem. That is, while the solid image and a normal letter image are reproduced with general faithful to the original imaged, the line image is reproduced with very lower density, some or all of the line image can not be reproduced.

On the other hand, in the developing region, if a small amount of the developer per hour contact the photosensitive member, a small amount of the toner is supplied to the photosensitive member and thus the toner is not sufficiently supplied to the electrostatic latent image. Then, the reproduced image is with lower density. However, it is hard to scrapped off the toner supplied to the electrostatic latent image therefrom by the magnetic brush. Even though the latent image to be developed includes a fine line image, the toner supplied to the latent image is transferred and fixed to a copy paper so that the original fine line image can be reproduced as a fine line image with lower density and with relatively faithful to the original image.

Then, the image forming apparatus employing the magnetic brush type developing devices has the problem that it is difficult to reproduce the line image as well as the solid image and the normal letter image while having sufficient density.

Moreover, generally, in image forming apparatuses having a magnetic brush type developing device, developer packaged density, toner content ratio, and toner charged electric potential at a portion confronting a photosensitive member with a developing sleeve cause the quality of a reproduced image to change. Here, the developer packaged density F at a developing region where a developing sleeve confronts with a photosensitive member is shown by the equation which is $$F = Vd / Ds,$$

where Vd is an amount of a developer passed through the region per hour and Ds is a gap between the sleeve and the member. Then, for example, higher developer packaged density results in improvement of reproducibility RSI of density of a reproduced solid image. Conversely, lower developer packaged density results in improvement of reproducibility RLI of density of a reproduced line image. However, as described previously, the reproducibility RSI of the density of the solid image conflicts with the reproducibility RLI of the density of the line image, and then it was impossible for both of the reproducibility RSI and RLI of the density of the solid image and the line image to simultaneously improve by only one developing device.

In addition, the amount of toner consumption in a developing device for reproducibility RSI of the density of a reproduced solid image is much larger than that in a developing device for reproducibility RLI of the density of a reproduced line image. Then, there is the problem that it is unreasonable that the developer capacity in each device is the same in design but it is necessary for the device which consumes large amounts of the developer to accommodate such an amount of developer.

Furthermore, conventionally, there have been proposed image forming apparatuses for circularly transporting a two-component developer composed of a toner and a carrier. In these apparatuses, a developing sleeve is arranged inside a housing to confront with a photosensitive member, a partition is arranged in a back space of the sleeve by which plural transporting paths are approximately parallel with each other are formed, and connecting paths for connecting both the transporting paths with each other at ends of the housing are arranged at a position adjacent to the partition in the housing, thus the developer is circularly transported by a transporting means arranged in each transporting path to supply the developer to the surface of the sleeve.

However, according to these apparatuses, since the toner is graduately consumed while being transported from the upstream side in a transporting direction of the transporting path adjacent to the sleeve to the downstream side thereof, the toner density in the developer, that is, the toner mixing ratio to the carrier, becomes lower while the toner is transported toward the downstream therein. Then, when the toner is replenished in the transporting path, ununiformity of the toner density in consuming the toner overlaps ununiformity of the toner density in replenishing the toner to magnify the ununiformity thereof.

Therefore, the density of the developer at the upstream side of the transporting path adjacent to the sleeve becomes higher and conversely the density at the downstream side thereof becomes lower. Then, these states results in that an image at one side of an original document is reproduced with higher density than necessary while producing any fog, and conversely, an image at the other side thereof is reproduced with lower density.

SUMMARY OF THE INVENTION

Accordingly, an essential object of the present invention is to provide an image forming apparatus in which a solid image may be reproduced with sufficient density at the same time that a line image may be clearly reproduced, thus improving the reproducibility RSI and RLI of the density of the reproduced solid image and the reproduced line image.

Another object of the present invention is to provide an image forming apparatus in which suitable amount of a developer in correspondence with developer consumption may be accommodated in a developing device which consumes large amounts of the developer.

Further object of the present invention is to provide an image forming apparatus by which an excellent quality image with uniform density may be reproduced.

In accomplishing these and other objects, there is provided an image forming apparatus having plural developing devices, comprising:

a photosensitive member arranged rotatably in one direction and holding an electrostatic latent image corresponding to an original image;

a developing sleeve rotatably arranged in each developing device at a position confronting the photosensitive member to transport a developer;

means for simultaneously driving for rotation of each of the developing sleeves in the developing devices; and an adjusting mechanism for adjusting operation of the developing devices so that in a region where the developing sleeves confront with the photosensitive member, a developer packaged density (F) in the developing device arranged at an upstream side in a rotational direction of the member is larger than that of the developing device arranged at a downstream side in the rotational direction of the member, which is $$F = Vd/Ds,$$

where Vd is an amount of the developer passing between the developing sleeve and the photosensitive member per hour, and Ds is a distance between the developing sleeve of the developing device and the photosensitive member.

According to the arrangement of the present invention, since the image forming apparatus comprises plural devices each accommodated toners in the same color to form a reproduced image by the toners, the upstream device arranged at the upstream side of the member and having high developer packaged density and the downstream device arranged at the downstream side of the member and having lower developer packaged density are simultaneously driven to develop the same electrostatic latent image on the photosensitive member by each of the devices.

Then, an original solid image and an original normal literal image may be reproduced with sufficient density by the upstream device with the first priority for development order and an original line image may be clearly reproduced by the downstream device with the second priority for development order.

Therefore, the present invention may be provided the apparatus by which the reproducibility RSI and RLI of the density of the solid image and the line image is improved.

Furthermore, when the value of the density of the toner in the upstream device with the first priority therefor becomes smaller than the reference value, a mode in which both the devices are driven for development is changed into other mode in which the downstream device with the second priority therefor is solely driven for development to have priority for the reproducibility RSI of the density of the reproduced solid image, and then a reproduced image with sufficient density may be obtained.

In another aspect of the present invention, the image forming apparatus wherein a magnetic roller with plural magnetic poles is fixed into each of the sleeves, a height regulating member in the upstream developing device is arranged to confront with a portion of an outer circumferential surface of the sleeve in the upstream developing device, at which the regulating member confronts with a middle of the adjacent magnetic poles of the roller, and the regulating member in the downstream developing device is arranged to confront with a portion of an outer circumferential surface of the sleeve in the downstream developing device, at which the regulating member confronts with the pole of the roller.

By the arrangement of the present invention, the height regulating member is arranged to confront with the middle of the poles in the upstream device with respect to rotation of the photosensitive member and the height regulating member is arranged to confront with the pole in the downstream device so that the developer packaged density (F) at the portion, confronting the sleeve with the photosensitive member, in the upstream device is larger than that (F) in the downstream device and both the devices are simultaneously driven.

Therefore, it may prevent the great fluctuation in the amount in correspondence with the slight adjusting error of the gap in the device, and thus, the developer may be stably transported.

Furthermore, since the developer transporting amount in the downstream device may become smaller without setting the gap to the very small value, it may prevent the clogging of the foreign material and the developer in the gap, and thus, the developer may be smoothly transported.

Therefore, a high quality image with the improved reproducibility RSI and RLI of the density of the solid image and the line image may be stably obtained by the apparatus.

In still another aspect of the present invention, the image forming apparatus further comprising:

a transporting path having a developer transporting member for transporting the developer which is formed rotatably in one direction behind each sleeve in each developing device, and a driving transmission means for transmitting to the developer transporting members driving forces for driving the members to transport the developer in the paths in different transporting directions with each other, respectively.

According to the arrangement, since the toner transporting direction in the path adjacently arranged at the developing sleeve in the upstream device is the opposite of that in the downstream device, the interpolation of the devices may result in reproduction of an image with average toner density as a whole. Therefore, an excellent quality image with uniform density and non-fog may be reproduced by the apparatus.

In a further aspect of the present invention, the image forming apparatus comprising:

a photosensitive member arranged rotatably in one direction and holding an electrostatic latent image corresponding to an original image;

a first developing device arranged at a distance around the photosensitive member and accommodating a developer of a specified color, the upstream developing device having a developing sleeve arranged to confront with a surface of the photosensitive member at a distance to transport the developer in the device to a position thereon where the developer confronts with the photosensitive member, and a magnetic roller with plural magnetic poles arranged fixedly in the sleeve, the pole to be used in developing being biased on an upstream side of a line passed through rotary centers of the photosensitive member and the roller in a rotational direction of the member;

a second developing device arranged at a downstream side of the first developing device in a rotational direction of the member while confronting with the member and accommodating a developer of the same color as that of the developer in the upstream developing device, the downstream developing device having a developing sleeve rotatably arranged to confront with a surface of the member at a distance to transport the developer in the device to a position thereon where the developer confronts with the member, and a magnetic roller with plural magnetic poles arranged fixedly in the sleeve, the pole to be used in developing being positioned on a line passed through the rotary center of the member and a rotary center of the roller; and a control means for controlling to drive the upstream developing device to develop the latent image on the member before controlling to drive the downstream developing device to develop the latent image developed by the upstream developing device.

According to the arrangement, the apparatus is so constructed that plural magnetic brush type developing devices each of which has the developing sleeve and the same color toner are arranged at portions near the surface of the photosensitive member along an operating direction of the member, respectively, so that the sleeves in the devices are simultaneously driven for rotation to develop the same electrostatic latent image formed on the surface of the member by each device. Then, the center of the main pole of the magnetic poles in the sleeve in the downstream device of the operating direction of the member is positioned on the straight line passed through the center of the sleeve and the center of the member, and the center of the main pole of the magnetic poles in the sleeve in the upstream device of the operating direction of the member is positioned at the position where is located at the upstream side of the straight line passed through the center of the sleeve and the center of the member.

Therefore, a high quality image with the improved reproducibility RSI of the density of the solid image is stably reproduced by the upstream device and the improved reproducibility RLI of the density of the line image may be stably obtained by the downstream device without bad effect produced between the devices in correspondence with the fluctuation in the amount in each device which is caused in manufacturing and setting.

In a still further aspect of the present invention, the image forming apparatus wherein an amount of the developer accommodated in the upstream developing device is larger than that in the downstream developing device.

According to the arrangement of the apparatus which has plural developing devices each for supplying the developer in the same color toner to the same latent image formed on the surface of the photosensitive member, the developer consumption amount of the upstream device of the photosensitive member is designed to be larger than that of the downstream device of the photosensitive member. Therefore, even if images each with lots of solid parts are sequentially developed by the upstream device, the images with sufficient density may be reproduced by the upstream device.

BRIEF DESCRIPTION OF THE DRAWINGS

These and other objects and features of the present invention will become apparent from the following description taken in conjunction with the preferred embodiment thereof with reference to the accompanying drawings, in which:

FIG. 11 is an explanatory view showing reproducibility RSI and RLI of density of a reproduced solid image and a reproduced line image when developing gaps are set to standard modes;

FIG. 12 is an explanatory view showing reproducibility RSI and RLI of density of a reproduced solid image and a reproduced line image when developing-gaps are set to line reproduction modes;

FIG. 13 is an explanatory view showing reproducibility RSI and RLI of density of a reproduced solid image and a reproduced line image when an electrostatic latent image is developed by a device set to the standard mode and a device set to the line reproduction mode;

DETAILED DESCRIPTION OF THE INVENTION

Figure 1:
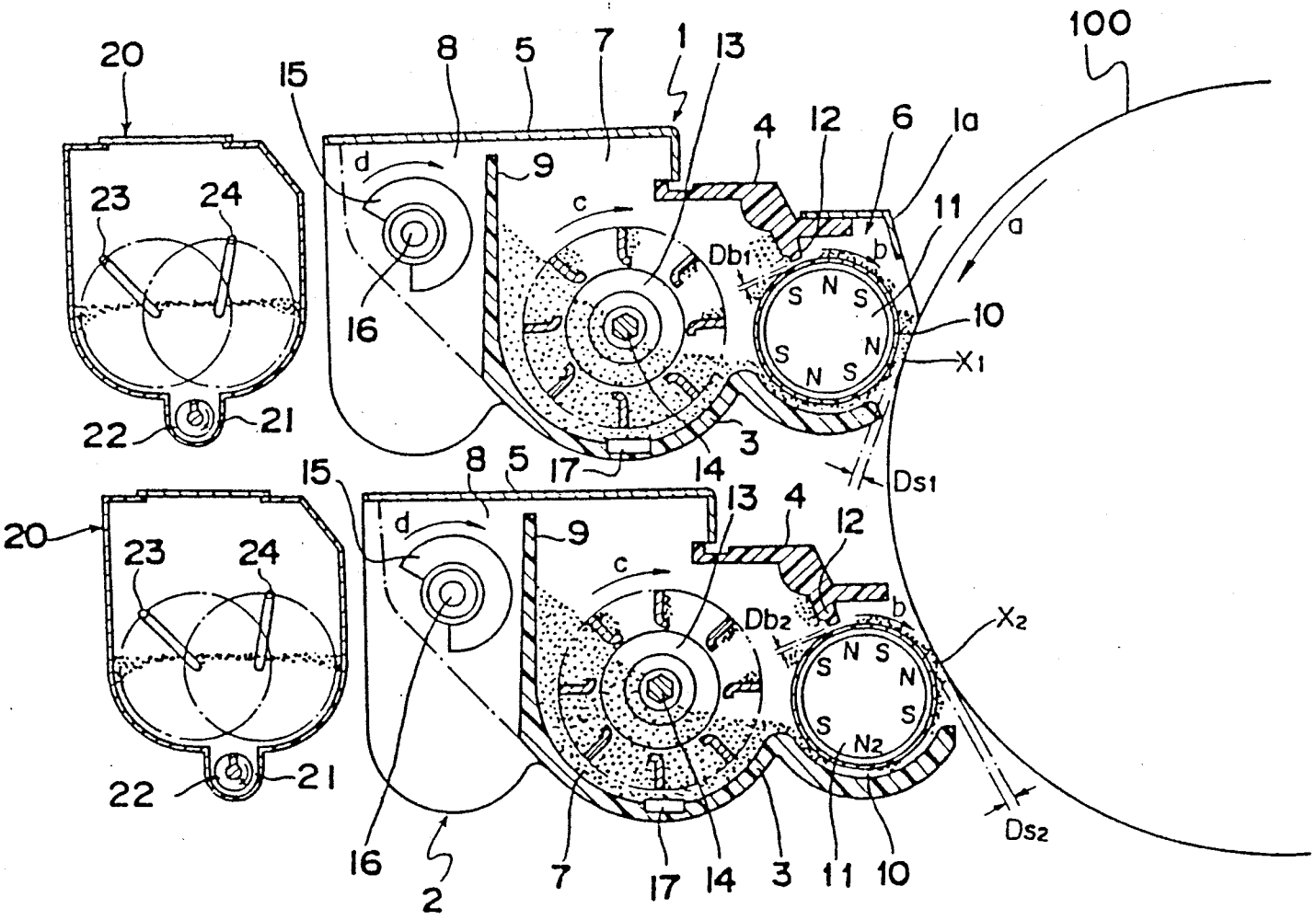
FIG. 1 is a sectional view of a developing unit in an image forming apparatus according to the first embodiment of the present invention.

Before the description of the present invention proceeds, it is to be noted that like parts are designated by like reference numerals and symbols throughout the accompanying drawings.

First Embodiment

I. Construction and operation of developing unit

FIG. 1 shows a main part of an image forming apparatus, specifically a copying apparatus, according to the first embodiment of the present invention. In FIG. 1, reference numeral 100 denotes a photosensitive drum having a photosensitive layer on the outer circumferential portion thereof so as to be driven for rotation in a direction shown by an arrow (a).

Reference numerals 1 and 2 denote developing devices for developing an electrostatic latent image formed onto the surface of the drum by supplying a two-component developer composed of a toner and a carrier. These devices each have the same construction with each other excepting for some parts, and like parts in both the devices are designated by like reference numerals.

A housing of each of the devices 1 and 2 is constructed by a bottom casing 3, an upper casing 4, and a cover 5 for opening and closing. In a space formed thereby, a developing unit 6 and transporting paths 7 and 8 are disposed toward the left side from the drum 100 in FIG. 1. The paths 7 and 8 are separated from each other by a partition 9. In the devices 1 and 2, an end path (not shown) is, respectively, formed between the inner surface of each device and each side end of the partition 9, to connect the path 7 with the path 8 therethrough.

In the developing unit 6, a developing sleeve 10 is disposed near the drum 100, and is supported to be driven for rotation in a direction shown by an arrow (b) while confronting with the drum 100 through small developing gaps $Ds_1$ and $Ds_2$, respectively.

Developer height regulating members 12 confront with the upper of the outer circumferential surface of the sleeve 10 through small developing height regulating gaps $Db_1$ and $Db_2$, respectively.

Into the sleeve 10, a magnetic element 11 is fixedly accommodated to be independent of the inner surface of the sleeve 10. At the outer circumferential portion of the element 11, plural magnetic poles are disposed. At a portion confronting with the path 7, the same poles S and S are adjacently disposed.

In the path 7, a bucket roller 13 is rotatably supported by a shaft 14 to be driven for rotation in a direction shown by an arrow (c) by means of a driving means (not shown). In the path 8, a screw 15 is rotatably supported by a shaft 16 to be driven for rotation in a direction shown by an arrow (d) by means of a driving means (not shown).

On the bottom of the path 7, a magnetic sensor 17 is disposed to measure an alternation in the magnetic permeability of the developer existing in the path 7.

In the device 1 positioned at the upstream side of the device 2, a sleeve cover la for covering the upper section of the sleeve 10 is disposed at the end of the upper casing 4.

In the device 2 positioned at the downstream side of the device 1, the developing gap $Ds_2$ is adjustable by a developing gap adjusting mechanism described later.

The reference numeral 20 denotes a toner replenishment tank of which a transporting path 21 is formed by protruding toward the lower of the tank 20 from the bottom. A screw 22 is disposed in the path 21, and agitating screws 23 and 24 are disposed in the tank 20. The path 21 is connected with the path 8 through a replenishment path (not shown).

Hereinafter, the developing operation by employing the devices 1 and 2 will be explained.

In the devices 1 and 2 which have the above described construction, the two-component developer composed of the toner and the carrier is accommodated into the paths 7 and 8.

The developer is circularly transported in the paths 7 and 8 through the end paths (not shown) formed between the ends of the partition 9 and the inner surface of the device 1 on the basis of the rotation of the bucket roller 13 and the screw 15. That is, for example the developer in the path 7 is transported by the bucket roller 13 from this side toward that side in FIG. 1. At the end of that side, the developer is transported into the path 8 through the other end path. On the other hand, the developer in the path 8 is transported from that side to this side in FIG. 1 by the screw 15. At the end of this side, the developer is transported into the path 7 through the end path (not shown).

Thus, the transportation of the developer causes the toner and the carrier of which the developer is composed to charge with different polarities with friction contact therebetween.

The developer transported in the path 7 is transported toward the sleeve 10 while transporting as described above on the basis of rotation of the bucket roller 13. Then, the developer is held on the outer circumferential portion of the sleeve 10 by the magnetic force of the magnetic element 11 while the sleeve 10 rotates in the direction shown by the arrow (b).

The developer held on the sleeve 10 is transported in the direction shown by the arrow (b) on the basis of rotation of the sleeve 10 to regulate by the portion, confronting with the sleeve 10, of the regulating member 12. The developer passed through each of the regulating gaps $Db_1$ and $Db_2$ is transported in the direction shown by the arrow (b) while forming a magnetic brush along a magnetic line of force which is formed by the plural magnetic poles, and then, it is transported to each of developing regions $X_1$ and $X_2$ where the sleeve 10 confronts with the drum 100.

On the surface of the drum 100, after charging at a charging region (not shown), an image light is exposed at an exposure region (not shown) onto the charged region to form an electrostatic latent image in correspondence with an original image on an original document.

This latent image is contacted with the developer held onto the surface of the developing sleeve 10 in passing through the developing regions $X_1$ and $X_2$ so that the toner is electrostatically supplied onto the latent image to be developed into a visible toner image.

Then, the toner image is transported to a transfer region (not shown) to be transferred onto a copy paper. The paper is heated to fix the image thereon.

On the other hand, the developer on the developing sleeve 10 of which toner density becomes lower because the toner in the developer is consumed for developing at each of the developing regions $X_1$ and $X_2$ is consequentially transported in the direction shown by the arrow (b). Then, when the developer reaches a position confronting with the transporting path 7, it is released from a restraint of the magnetic element 11 by a repulsion magnetic field formed by the adjacent poles S and S to fall from the surface of the sleeve 10 to the path 7.

The developer fallen to the path 7 is taken into the developer transporting by the bucket roller 13 while mixing and agitating thereby.

In the first developing device 1, the sleeve cover 1*a* is arranged to prevent toner smoke from splashing which is caused by the developer held on an outer circumferential portion of the sleeve 10.

The control operation of toner density in the developing devices 1 and 2 will be explained hereinafter.

Figure 10:
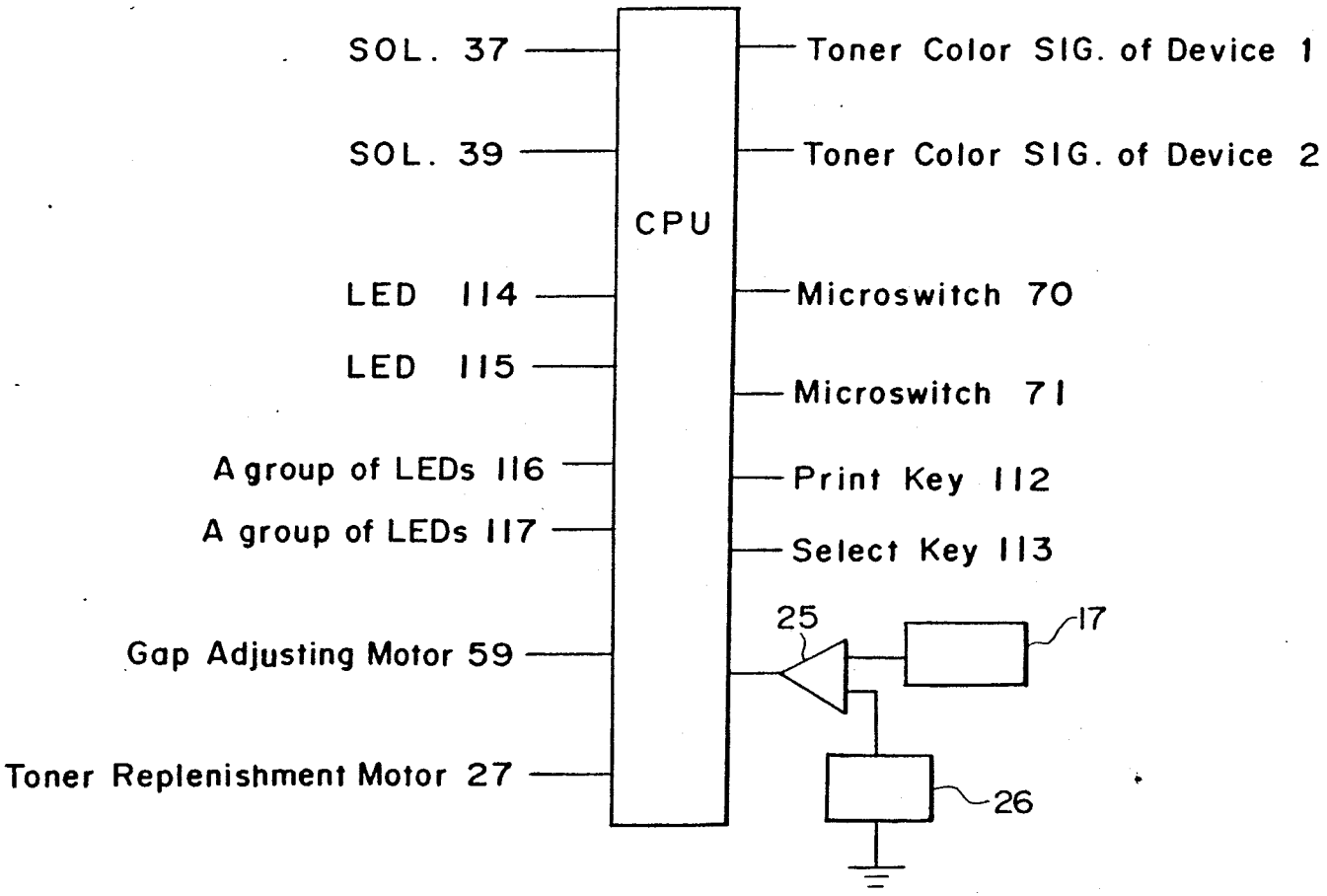
FIG. 10 is a control circuit diagram in the apparatus.

In the first and second developing devices 1 and 2, toner density $T_1$ and $T_2$ of the developers therein is measured as change in permeability by each magnetic sensor 17 in each path 7. As shown in FIG. 10, a signal of a voltage corresponding to the toner density is inputted into a comparative input terminal of a comparator 25. A signal of a reference voltage of an electric power supply 26 is inputted into a reference input voltage of the comparator 25.

In the comparator 25, the voltage signals inputted from both of the terminals are compared with each other. Then, it is detected whether or not the toner density $T_1$ and $T_2$ of the developers is smaller than a specified reference value $T_0$. When it is judged by the comparator 25 that either the toner density $T_1$ or $T_2$ thereof has been smaller than the reference value $T_0$, the comparator 25 outputs a toner replenishment signal to a central processing unit CPU.

In the CPU unit, when the toner replenishment signal is inputted, a motor 27 is driven to rotate the screw 22 and the agitating screws 23 and 24 of the toner replenishment tank 20 to replenish the transporting path 8 with toner.

The toner, which is replenished in such a manner, is taken into the developer transported in the path 8 to be charged while mixing and agitating with the carrier. When it is determined that the toner density $T_1$ or $T_2$ in the paths 7 which was smaller than the reference value $T_0$ is not smaller than the reference value $T_0$, the toner replenishing operation is stopped by the CPU unit.

II. Image forming characteristics

In the image forming apparatus comprising the developing devices 1 and 2, there is a close relation between developer packaged density (F) in the developing regions $X_1$ and $X_2$ confronting the sleeve 10 with the drum 100 and the quality of a reproduced image. The packaged density (F) is calculated by the equation which is $$F = Vd/Ds,$$

where Vd is an amount of the developer passed through between the sleeve 10 and the drum 100 per hour, and Ds is the developing gap. Then, referring to FIGS. 11 and 12, it will be explained hereinafter how the reproduced image is changed with the packaged density (F) which is changed with the gap Ds.

FIGS. 11 and 12 show examples indicating relation between the developing gap Ds and both of reproducibility RSI of density of a reproduced solid image and reproducibility RLI of density of a reproduced line image, which indicates limited density of reproducibility of an original line image with 50 μm width when the line image is reproduced as a line, under the following condition. FIG. 11 shows the example in a first standard mode in which the developing gap Ds is set to 0.6 mm and the height regulating gap Db is set to 0.5 mm. FIG. 12 shows the example in a first line reproduction mode in which the developing gap Ds is set to 1.2 mm and the height regulating gap Db is set to 0.5 mm.

Experimental condition of the examples

1. Photosensitive drum 100 the peripheral speed: 150 mm/sec;

2. Developing sleeve 10
   the outer diameter: 24.5 mm,
   the rotation frequency: 143.64 rpm,
   the developing gaps Ds: 0.6 mm (a developing condition I in FIG. 11) and 1.2 mm (a developing condition II in FIG. 12),
   the height regulating gap Db: 0.5 mm (the developing condition I in FIG. 11 and the developing condition II in FIG. 12),
   a gap between the sleeve 10 and the bottom casing 3: 1.0 mm;
3. Magnetic element 11
   the magnetic force of a main pole N confronting with the sleeve 10: 1,000 G,
   the magnetic force of the other poles: 500–800 G, where G denotes Gauss;
4. Bucket roller 13
   the outer diameter: 34 mm,
   the rotation frequency: 179.55 rpm;
5. Screw 15
   the outer diameter: 20 mm,
   the rotation frequency: 100 rpm;
6. Developer
   the toner: positive chargeable, insulated, and non-magnetic toner;
   the carrier: the average grain diameter of 57 μm, binder type insulated magnetic carrier, the resistance of $10^{13}$ Ω·cm.

As shown in FIG. 11, when the developing device is set to the standard mode in which the developing gap Ds is 0.6 mm and the height regulating gap Db is 0.5 mm, that is, the developing condition I, the reproducibility RSI of density of a reproduced solid image is about 1.4, the reproducibility RLI of density of a reproduced line image which indicates that the original line image is reproduced as a line lies in the range of 0.9–1.2, and an original line image with the lower density than that of the original line image above density can not be reproduced as a line.

On the other hand, as shown in FIG. 12, when the developing device is set to the line reproduction mode in which the developing gap Ds is 1.2 mm and the height regulating gap Db is 0.5 mm, that is, the developing condition II, the reproducibility RSI of density of a reproduced solid image is about 0.8, the reproducibility RLI of the density of a reproduced line image lies in the range of 0.4–0.6, and an original line image with the lower density than that of the original line image can not be reproduced as a line.

Thus, as shown in Table 1 described below, when the developing gap Ds is set to be larger so that the developer packaged density (F) becomes lower at the developing region, the reproducibility RLI of density of a reproduced line image is improved but it causes the density of the reproduced solid image to be lower to result in the worse reproducibility RSI of the density thereof.

Conversely, when the developing gap Ds is set to be smaller so that the developer packaged density (F) becomes higher at the developing region, the density of the reproduced solid image becomes higher to improve the reproducibility RSI of the density thereof but it results in the worse reproducibility RLI of the density of the reproduced line image.

TABLE 1

| Developer packaged density (F) | high | low |
|---|---|---|
| Reproducibility of the density of the reproduced solid image (RSI) | good | bad |
| Reproducibility of the density of the reproduced line image (RLI) | bad | good |

Thus, in the developing devices 1 and 2, either the reproducibility RSI of the density of the reproduced solid image or the reproducibility RSI of the density of the line image becomes worse and both of them may not be improved simultaneously, as far as only one of the devices is employed.

However, if two devices are, respectively, set to the following different conditions and are driven simultaneously, the latent image is developed into a visible image in the following manner. Here, the different conditions are cases where toners of the same color are accommodated in the first and second developing devices 1 and 2, respectively, and the developing gap $Ds_2$ of the second developing device 2 is larger than that $Ds_1$ of the first developing device 1, so that the developer packaged density (F) at the developing region $X_2$ is lower than that (F) at the developing region $X_1$.

First, after an operation for forming an electrostatic latent image on the surface of the drum 100 is executed, the toner in the first developing device 1 is supplied to the latent image on the drum 100 by the first developing device 1 at the developing region $X_1$.

Here, as described previously, since the developing gap $Ds_1$ is set to be smaller than the developing gap $Ds_2$, the developer in the device 1 frequently is contacted with the latent image to be sufficiently supplied thereto for development. The toner attached to an electrostatic latent image of a line image is often scraped off by the magnetic brush and thus little toner is attached to the latent image of the line image passed through the developing region $X_1$. After the toner attached to the latent image is scraped off, the latent image has still been maintained in a charging state.

Next, the toner in the second developing device 2 is supplied to the latent image transported to the developing region $X_2$ by the second developing device 2 to be supplied to the toner image formed at the developing region $X_1$.

Then, the toner in the device 2 is supplied to the latent image of the line image by the device 2 to which the toner attached is scraped off by the magnetic brush at the developing region $X_1$.

Since the value of the packaged density (F) at the developing region $X_2$ is smaller than that at the region $X_1$, the toner attached to the latent image is seldom scraped off by the magnetic brush, the latent image of the line image passes through the developing region $X_2$ while the toner sufficient to be developed into a visible image is attached to the latent image of the line image.

Therefore, most of the literal images and solid images are reproduced with the sufficient density thereof and the line image is reproduced as a line image sufficient to be visible.

Sequentially, the developing gaps Ds and the height regulating gaps Db of the developing devices 1 and 2 which are set to the experimental condition described above are, respectively, changed into the values described in Table 2. Then, both of the devices 1 and 2 are simultaneously driven to form a reproduced image corresponding to the same original image under the different condition by each of the devices 1 and 2, and thus the resulting reproducibility RSI and RLI of density of the solid image and the line image will be explained below.

TABLE 2

| | Developing gap Ds (mm) | Height regulating gap Db (mm) |
|---|---|---|
| First developing device 1 | 0.4 | 0.5 |
| Second developing device 2 | 1.2 | 0.5 |

Developing conditions III and IV in FIG. 13, respectively, show cases where each of the devices 1 and 2 is solely driven in the manner described above, respectively. The developing gap Ds is 0.4 mm and the height regulating gap Db is 0.5 mm in the developing condition III, and the developing gap Ds is 1.2 mm and the height regulating gap Db is 0.5 mm in the developing condition IV. The reproducibility RSI of the density of the reproduced solid image formed by the first developing device 1 under the condition III, where the developing gap $Ds_1$ is set to be smaller than that $Ds_2$ of the device 2 so that the packaged density (F) becomes higher, is about 1.4 and the reproducibility RLI of the density of the reproduced line image formed thereby under the above condition III lies in the range of 0.9–1.2. On the other hand, the reproducibility RSI of the density of the reproduced solid image formed by the second developing device 2 under the condition IV, where the developing gap $Ds_2$ is set to be larger than that $Ds_1$ of the device 1 so that the packaged density (F) of the device 2 is lower than that of the device 1, is about 0.8 and the reproducibility RLI of the density of the reproduced line image formed thereby under the above condition IV lies in the range of 0.4–0.6.

Here, a developing condition V in FIG. 13 shows a case where both of the devices 1 and 2 are simultaneously driven to develop the same latent image by each of the devices 1 and 2 at each of the developing regions $X_1$ and $X_2$. As shown in the condition V, the reproducibility RSI of density thereof is about 1.4 and the reproducibility RLI of density of the line image lies in the range of 0.4–0.6.

That is, the result in the developing condition III done by the first developing device 1 and the result in the developing condition V done by both of the devices 1 and 2 are the same reproducibility RSI of the density thereof. The result in the developing condition case IV done by the second developing device 2 and the result in the developing condition V done by both of the devices 1 and 2 are the same reproducibility RLI of the density of the reproduced line image. Then, the developing conditions V may cause both of the reproducibility RSI and RLI of the density of the solid image and the line image to improve simultaneously.

Then, in the image forming apparatus according to the first embodiment, when it is judged that the toners accommodated in the devices 1 and 2 have the same color, the developing gap $Ds_2$ is set to be larger than that $Ds_1$ of the device 1 so that the packaged density (F) at the region $X_2$ becomes lower than that (F) at the region $X_1$, and then, both of the devices 1 and 2 are simultaneously driven to obtain the high quality image with the improved reproducibility of the density of the solid image and the line image. In order to obtain the high quality image, the image forming apparatus has a toner color judging mechanism, a drive transmission mechanism, and the developing gap adjusting mechanism, as described below.

III. Toner color judging mechanism

Hereinafter, the mechanism will be described referring to FIG. 2.

Figure 2:
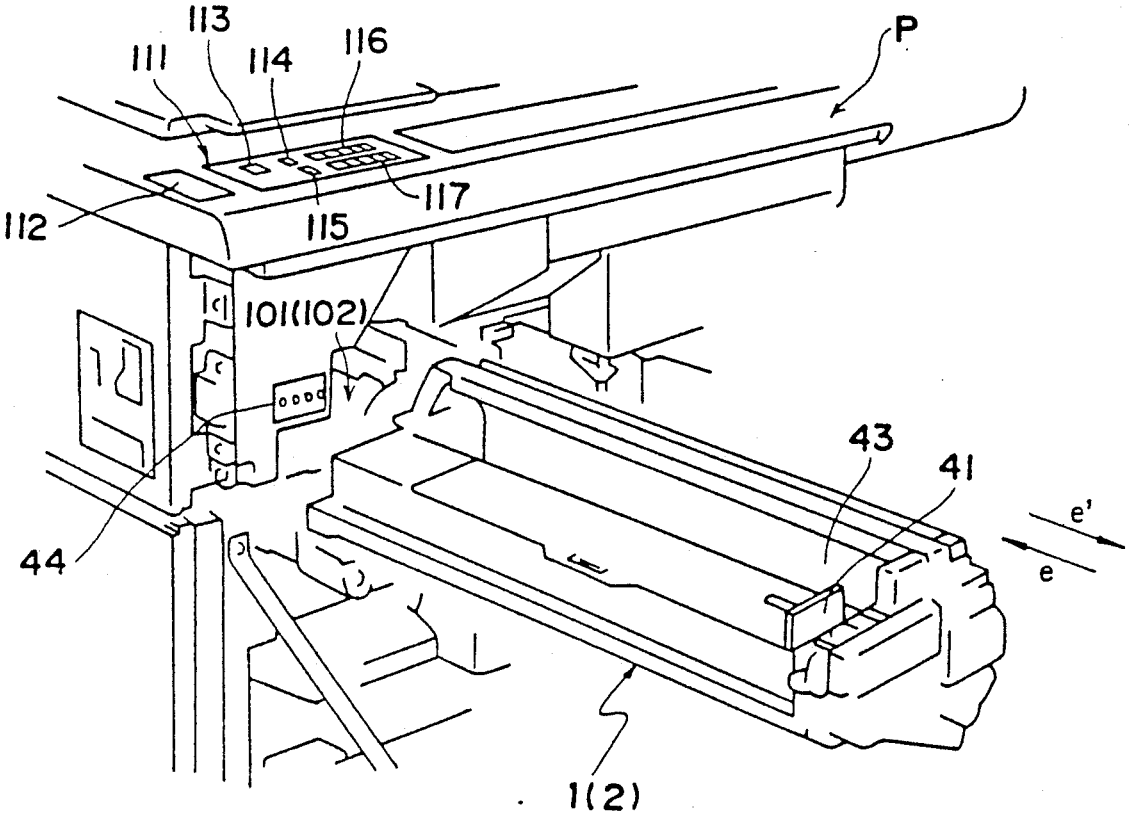
FIG. 2 is a perspective view of a main part of the apparatus.

In FIG. 2, the first and second developing devices 1 and 2 are detachably arranged in spaces 101 and 102 (not shown), of the apparatus, formed at the side of the drum 100, respectively. Each of the devices 1 and 2 is detached from and attached to each of the spaces 101 and 102 along a direction shown by an arrow (e) or (e') in' which is parallel to an axis of the drum 100, by opening a closing door arranged on an operating side of the image forming apparatus (P).

Figure 3:
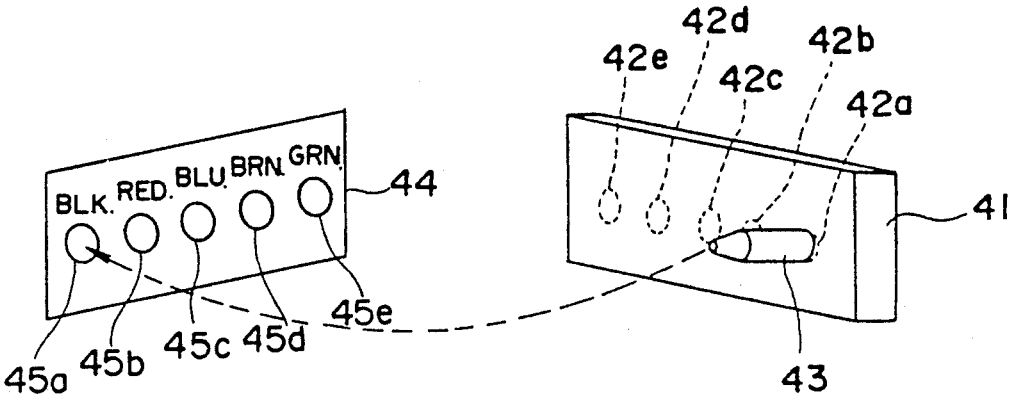
FIG. 3 is a perspective view of a main part of a toner color judging mechanism in the apparatus.

Each device has a plate 41 with a color detection pin 43 attached to one of five positions 42*a*, 42*b*, 42*c*, 42*d*, and 42*e*, as shown in FIG. 3. The position to which the pin 43 is attached corresponds to the color of the developer, exactly the color of the toner, accommodated into each of the devices 1 and 2. If the color of the developer accommodated into each of the devices 1 and 2 is one of black, red, blue, brown, and green, the pin 43 is attached to one of the positions 42*a*, 42*b*, 42*c*, 42*d*, and 42*e*, respectively.

At the side of the spaces 101 and 102 of the apparatus, a pin detection unit 44 is arranged. The unit 44 has five insert holes 45*a*–45*e* each accommodating a contact (not shown) thereinto.

The insert holes 45*a*–45*e* corresponds to the positions 42*a*–42*e*, respectively. It is so constructed that when the devices 1 and 2 are attached into the space 101 or 102, respectively, the pin 43 attached to one of the positions 42*a*–42*e* is inserted into one of the insert holes 45*a*–45*e*.

Therefore, for example, when the device 1 or 2 accommodated the black developer is attached into the space 101 or 102, the pin 43 attached to the position 42*a* is inserted into the insert hole 45*a* and thus the contact accommodated into the insert hole 45*a* is switched on. Similarly, when the device 1 or 2 accommodated the red, blue, blown, or green developer is attached into the spaces 101 and 102, the pin 43 attached to the corresponding position is inserted into the corresponding insert hole 45*b*, 45*c*, 45*d*, or 45*e* and thus the contact accommodated into the insert hole 45*b*, 45*c*, 45*d*, or 45*e* is switched on.

FIG. 10 shows a control circuit diagram with respect to the contacts.

As shown in FIG. 10, a switching-on signal of each contact is inputted into the CPU unit as a toner color signal of each of the devices 1 and 2. It is judged by the signal what color of toner accommodated into each of the devices 1 and 2.

Then, the developer color detected in this manner is displayed on a panel 111 of the apparatus P as shown in FIG. 2.

On the panel 111, reference numeral 112 denotes a print key, 113 a select key for selecting a developing mode and one of the devices 1 and 2 to be used in developing, and 114 and 115 mode display lamps for displaying the developing mode selected by the select key 113. When a first developing device drive mode for using the first developing device 1 is selected, the lamp 114 is turned on. When a second developing device drive mode for using the second developing device 2 is selected, the lamp 115 is turned on. Reference numerals 116 and 117 denote a group of LEDs for displaying the toner color accommodated into each of the devices 1 and 2.

As shown in FIG. 10, when the signal corresponding to the toner color in one of the devices 1 and 2 is inputted into the unit CPU as described above, one of the LEDs 116 and 117 which corresponds to the toner color is turned on.

Therefore, by checking the turning-on LED of the LEDs 116 and 117 an operator can know what color of toner accommodated in the apparatus and that the latent image is developed by the toner in the color.

IV. Drive transmission mechanism

Hereinafter, the drive transmission mechanism for the devices 1 and 2 will be explained referring to FIGS. 4–6.

Figure 4:
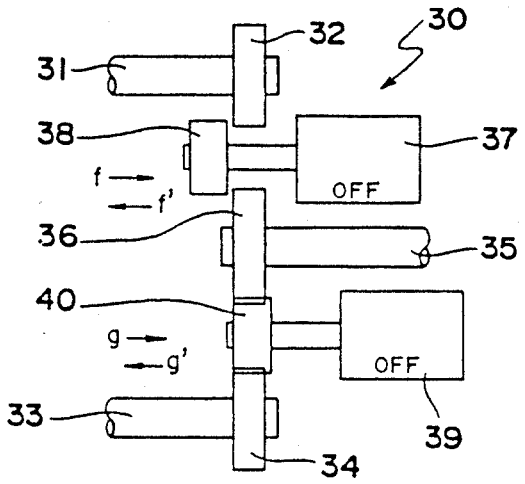
FIGS. 4–6 are side views of a driving transmission mechanism for transmitting a driving force to the developing unit in the apparatus.
Figure 5:
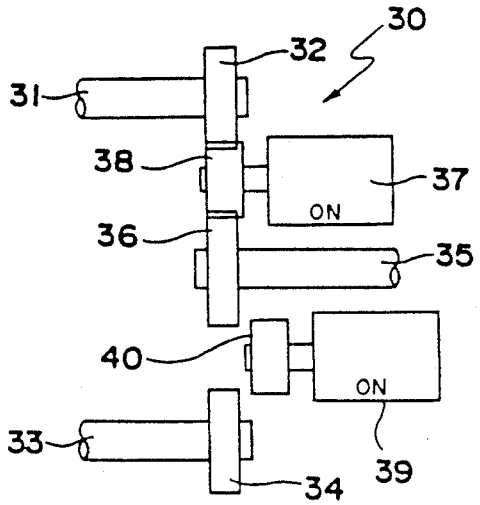
Figure 6:
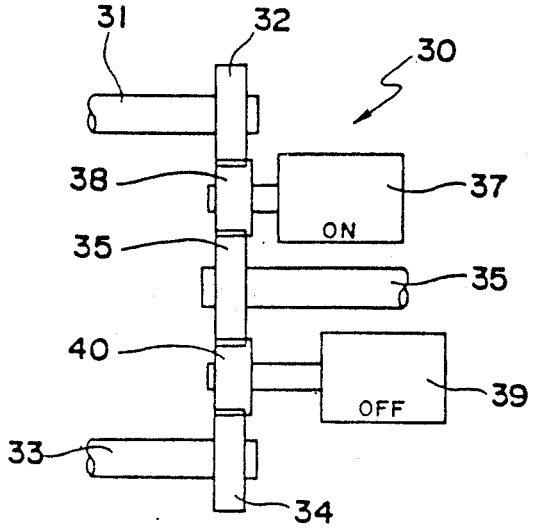

FIGS. 4–6 show, respectively, the drive transmission mechanism for transmitting a driving force from the body of the apparatus P to the devices 1 and 2 when the devices 1 and 2 are attached to the apparatus P. Reference numerals 31 and 33 denote drive shafts for transmitting the driving force to a shaft of each sleeve 10 accommodated into devices 1 and 2. Gears 32 and 34 having the same shape each other are fixed at the one ends of the drive shafts 31 and 33, respectively.

Reference numeral 35 denotes a drive shaft operatively connected with a main motor (not shown) of the apparatus, and a gear 36 is fixed at the one end of the shaft 35.

A gear 38 rotatably attached to one end of a plunger of a solenoid 37 is arranged at the sides of the gears 32 and 36. The gear 38 is engaged with the gears 32 and 36 when the solenoid 37 is turned on, while the gear 38 is disengaged from the gears 32 and 36 when the solenoid 37 is turned off. Similarly, a gear 40 rotatably attached to one end of a plunger of a solenoid 39 is arranged at the sides of the gears 34 and 36. The gear 40 is engaged with the gears 34 and 36 when the solenoid 39 is turned off, while the gear 40 is disengaged from the gears 34 and 36 when the solenoid 39 is turned on.

As shown in FIG. 10, the turning-on states and the turning-off states of the solenoids 37 and 39 are controlled by signals outputted from the CPU unit. As shown in Table 3, when a drive change mode (So) is $M_2$ (referred to FIG. 4), the solenoids 37 and 39 are turned off to transmit the rotary power of the main motor to only the drive shaft 33 of the second developing device 2 through the gears 36, 40, and 34. When the drive change mode (So) is $M_1$ (referred to FIG. 5), the solenoids 37 and 39 are turned on to transmit the rotary power of the main motor to only the drive shaft 31 of the first developing device 1 through the gears 36, 38, and 32. Furthermore, when the drive change mode (So) is $M_{12}$ (referred to FIG. 6), the solenoid 37 is turned on and the solenoid 39 is turned off to transmit the rotary power thereof to both the first and second developing devices 1 and 2.

TABLE 3

| Drive change mode | Solenoid | | Developing device | |
|---|---|---|---|---|
| So | 37 | 39 | 1 | 2 |
| $M_1$ | ON | ON | ON | OFF |
| $M_2$ | OFF | OFF | OFF | ON |
| $M_{12}$ | ON | OFF | ON | ON |

The gears 32 and 38 have the same outer diameters and numbers of teeth as those of the gears 34 and 40, respectively. The sleeves 10 of the devices 1 and 2 rotate at the same peripheral speed.

The rotary power transmitted to each of the sleeves 10 thereof is transmitted to the bucket roller 13 and the screw 15 through gears (not shown).

V. Developing gap adjusting mechanism

Hereinafter, the developing gap adjusting mechanism will be explained referring to FIG. 7.

Figure 7:
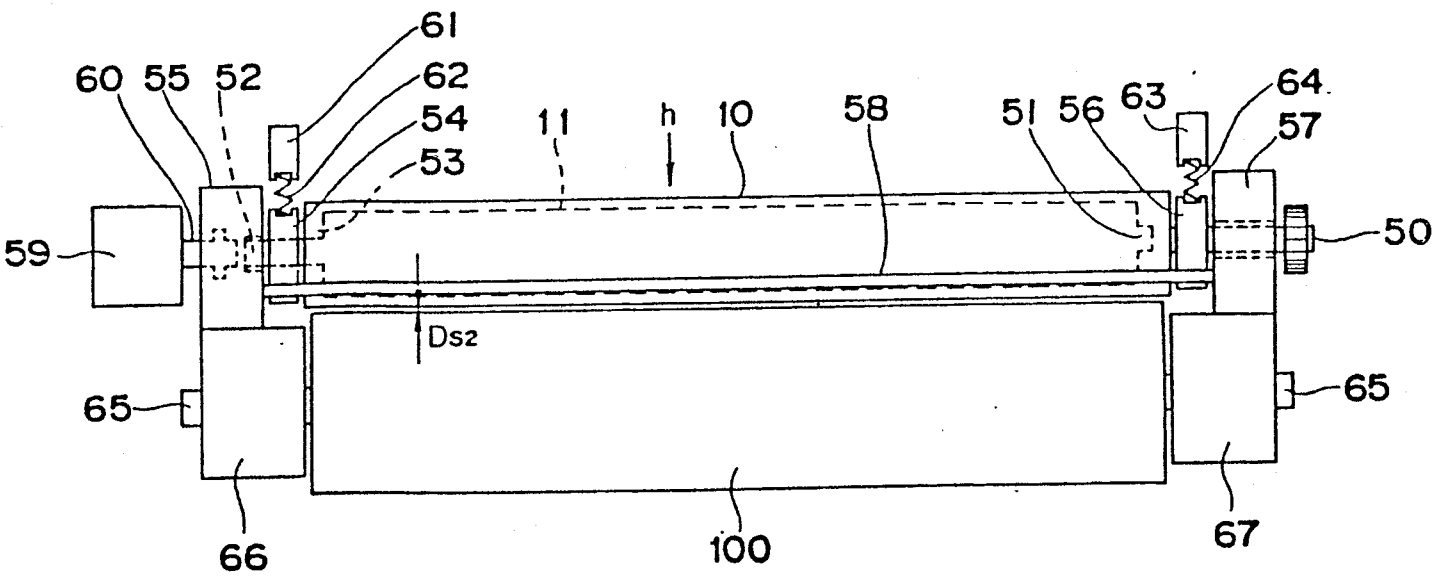
FIG. 7 is a plan view of a gap adjusting mechanism in the apparatus.

FIG. 7 shows a plan view showing the drum 100 and the sleeve 10. In FIG. 7, the righthand end of a support shaft 51 of the magnetic element 11 is rotatably supported by a bearing recess formed at the inner side of a side plate of the sleeve 10. The lefthand end of a support shaft 52 of the element 11 protrudes from a side plate of the sleeve 10 to be fixed to a bearing member 54 arranged at a side wall of the housing of the apparatus. The distal lefthand end of the shaft 52 is rotatably supported by an ellipse cam 55 of which the center is supported by a drive shaft 60 of a motor 59 which is positioned on the same axis as that of the shaft 52.

A righthand shaft 50 of the sleeve 10 is rotatably supported by a bearing member 56 arranged at a side wall of the housing of the apparatus, and an ellipse cam 57 having the same shape as that of the cam 55 is rotatably attached to the shaft 50. On the other hand, a lefthand part of the sleeve 10 is rotatably supported by the shaft 52 of the element 11 through a side plate 53 of the sleeve 10.

Figure 8:
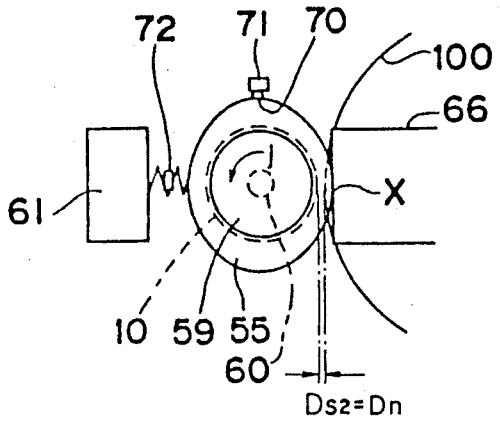
FIGS. 8 and 9 are side views of the gap adjusting mechanism.
Figure 9:
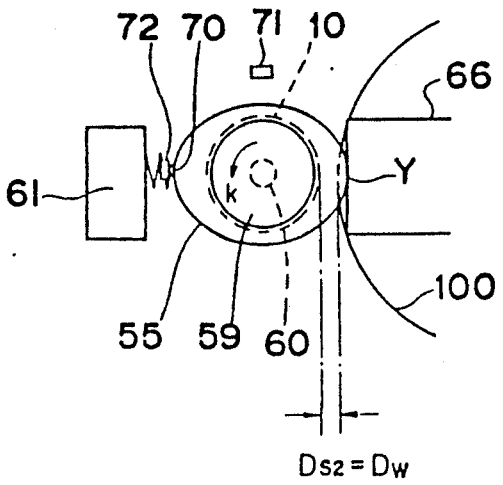

The cam 55 is connected with the cam 57 through a connecting member 58. As shown in FIG. 8 and 9, when the cams 55 and 57 are observed along the axis of the sleeve 10, the minor axis and the major axis of the cam 55 are designed to be the same as those of the cam 57, respectively.

The bearing members 54 and 56 are urged in a direction shown by an arrow (h) by spring members 62 and 64 arranged between support members 61 and 63 each fixed to the side wall of the housing to contact under pressure the cams 55 and 57 with press members 66 and 67 rotatably arranged at both ends of a support shaft 65 of the drum 100. Thus, the distances between the outer circumferential portions of the sleeve 10 and the drum 100, that is, the developing gaps $Ds_2$ are held to be the same value in the righthand and lefthand of the sleeve 10 and the drum 100 in FIG. 7.

As shown in FIGS. 8 and 9, an operating portion 70 is attached to the outer circumferential portion of one end of the major axis of the cam 55. As shown in FIG. 8, microswitches 71 and 72 are arranged around the outer circumferential portion of the cam 55, respectively. The microswitch 71 is arranged to be operated by the operating portion 70 when the outer circumferential portion of the cam 55 contacts with the press member 66 at one point X on the minor axis thereof. As shown in FIG. 9, the microswitch 72 is arranged to be operated by the operating portion 70 when the outer circumferential portion of the cam 55 contacts with the press member 66 at one point Y on the major axis thereof. As shown in FIG. 10, both of the microswitches 71 and 72 are electrically connected with the unit CPU to be capable of detecting by a turning-on signal and a turning-off signal of the microswitches 71 and 72 the states of the cams 55 and 57 and the developing gaps $Ds_2$.

According to the arrangement of the apparatus, the cams 55 and 57 are driven for synchronous rotation by the motor 59 to adjust the gap $Ds_2$ between the sleeve 10 and the drum 100.

Then, as shown in FIG. 8, when the cams 55 and 57 contact with the press members 66 and 67 on points X of the minor axes thereof, respectively each of the gaps $Ds_2$ is set to be a smallest value, and the adjusted state is detected by the turning-on signal of the microswitch 71 operated by the operating portion 70. A gap Dn shown in FIG. 8 is the same in dimension as the developing gap $Ds_1$ of the first developing device 1.

As shown in FIG. 9, when the cams 55 and 57 contact with the press members 66 and 67 on the points Y of the major axes thereof, each of the gaps $Ds_2$ is set to be a largest value, that is, the value of the gap Dw, and the adjusted state is detected by the turning-on signal of the microswitch 72 operated by the operating portion 70.

VI. Control operation

Hereinafter, the control operation in which the same electrostatic latent image is developed by each of the devices 1 and 2 to form a high quality image with the improved reproducibility of the density of a solid image thereof and the line image thereof will be explained referring to flow charts of FIGS. 14–16.

Figure 14:
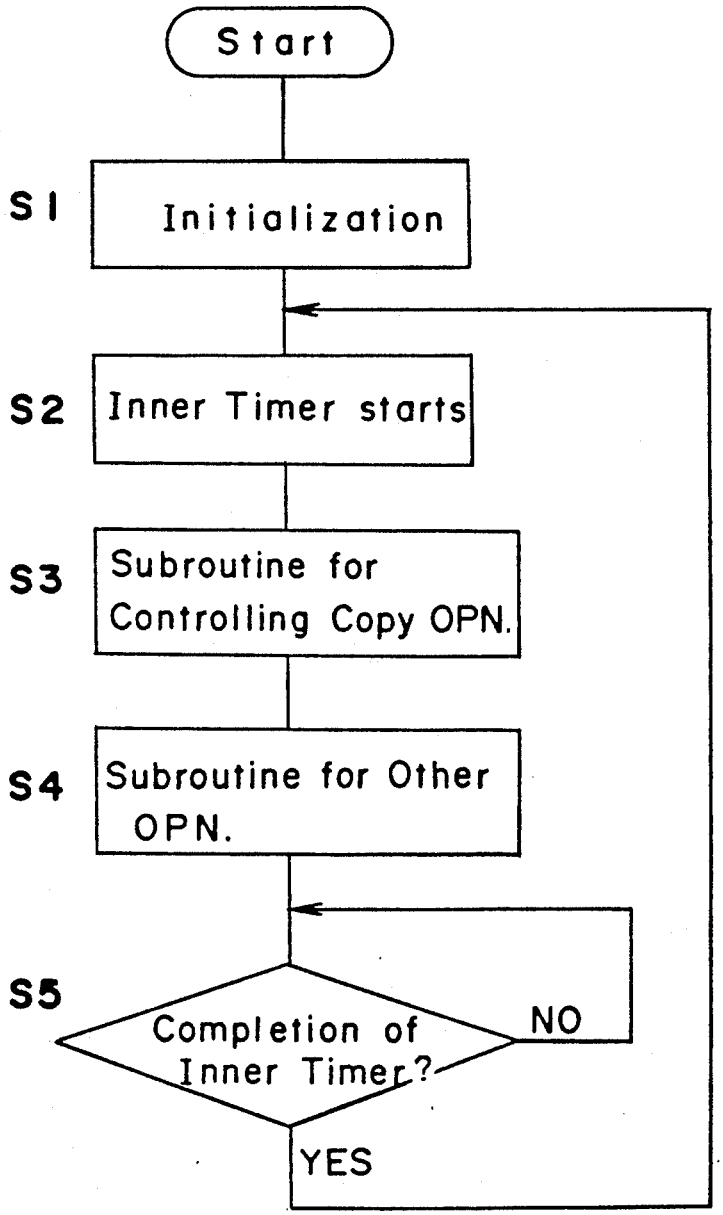
FIG. 14 is a flow chart showing the content of a main routine in the apparatus.

Main routine (referred to FIG. 14)

FIG. 14 shows the content of a main routine of the control operation to control the whole of the apparatus.

In this routine, when a power switch of the apparatus is turned on to start a program, the unit CPU is initialized at step S1 to set each of the members to initial modes.

At step S2, an inner timer initialized at step S1 is started. A time period of one routine in each subroutine unrelated to the contents of the following subroutines is set to be a constant value by the timer. Then, by utilizing the time period of the one routine as a standard, counting operations of various timers are executed in each subroutine.

At step S3, a subroutine for controlling the copy operation is executed. That is, the copy operation is executed by the subroutine in pressing the print key.

At step S4, a subroutine for an other operation such as a subroutine for adjusting the temperature of a fixing device is executed after calling up the subroutine. Since the content of the subroutine is not related to the present invention, a detailed explanation of the subroutine will be omitted.

At step S5, it is judged whether or not the inner timer set at step S2 has been completed, and then, the program returns to step S2 after waiting completion of the inner timer.

Figure 15:
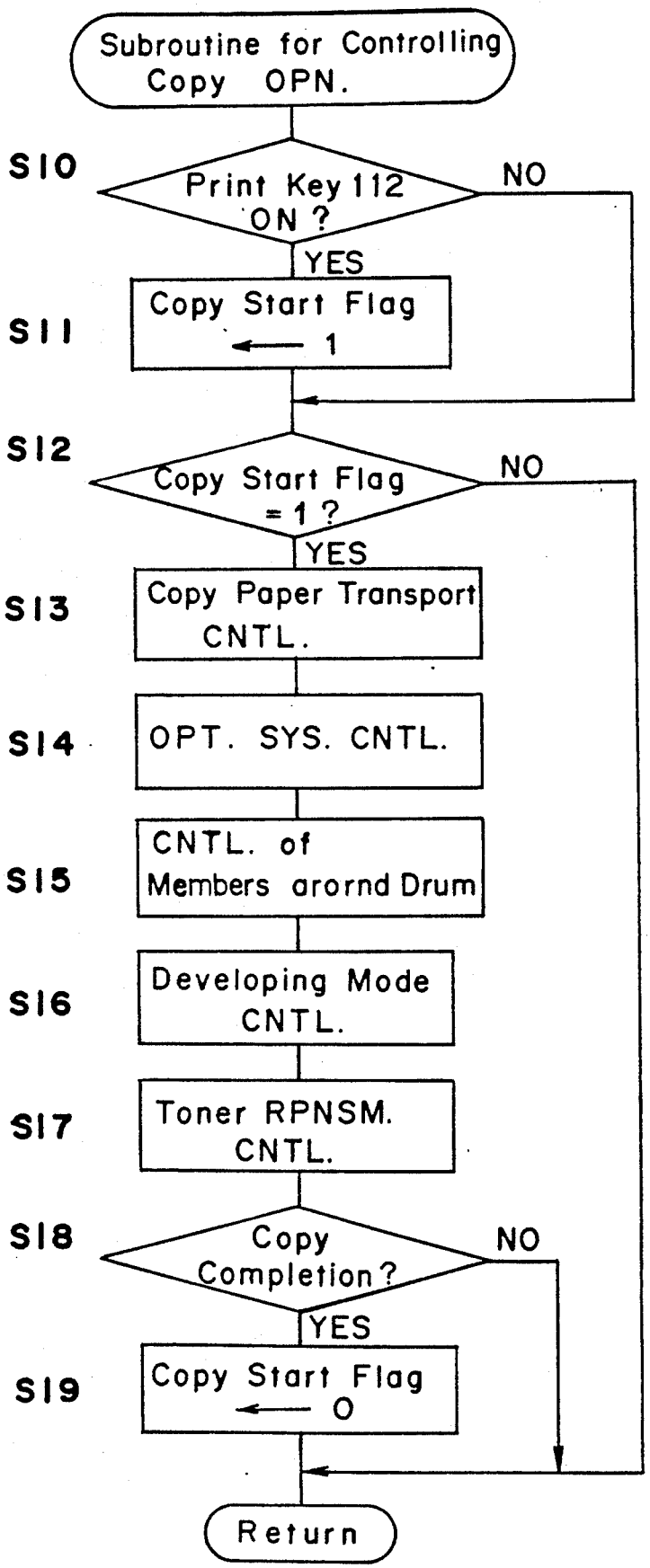
FIG. 15 is a flow chart showing the content of a subroutine for controlling a copy operation in the apparatus.

Subroutine for controlling the copy operation (referred to FIG. 15)

Next, the content of the subroutine for controlling the copy operation will be explained referring to FIG. 15.

In this subroutine, at step S10, it is determined whether the print key 112 on the panel 111 has been turned on. When an on-edge of the turning-on signal is detected by depressing the key 112, a copy start flag is set to 1 at step S11 to advance step S12. When the print key 112 is not depressed, the program advances step S12 without executing step 11. The copy start flag is a flag for judging whether the copy operation is executed. The flag is set to 1 by depressing the print key 112, and is reset to 0 by completion of the copy operation, as described at step S19.

At step S12, it is judged whether the flag is set at 1, and when the flag is 1, the steps after step S13 are executed, respectively. When the flag is 0, the program returns to the main routine without executing the steps after step S13, and then step S4 is executed.

At steps S13–S15, control operations for controlling the transfer of copy papers, optical systems, and various cocking operations and lumps arranged around the drum are executed, respectively.

At step S16, it is determined whether the color of the toner accommodated in the device 1 has been the same as that in the device 2, and whether the developing mode for development by using one of the devices 1 and 2 is selected or whether the developing mode for obtaining a high quality image by using both the devices 1 and 2 is selected. Thus, the drive transmission mechanism and the developing gap adjusting mechanism are set in specified states in correspondence with the color of the toner and the developing mode. The content of step S16 will be explained later.

At step S17, the toner replenishment control predescribed is executed to keep the adequate density of the toner in the devices 1 and 2.

At step S18, it is determined whether the copy operation has been completed. The flag is reset to 0 at step S19 when the copy operation is completed. The operation at step S19 is not executed when the copy operation is executing. Then, the program returns to the main routine to execute the program at step S4.

Figure 16:
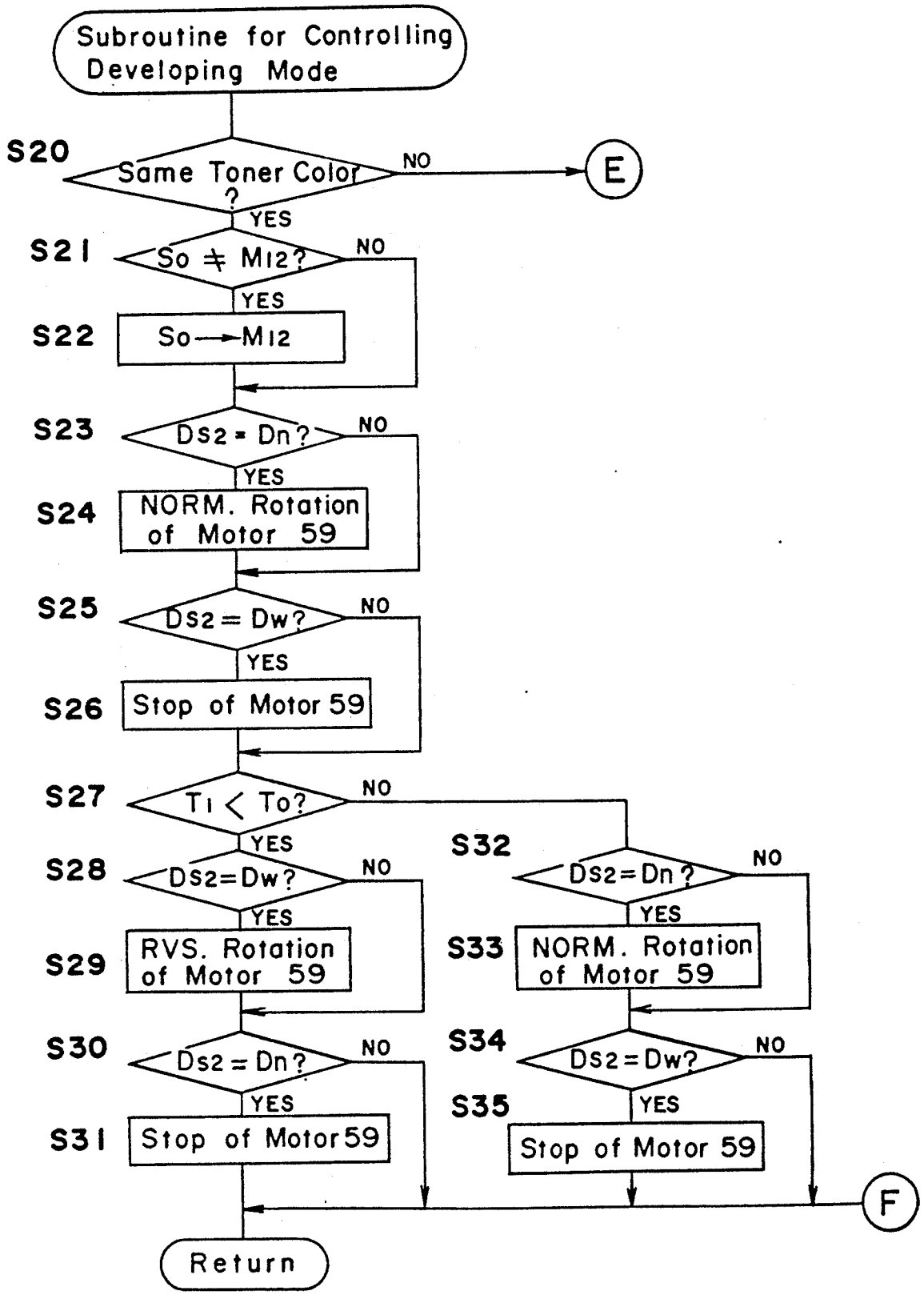
FIG. 16 is a flow chart showing the content of a subroutine for controlling a developing mode in the apparatus.
Figures 16, 16B:
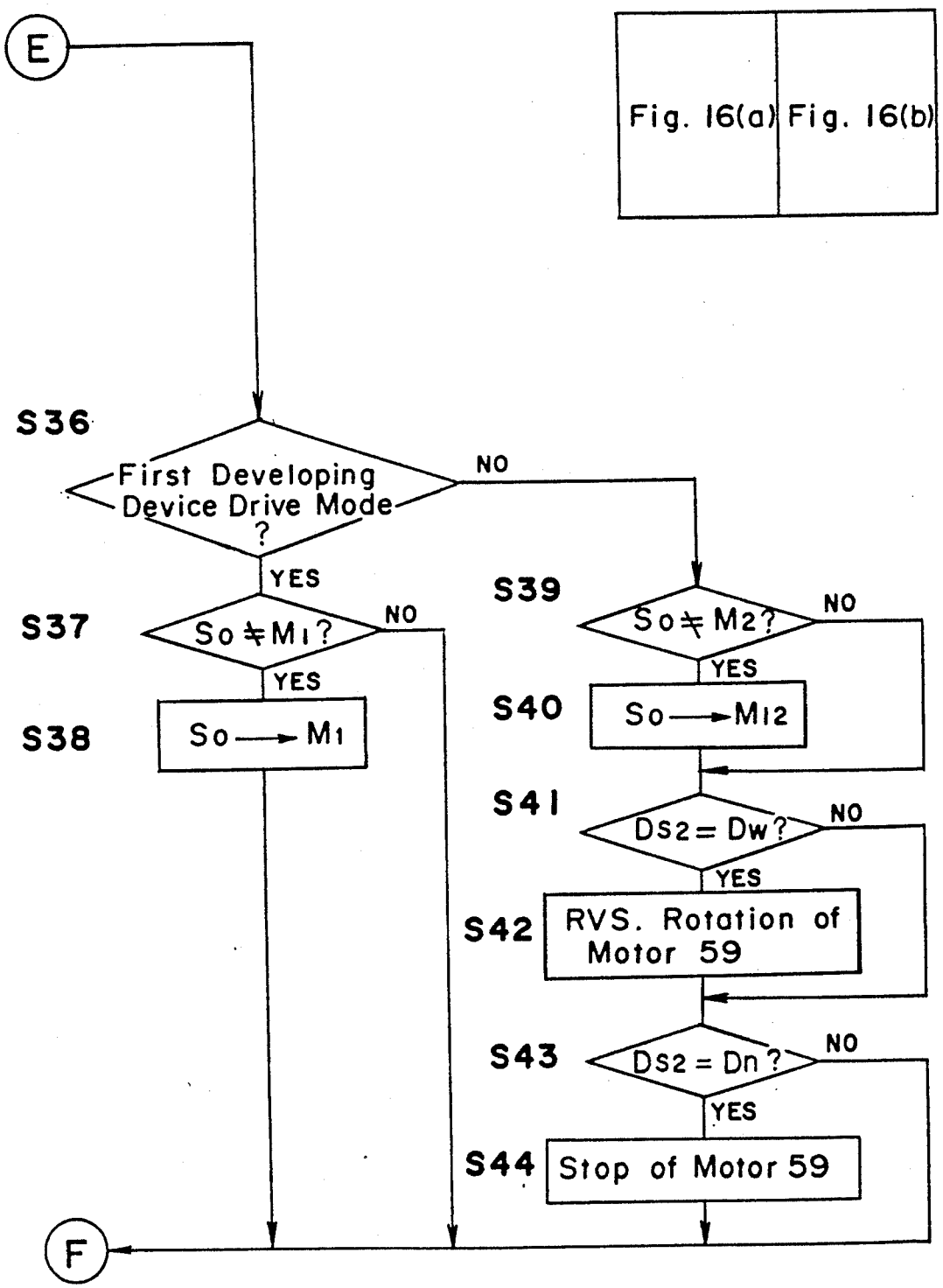

Subroutine for controlling the developing mode (referred to FIG. 16)

This subroutine is a routine for controlling the drive transmission mechanism and the developing gap adjusting mechanism in accordance with the colors of the toners accommodated in the devices 1 and 2 and the selected developing mode. At step S20, it is determined whether the color of the toner accommodated in the device 1 has been the same as that in device 2. The judgment is executed by detecting the toner color signal outputted from the toner color judging mechanism to the unit CPU.

The program advances step S21 when the color of the toner in the device 1 is the same as that in the device 2 at S20.

At step S21, it is judged whether the drive change mode (So) has been $M_{12}$, that is, both the devices 1 and 2 have been in operatable states. When the drive change mode (So) is not $M_{12}$, the mode (So) is changed into $M_{12}$ at step S22. When the mode (So) is $M_{12}$, the program advances step S23 without executing the operation at step S22. That is, both the devices 1 and 2 are set in the operatable states by the above control process.

At step S23, it is judged whether the developing gap $Ds_2$ has been set to the gap Dn ($=Ds_1$). That is, as shown in FIG. 8, the judgment is executed by detecting whether the microswitch 71 has been turned on. When the microswitch 71 is turned on, the developing gap $Ds_2$ has been set to the gap Dn.

According to the judged result, when the developing gap $Ds_2$ is equal to the gap Dn, the motor 59 is driven for rotation in a normal direction at step S24 to rotate the cams 55 and 57 in a direction shown by an arrow (j) as shown in FIG. 8.

Then, when the cams 55 and 57 rotate to the states shown in FIG. 9, the microswitch 72 is turned on by the operating portion 70 and it is judged that the developing $Ds_2$ has been set to the gap Dw at step S25, the motor 59 is stopped at step S26.

At steps S27–S35, a control process is executed in which the larger developing gap $Ds_2$ (=Dw) set in order to form a high quality image is changed into the smaller gap Dn similar to that in the device 1 in order to obtain the density required to a reproduced image in the device 2, in a case where the value of the toner density $T_1$ in the device 1, which has serious effects on the reproducibility of the density of the solid image, is smaller than the reference value $T_0$ even though the developing mode for obtaining the high quality image has been selected.

First, at step S27, it is judged whether the value of the toner density $T_1$ in the device 1 has been smaller than the reference value $T_0$.

Then, when it is judged that the value of the toner density $T_1$ in the device 1 has been smaller than the reference value $T_0$ at step S27 and that the developing gap $Ds_2$ in the device 2 has been set to the larger gap Dw at step S28, the motor 59 for adjusting the developing gap is driven for rotation in a reverse direction so that the developing gap $Ds_2$ becomes smaller at step S29. Then, when it is judged the developing gap $Ds_2$ has been the smaller gap Dn at step S30, the motor 59 is stopped at step S31, so that the program returns to the subroutine for controlling the copy operation to execute the operation at step S11.

According to the process described above, the density required to reproduce the image is maintained by the device 2.

On the other hand, when it is judged the value of the toner density $T_1$ has not been smaller than the reference value $T_0$, it is judged whether the developing gap $Ds_2$ has been the smaller gap Dn at step S32. When the developing gap $Ds_2$ is equal to the gap Dn, the motor 59 is driven so that the developing gap $Ds_2$ becomes larger at step S33. After that, when it is judged the developing gap $Ds_2$ is the larger gap Dw at step S34, the motor 54 is stopped at step S35 before the program returns to the subroutine for controlling the copy operation (referred to FIG. 15) to execute the operation at step S17.

When it is judged the color of the toner in the device 1 is different from that in the device 2 at step S20, the device 1 is driven so that it is judged whether the first developing device drive mode for driving the device 1 to develop has been selected at step S36.

Then, when the first developing device drive mode is selected, it is judged whether the drive change mode (So) has not been $M_1$, that is, the mode (So) has been set to either $M_2$ or $M_{12}$ at step S37. When the mode (So) is either $M_2$ or $M_{12}$, the mode (So) is changed into $M_1$ at step S38. When the mode (So) is $M_1$, the program returns to the subroutine for controlling the copy operation to execute the operation at step S11.

According to the process, when the developing mode for using only the device 1 is selected, only the device 1 is driven under the condition where the drive change mode (So) is $M_1$ and the device 2 is maintained in a non-operating state. Thus, the image is reproduced by only the device 1.

On the other hand, when it is judged the first developing device drive mode is not selected at step S36, that is, the second developing device drive mode for using only the device 2 is selected, it is judged whether the drive change mode (So) has not been $M_2$ at step S39, that is, the drive change mode (So) has been either $M_1$ or $M_{12}$. When the drive change mode (So) is either $M_1$ or $M_{12}$, the mode (So) is changed into $M_2$ at step S40.

At step S41, it is judged whether the developing gap $Ds_2$ has been set to the gap Dw. When the developing gap $Ds_2$ is set to the gap Dw, that is, the cams 55 and 57 are set to be in the state shown in FIG. 9, the motor 59 is driven for rotation in the reverse direction to rotate the cams 55 and 57 in a direction shown by an arrow (k) at step S42.

Then, at steps S43 and S44, when the cams 55 and 57 rotate to the state shown in FIG. 8, the microswitch 71 is turned on by the operating portion 70, and the developing gap $Ds_2$ is set to the gap Dn, the motor 59 is stopped so that the program returns to the subroutine for controlling the copy operation to execute the operation at step S11.

As described above, when the developing mode for using the device 2 only is selected, the drive change mode (So) is $M_2$. Thus, only the device 2 is driven, the device 1 is maintained in the non-operating state, and the image is reproduced by only the device 2.

VII. Modifications

Though two developing devices 1 and 2 are arranged around the drum 100 in the embodiment, three or more developing devices may be arranged therearound to execute the operations described above.

For example, in a case where three devices are arranged therearound, the colors of the toners accommodated in at least two devices thereof are the same and when a mode for using one of the devices is selected, both the devices may be simultaneously driven for development. In a case where the colors of the toners in all of the devices are the same, the developing gaps may be set to be gradually larger from the device arranged at the upstream side to that at the downstream side of the drum, so that all of the devices may be simultaneously driven for development.

The same character of developers may be accommodated in the devices. Also, developers having different character each which have a toner with different density and grain diameters, and a carrier with different kinds, grain diameters and shapes may be accommodated in each device.

For example, with respect to kinds of the carrier, since there is differences between the conventional binder type carrier and the conventional ferrite carrier in physical properties, both the carriers have advantageous and disadvantageous, respectively. Generally, the ferrite carrier has advantageous for reproducibility of density of a reproduced line image and disadvantageous for reproducibility of density of a half tone image, and the binder type carrier is suitable for reproducibility of density of a reproduced solid image but is slightly inferiorly reproduced a line image. With respect of lifetimes of the carriers, the former is inferior to the latter. The binder type carrier is comprised of one of acrylic resin, polyester resin, and epoxy resin in which magnetic powder and carbon black are fused and dispersed.

Therefore, the binder type carrier is accommodated in the first developing device 1 with the first priority for development order and the ferrite carrier is accommodated in the second developing device 2 with the second priority therefor, so that the excellent reproducibility RSI of density of a reproduced solid image is achieved by the device 1 and the excellent reproducibility RLI of density of a reproduced line image is achieved by the device 2, and thus, a high quality image which has high density of the reproduced solid image and is clear reproducibility of the reproduced line image is reproduced by the apparatus.

Since the toner in the device 1 is firstly supplied to an electrostatic latent image to reproduce the image with high density, the consumption amount of the toner in the device 1 is larger than that in the device 2 and the carrier in the device 1 intends to greatly wear out. Therefore, the life-time of the carrier in the device 1 may become longer by using the binder type carrier.

With respect to the density of the toner, though the high density of the toner in the developer results in high density of a reproduced image, the toner without charging increases to disadvantageously result in the increase in fog density of the reproduction image and splash of the toner.

Therefore, the density of the toner in the device 2 may be set to be lower than that in the device 1 to obtain a reproduced image with sufficient density in the device 1. Even if the toner without charging is supplied from the sleeve 10 of the device 1 to the surface of the drum 100, the toner without charging attached onto the surface of the drum 100 is scraped therefrom by the magnet brush of the device 2.

Then, the range of setting tolerance of the density of the toner in the device 1 may become wider to simply and easily control the density thereof.

Furthermore, though the devices 1 and 2 are so constructed that the sleeve 10 rotates around the fixed magnetic element 11 in the first embodiment and the modifications described above, the device may be so constructed either that the magnet element 11 rotates with the sleeve 10 or that only the element 11 rotates in the sleeve 10 fixed. That is, any device may be employed in the present invention in which a small developing gap is formed between a photosensitive drum and a developing sleeve confronting with the drum and a developer is transported along the outer circumferential portion of the drum while forming a magnetic brush to contact with an electrostatic latent image on the surface of the drum to be developed into a visible image.

Second embodiment

Next, FIGS. 17–20 show the second embodiment of the present invention in which the height regulating gap in the device 2 is changed to control the density of a reproduced image.

I. Construction and operation of developing unit

In the second embodiment, the device 2 has no mechanism for adjusting the developing gap Db but the device 2 has a height regulating gap adjusting mechanism for adjusting the height regulating gap Ds.

In the devices 1 and 2, the height regulating member 12 and a height regulating member 81 each confront with the upper of the outer circumferential portion of each sleeve 10. The height regulating member 12 in the first developing device 1 is integrally formed with the upper casing 4 so that the height regulating gap $Db_1$ between the sleeve 10 and the height regulating member 12 is maintained to be a constant value. The height regulating member 81 in the second developing device 2 is capable of moving forward and backward toward the sleeve 10 to adjust the height regulating gap $Db_2$ by the height regulating gap adjusting mechanism described later.

II. Image forming characteristics

In the image forming apparatus according to the second embodiment, there is a close relation between developer packaged density (F) in the developing regions $X_1$ and $X_2$ confronting the sleeves 10 with the drum 100 and the quality of a reproduced image. The packaged density (F) is calculated by the equation which is $$F = Vd/Db,$$

where Vd is an amount of the developer passed through between the sleeve 10 and drum 100 per hour, and Db is the height regulating gap. Then, referring to FIGS. 11 and 12, it will be explained hereinafter how the reproduced image is changed with the packaged density (F) which is changed with the gap Db.

FIGS. 11 and 12 also show examples indicating a relation between the height regulating gap Db and both of the reproducibility RSI and RLI of the density of a reproduced image and a reproduced line image under the following condition. FIG. 11 shows the example in a second standard mode in which the developing gap Ds is set to 0.6 mm and the height regulating gap Db is set to 0.5 mm, that is, the developing condition I. FIG. 12 shows the example in a second line reproduction mode in which the developing gap Ds is set to 0.6 mm and the height regulating gap Db is set to 0.2 mm, that is, the developing condition II.

The experimental condition of the examples is almost the same as that of the first embodiment but it is different in that each of the developing gap Ds is 0.6 mm and the height regulating gaps Db are 0.5 mm and 0.2 mm in the sleeves 10, respectively.

As a result, as shown in FIG. 11, when the developing device is set to the second standard mode in which the developing gap Ds is 0.6 mm and the height regulating gap Db is 0.5 mm, the reproducibility RSI of the density of a reproduced solid image is about 1.4 and the reproducibility RLI of the density of a reproduced line image which indicates that the original line image is reproduced as a line lies in the range of 0.9–1.2 and an original line image with lower density than the density of the original line image can not be reproduced as a line.

On the other hand, as shown in FIG. 12, when the developing device is set to the second line reproduction mode in which the gap developing Ds is 0.6 mm and the height regulating gap Db is 0.2 mm, the reproducibility RSI of the density of a reproduced solid image is about 0.8, the reproducibility RLI of the density of a reproduced line image lies in the range of 0.4–0.6, and an original line image with lower density than the density of the original line image may nct be reproduced as a line.

Thus, as shown in Table 1 described previously, when the height regulating gap Db is set to be smaller so that the developer packaged density (F) becomes lower, the reproducibility RLI of the density of the line image is improved but it causes the density of the reproduced solid image to be lower to result in the worse reproducibility RSI of the density thereof.

Conversely, when the height regulating gap Db is set to be larger so that the developer packaged density (F) becomes higher, the density of the reproduced solid image becomes higher to improve the reproducibility RSI of the density thereof but it results in the bad reproducibility RLI of the density of the line image.

Thus, in the developing devices 1 and 2, either the reproducibility RSI of the density of the reproduced solid image or the reproducibility RLI of the density of the reproduced line image becomes worse and both of them may not be improved simultaneously, as far as only one of the devices is employed.

However, if two devices are, respectively, set to the following different conditions and are driven simultaneously, the latent image is developed into a visible image in the similar manner as the manner of the first embodiment in which the developing gap Ds is adjusted to control the reproduced image. Here, the different conditions are cases where toners in the same color are accommodated in the first and second developing devices 1 and 2, respectively, and the height regulating gap $Db_2$ of the second developing device 2 is larger than that $Db_1$ of the first developing device 1, so that the developer packaged density (F) at the developing region $X_2$ is lower than that (F) at the developing region $X_1$.

That is, first, after an operation for forming an electrostatic latent image on the surface of the drum 100 is executed, the toner in the first developing device 1 is supplied to the latent image on the drum 100 by the first developing device 1 at the developing region $X_1$.

Here, as described above, since the height regulating gap $Db_1$ is set to be smaller than the height regulating gap $Db_2$, the developer in the device 1 frequently is contacted with the latent image to be sufficiently supplied thereto for development. The toner attached to an electrostatic latent image of a line image is often scraped off by the magnetic brush and thus the little toner is attached to the latent image of the line image passed through the developing region $X_1$. After the toner attached to the latent image is scraped off, the latent image has still been maintained in a charging state.

Next, the toner in the second developing device 2 is supplied to the latent image transported to the developing region $X_2$ by the second developing device 2 to be supplied to the toner image formed at the developing region $X_1$.

Then, the toner in the device 2 is supplied to the latent image of the line image by the device 2 to which the toner attached is scraped off by the magnetic brush at the developing region $X_1$.

Since the value of the packaged density (F) at the developing region $X_2$ is smaller than that (F) at the region $X_1$, the toner attached to the latent image is seldom scraped off by the magnetic brush. Then, the latent image of the line image passes through the developing region $X_2$ while the toner sufficient to be developed into a visible image is attached to the latent image of the line image.

Therefore, most of literal images and solid images are reproduced with the sufficient density thereof and the line image is reproduced as a line image sufficient to be visible.

Sequentially, the developing gaps Ds and the height regulating gaps Db of the developing devices 1 and 2 set to the experimental condition described above are, respectively, changed into the values described in Table 4. Then, both of the devices 1 and 2 are simultaneously driven to form a reproduced image corresponding to the same original image under the different condition by each of the devices 1 and 2, and thus the resulting reproducibility RSI and RLI of the density of the solid image and the line image will be explained below.

TABLE 4

| | Developing gap Ds (mm) | Height regulating gap Db (mm) |
|---|---|---|
| First developing device 1 | 0.4 | 0.5 |
| Second developing device 2 | 0.6 | 0.2 |

The developing conditions III and IV in FIG. 13, respectively, show cases where each of the devices 1 and 2 is solely driven in the manner described above, respectively. The developing gap Ds is 0.4 mm and the height regulating gap Db is 0.5 mm in the developing condition III, and the developing gap Ds is 0.6 mm and the height regulating gap Db is 0.2 mm in the developing condition IV. The reproducibility of the density of the reproduced solid image formed by the first developing device 1 with high packaged density (F) is about 1.4 and the reproducibility of the density of the reproduced line image formed thereby lies in the range of 0.9–1.2. On the other hand, the reproducibility of the density of the reproduced solid image formed by the second developing device 2 with lower packaged density (F) than that of the device 1 is about 0.8 and the reproducibility of the density of the reproduced line image formed thereby lies in the range of 0.4–0.6.

Here, the developing condition V in FIG. 13 shows a case where both of the devices 1 and 2 are simultaneously driven to develop the same latent image by each of the devices 1 and 2 at each of the developing regions $X_1$ and $X_2$. As shown in the condition V, the reproducibility of the density of the reproduced solid image is about 1.4 and the reproducibility of the density of the reproduced line image lies in the range of 0.4–0.6.

That is, the result in the developing condition III done by the first developing device 1 and the result in the developing condition V done by both of the devices 1 and 2 are the same reproducibility RSI of the density of the solid image. The result in the developing condition case IV done by the second developing device 2 and the result in the developing condition V done by both of the devices 1 and 2 are the same reproducibility RLI of the density of the line image. Then, the developing conditions V may cause both of the reproducibility of the density of the solid image and the line image to improve simultaneously.

Then, in the image forming apparatus according to the second embodiment of the present invention, when it is judged that the toners accommodated in the devices 1 and 2 have had the same color, the height regulating gap $Db_2$ in the device 2 is set to be smaller than that $Db_1$ of the device 1 so that the packaged density (F) at the region $X_2$ becomes lower than that (F) at the region $X_1$, and then, both of the devices 1 and 2 are simultaneously driven to obtain the high quality image with the improved reproducibility of the density of the solid image and the line image. In order to obtain the high quality image, the image forming apparatus has the toner color judging mechanism, the drive transmission mechanism, and a height regulating gap adjusting mechanism as described below. Since both the toner color judging mechanism and the drive transmission mechanism are the same as those of the first embodiment, the explanation of them will be omitted and only the height regulating gap adjusting mechanism will be explained below.

III. Height regulating gap adjusting mechanism

Figure 17:
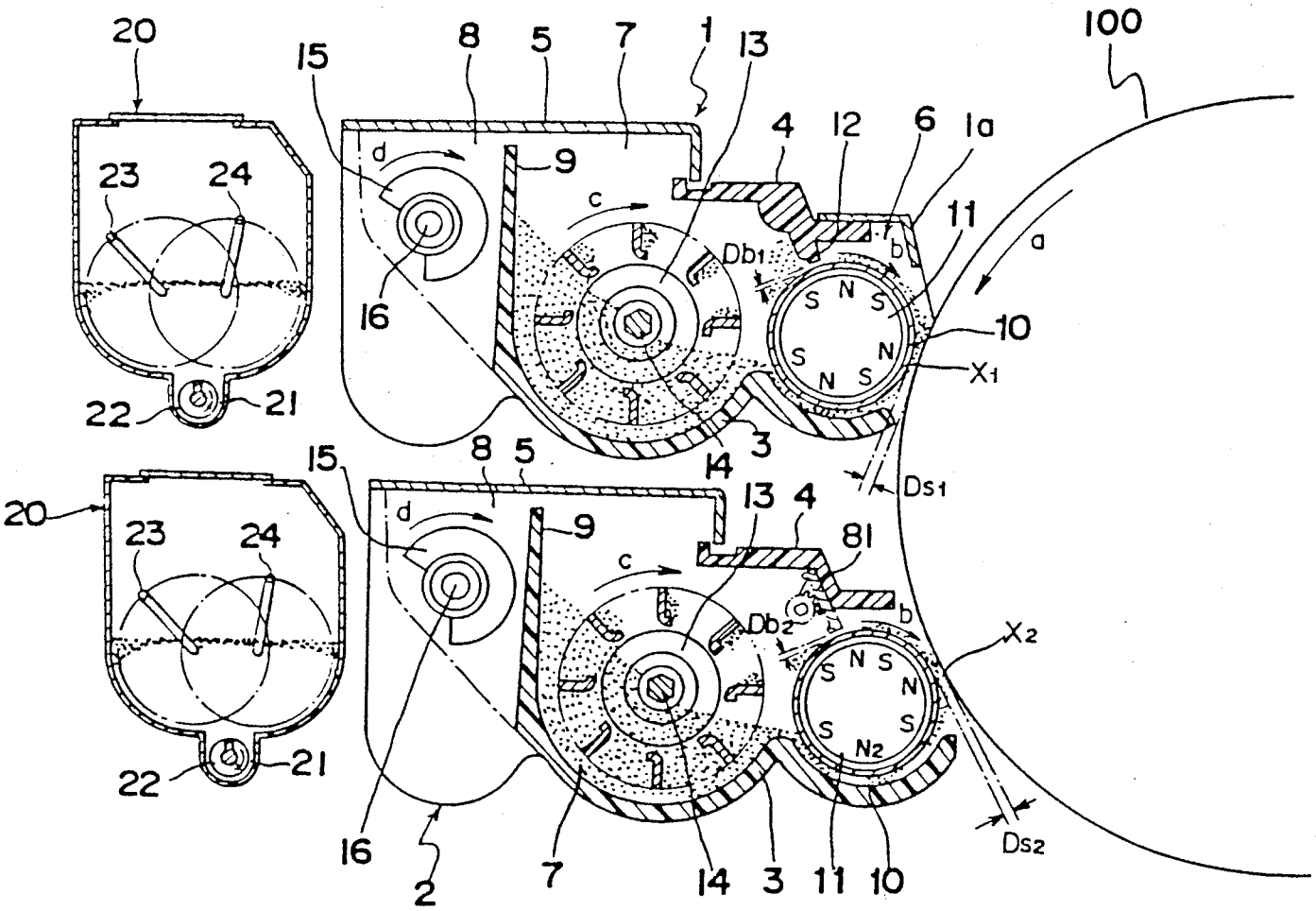
FIG. 17 is a sectional view of a developing unit of an image forming apparatus according to the second embodiment of the present invention.
Figure 18A:
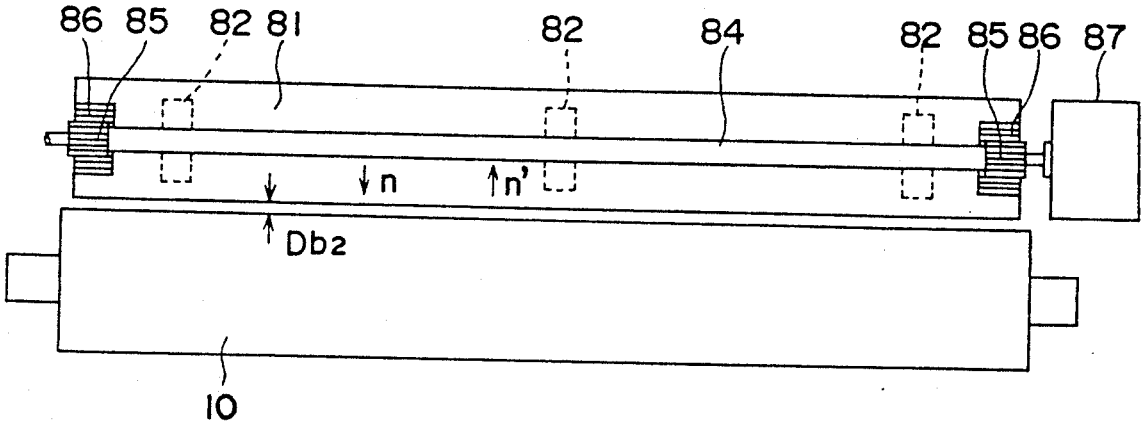
FIGS. 18A and 18B are plan views of a height regulating gap adjusting mechanism in the apparatus shown in FIG. 17.
Figure 18B:
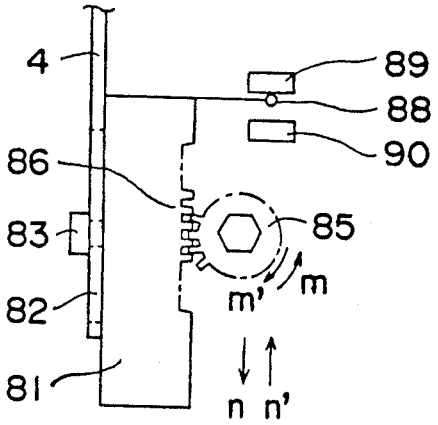

As shown in FIGS. 17, 18A, and 18B, plural guide grooves 82 extending toward the sleeve 10 are formed at the upper casing 4 supporting a height regulating member 81 of the device 2. The top of a bolt 83 movably attached into each of the guide grooves 82 is fixed to the height regulating member 81 so that the height regulating member 81 may move to approach and separate from the sleeve 10 through the bolts 83.

A shaft 84 of which both ends are rotatably supported by bearing portions (not shown) is arranged behind the height regulating member 81. Pinions 85 fixed to the both ends of the shaft 84 engage with racks 86 formed on the back face of the height regulating member 81. The one end of the shaft 84 is connected with a height regulating gap adjusting motor 87. The motor 87 is driven to reversely rotate by a signal outputted from a central processing CPU unit shown in FIG. 19.

As shown in FIG. 18B, a moving contact 88 is attached to the height regulating member 81, and fixed contacts 89 and 90 are arranged above and under the moving contact 88 through gaps, respectively.

When the developing gap $Db_2$ of the device 2 is set to the gap Dw equal to the developing gap $Db_1$ of the device 1, the moving cintact 88 contacts with the upper fixed contact 89. When the developing gap $Db_2$ of the device 2 is set to the smaller gap Dn than the developing gap $Db_1$ of the device 1, the moving contact 88 contacts with the lower fixed contact 90.

Figure 19:
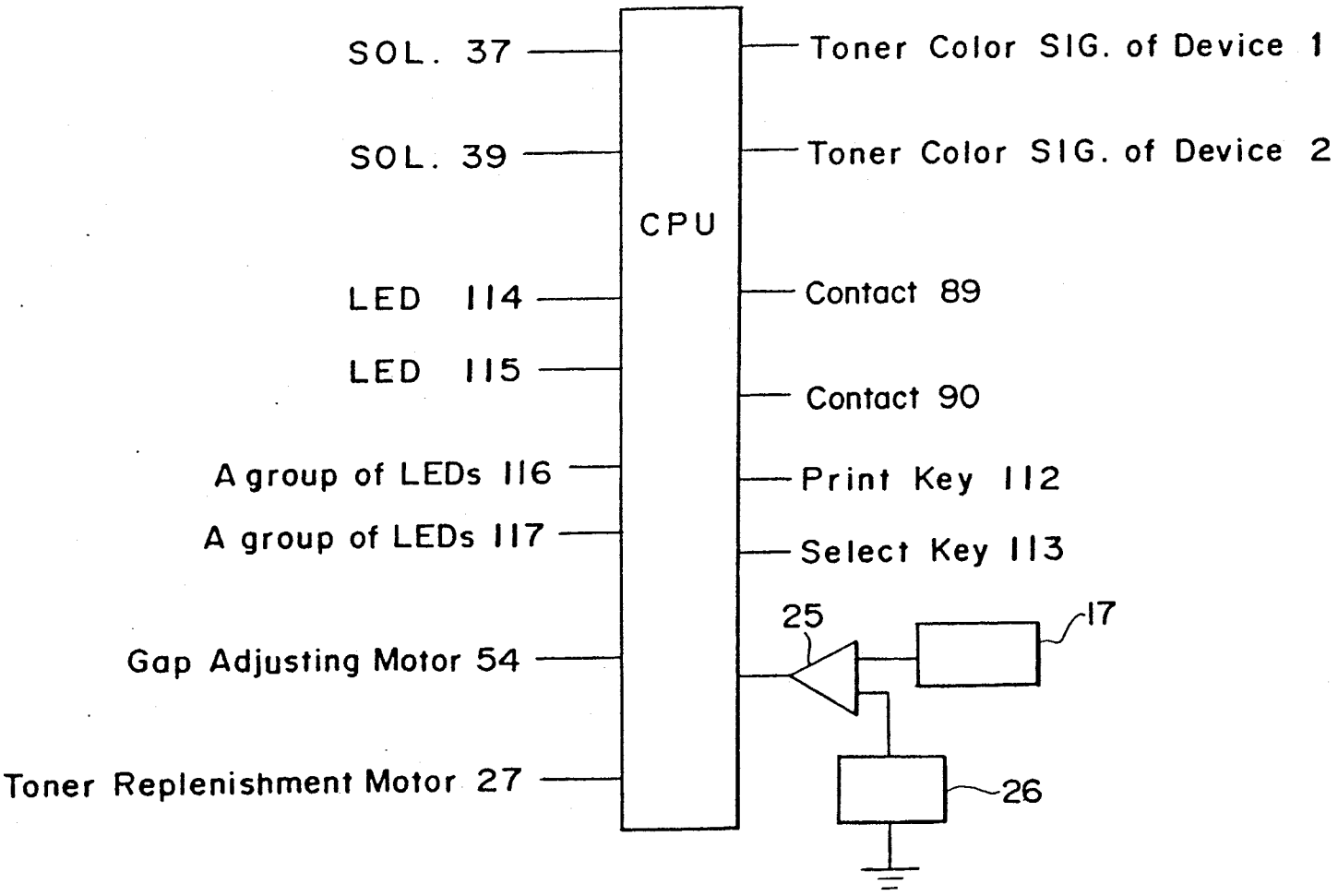
FIG. 19 is a control circuit diagram in the apparatus shown in FIG. 17.

Both the fixed contact 89 and 90 are electrically connected with the CPU unit so that a turning-on signal produced in contacting the moving contact 88 with each of the fixed contacts 89 and 90 is inputted into the CPU unit, as shown in FIG. 19.

According to the height regulating adjusting mechanism having the arrangement described above, when the motor 87 rotates in the normal direction, the pinions 85 rotate in a direction shown by an arrow (m) to move the height regulating member 81 in a direction shown by an arrow (n) so that the height regulating gap $Db_2$ becomes smaller.

Then, when the moving contact 88 contacts with the fixed contact 90, the turning-on signal produced thereby is inputted into the CPU unit so that the motor 87 is stopped by the CPU unit to set the developing gap $Ds_2$ to the gap Dn.

Conversely, when the motor 87 rotates in the reverse direction, the pinions 85 rotate in a direction shown by an arrow (m') to move the height regulating member 81 in a direction shown by arrow (n') so that the height regulating gap $Db_2$ becomes larger.

Then, when the height regulating member 81 moves upwardly to contact the moving contact 88 with the fixed contact 89, the turning-on signal produced by contacting the moving contact 88 with the fixed contact 89 is inputted into the CPU unit so that the motor 87 is stopped by the CPU unit to set the developing gap $Db_2$ to the gap Dw equal to the developing gap $Db_1$.

IV. Control operation

The main routine and the subroutine for controlling the copy operation of the second embodiment are the same as those of the first embodiment but the subroutine for controlling the developing mode of the second embodiment is different from that of the first embodiment. Therefore, the subroutine for controlling the develcping mode thereof will be explained hereinafter, referring to FIG. 20.

Figure 20:
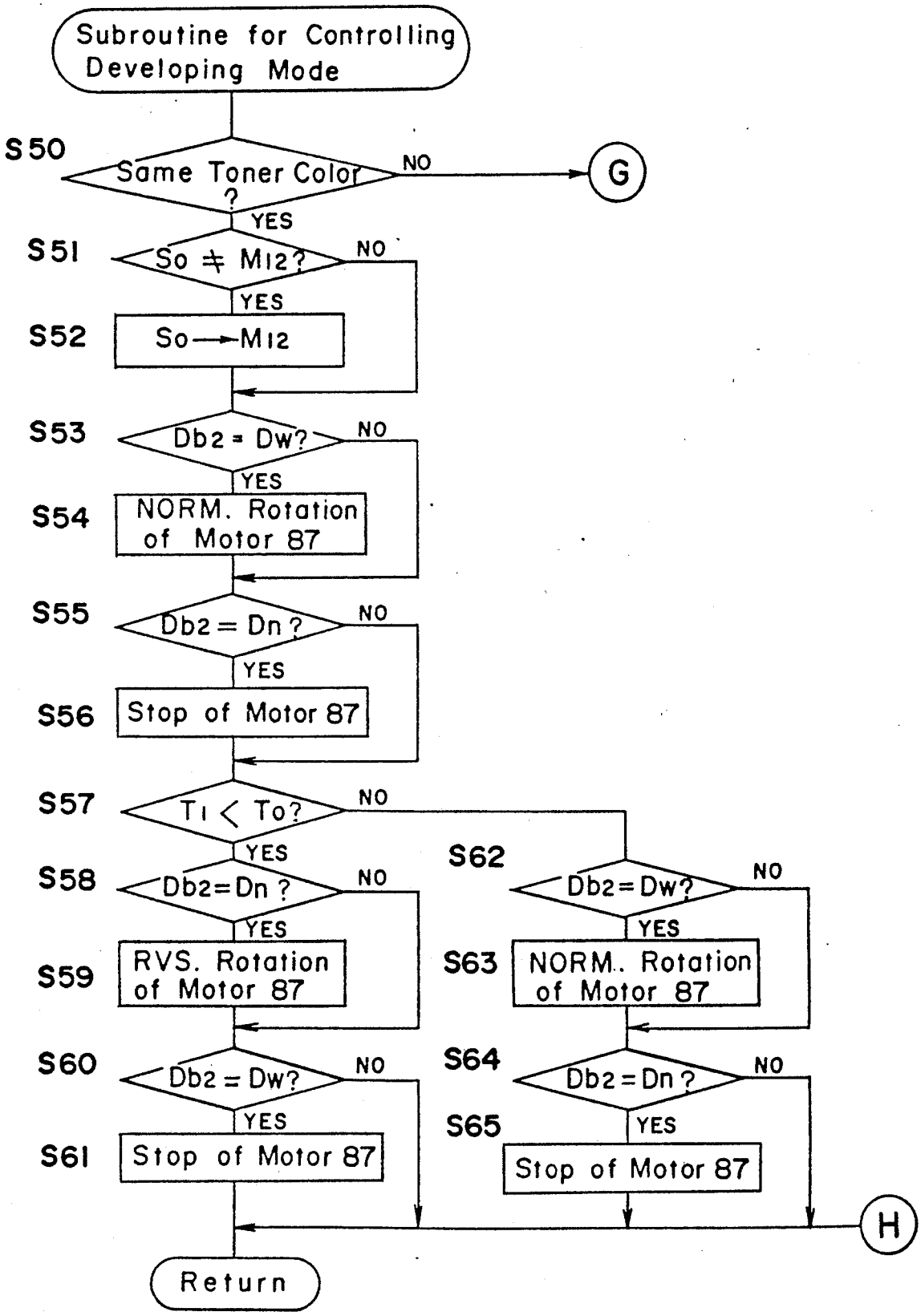
FIG. 20 is a flow chart showing the content of a subroutine for controlling a developing mode in the apparatus shown in FIG. 17.
Figure 20:
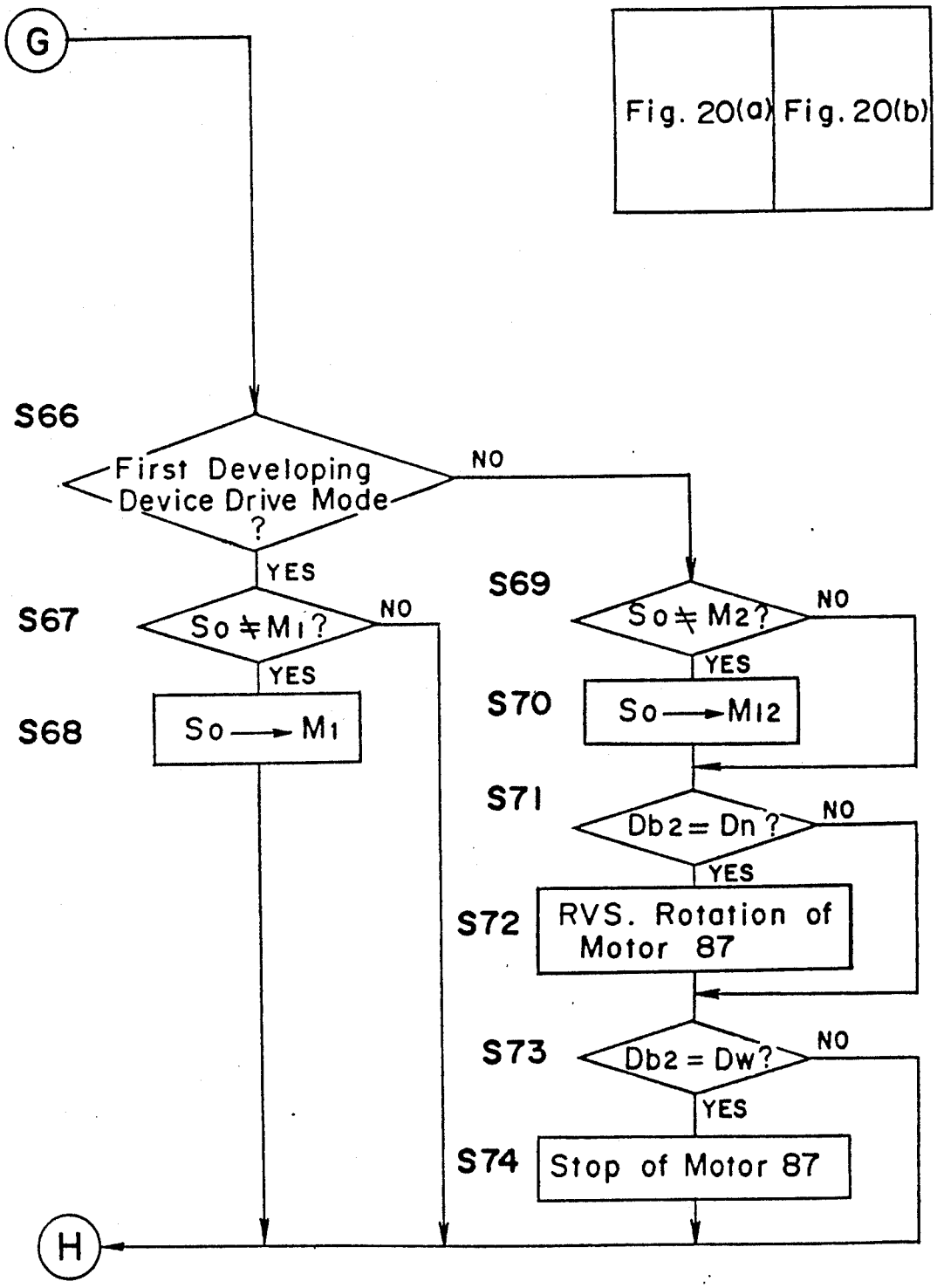

Subroutine for controlling the developing mode (referred to FIG. 20)

This subroutine is a routine for controlling the drive transmission mechanism and the height regulating gap adjusting mechanism in correspondence with the colors of the toners accommodated in the devices 1 and 2 and the selected developing mode. At step S50, it is judged whether the color of the toner accommodated in the device 1 has been the same as that in device 2. The judgment is executed by detecting the toner color signal outputted from the toner color judging mechanism to the CPU unit.

The program advances step S51 when the color of the toner in the device 1 is the same as that in the device 2 at step S50.

At step S51, it is determined whether the drive change mode (So) has been $M_{12}$, that is, both the devices 1 and 2 have been in operatable states. When the drive change mode (So) is not $M_{12}$, the mode (So) is changed into $M_{12}$ at step S52. When the mode (So) is $M_{12}$, the program advances step S53 without executing the operation at step S52. That is, both the devices 1 and 2 are set in the operatable states by the above control process.

At step S53, it is determined whether the height regulating gap $Db_2$ has been set to the larger gap Dw. That is, as shown in FIG. 18B, the judgment is executed by detecting the contact state, that is, detecting whether either the fixed contact 89 or 90 has contacted with the moving contact 88. When the fixed contact 89 contacts with the moving contact 88 to be in the turning-on state the height regulating gap $Db_2$ is set to the larger gap Dw. When the fixed contact 90 contacts with the moving contact 88 to be in the turning-on state, the height regulating gap $Db_2$ is set to the smaller gap Dn.

According to the judged result, when the height regulating gap $Db_2$ is equal to the gap Dw, the motor 87 is driven for rotation in a normal direction at step S54 to rotate the pinions 86 and 86 in the direction shown by the arrow (m) to move move the height regulating member 81 in the direction shown by the arrow (n) as shown in FIG. 18A.

Then, at step 55, when the moving contact 88 contacts with the fixed contact 90 to be in the turning-on state by the movement of the height regulating member 81 and the height regulating gap Db is set to the smaller gap Dn, the motor 87 is stopped at step S56.

At steps S57–S65, a control process is executed in which the larger height regulating gap $Db_2$ (=Dw) set in order to form a high quality image is changed into the smaller gap Dn in order to obtain the density required to a reproduced image in the device 2, in a case where the value of the toner density $T_1$ in the device 1, which has serious effects on the reproducibility of the density of the solid image, is smaller than the reference value $T_0$ even though the developing mode for obtaining the high quality image has been selected.

First, at step S57, it is judged whether the value of the toner density $T_1$ in the device 1 has been smaller than the reference value $T_0$.

Then, when it is judged that the value of the toner density $T_1$ in the device 1 has been smaller than the reference value $T_0$ at step S57 and that the height regulating gap $Db_2$ in the device 2 has been set to the smaller gap Dn (=$Db_2$) at step S58, the motor 87 for adjusting the height regulating gap is driven for rotation in a reverse direction so that the height regulating gap $Db_2$ becomes larger at step S59. Then, when it is judged the height regulating gap $Db_2$ has been the larger gap Dw at step S60, the motor 87 is stopped at step S61, so that the program returns to the subroutine for controlling the copy operation to execute the operation at step S11.

According to the process described above, the density required to reproduce the image is maintained by the device 2.

On the other hand, when it is judged the value of the toner density $T_1$ has not been smaller than the reference value $T_0$ at step S57, it is judged whether the height regulating gap $Db_2$ has been the larger gap Dw at step S62. When the height regulating gap $Db_2$ is equal to the larger gap Dw, the motor 87 is driven so that the height regulating gap $Db_2$ becomes smaller at step S63. After that, when it is judged the height regulating gap $Db_2$ is the smaller gap Dn at step S64, the motor 87 is stopped at step S65 before the program returns to the subroutine for controlling the copy operation (referred to FIG. 15) to execute the operation at step S17.

When it is judged the color of the toner in the device 1 is different from that in the device 2 at step S50, the device 1 is driven so that it is judged whether the first developing device drive mode for driving the device 1 to develop has been selected at step S66.

Then, when the first developing device drive mode is selected, it is judged whether the drive change mode (So) has not been $M_1$, that is, the mode (So) has been set to either $M_2$ or $M_{12}$ at step S67. When the mode (So) is either $M_2$ or $M_{12}$, the mode (So) is changed into $M_1$ at step S68. When the mode (So) is $M_1$, the program returns to the subroutine for controlling the copy operation to execute the operation at step S11.

According to the process, when the developing mode for using only the device 1 is selected, only the device 1 is driven under the condition where the drive change mode (So) is $M_1$ and the device 2 is maintained in a non-operating state. Thus, an image is reproduced by only the device 1.

On the other hand, when it is judged the first developing device drive mode is not selected at step S66, that is, the second developing device drive mode for using only the device 2 is selected, it is judged whether the drive change mode (So) has not been $M_2$ at step S69, that is, the drive change mode (So) has been either $M_1$ or $M_{12}$. When the drive change mode (So) is either $M_1$ or $M_{12}$, the mode (So) is changed into $M_2$ at step S70.

At step S71, it is judged whether the height regulating gap $Db_2$ has been set to the smaller gap Dn. When the height regulating gap $Db_2$ is equal to the gap Dn, the motor 87 is driven for rotation in the reverse direction to move the height regulating member 81 in the direction shown by the arrow (n') at step S72 as shown in FIG. 18B.

Then, at steps S73 and S74, when it is judged the height regulating member 81 has been the larger gap Dw, the motor 87 is stopped, so that the program returns to the subroutine for controlling the copy operation to execute the operation at step S11.

As described above, when the developing mode for using only the device 2 is selected, the drive change mode (So) is $M_2$. Thus, only the device 2 is driven, the device 1 is maintained in the non-operating state, and the image is reproduced by only the device 2.

V. Modifications

Though two developing devices 1 and 2 are arranged around the drum 100 in the second embodiment, three or more developing devices may be arranged therearound to execute the operations described above.

For example, in a case where three devices are arranged therearound and the colors of the toners in all of the devices are the same, the height regulating gaps may be set to be gradually larger from the device arranged at the upstream side to that arranged at the downstream side of the drum, respectively, and then, all of the devices may be simultaneously driven for development.

Third embodiment

Next, FIGS. 21–24 show the third embodiment of the present invention, in which the peripheral speed of the sleeve in the device 2 is changed to control the density of the a reproduced image.

I. Image forming characteristics

In the image forming apparatus comprising the developing devices 1 and 2, there is the close relation between developer packaged density (F) in the developing regions $X_1$ and $X_2$ confronting the sleeve 10 with the drum 100 and the quality of a reproduced image, as described in the first embodiment. The packaged density (F) is calculated by the equation which is $$F = Vd/Ds,$$

where Vd is an amount of the developer passed through between the sleeve 10 and drum 100 per hour, and Ds is the developing gap. Then, since there is a proportional relation between the peripheral speed of the sleeve 10 and the amount of the developer transported to the regions $X_1$ and $X_2$, it will be explained hereinafter how the reproduced image is changed with the amount of the developer transported to each of the regions $X_1$ and $X_2$ per hour and the packaged density (F), which are changed with the speed ratio $\theta$ of the peripheral speed of the sleeve 10 to the peripheral speed of the drum 100, referring to FIGS. 11 and 12. The speed ratio is calculated by the equation which is $$\theta = \text{(the peripheral speed of the sleeve 10)/(the peripheral speed of the drum 100)}.$$

FIGS. 11 and 12 show examples indicating a relation between the peripheral speed and both of reproducibility RSI and RLI of density of a reproduced solid image and a reproduced line image under the following condition. FIG. 11 shows the example in a third standard mode in which the peripheral speed $\theta$ is set to 1.75, that is, the developing condition I. FIG. 12 shows the example in a third line reproduction mode in which the height regulating gap $\theta$ is set to 1.25, that is, the developing condition II.

The experimental condition of each example is almost the same as that of the first embodiment but it is different that the peripheral speeds of the sleeves 10 are 262.5 mm/sec ($\theta$=1.75) and 187.5 mm/sec ($\theta$=1.25), respectively.

As shown in FIG. 11, when the developing device is set to the third standard mode in which the speed ratio is 1.75, reproducibility RSI of density of a reproduced solid image is about 1.4 and reproducibility RLI of density of a reproduced line image which indicates that the original line image is reproduced as a line lies in the range of 0.9–1.2 and an original line image with the lower density than the density of the original line image can not be reproduced as a line.

On the other hand, as shown in FIG. 12, when the developing device is set to the third line reproduction mode in which the speed ratio is 1.25, the reproducibility of the density of the reproduced solid image is about 0.8, the reproducibility of the density of the reproduced line image lies in the range of 0.4–0.6, and an original line image with the lower density than the density of the original line image may not be reproduced as a line.

Thus, as shown in Table 1 described previously, when the speed ratio is set to be smaller so that the developer packaged density (F) at the region becomes lower, the reproducibility RLI of the density of the line image is improved but it causes the density of the reproduced solid image to be lower to result in the worse reproducibility of the density of the reproduced solid image.

Conversely, when the speed ratio is set to be larger so that the developer packaged density (F) at the region becomes higher, the density of the reproduced solid image becomes higher to improve the reproducibility of the density thereof but it results in the worse reproducibility of the density of the line image.

Thus, in the developing devices 1 and 2, either the reproducibility RSI of the density of the reproduced solid image or the reproducibility RLI of the density of the line image becomes worse and both of them may not be improved simultaneously, as far as only one of the devices is employed.

However, if two devices are, respectively, set to the following different conditions and are driven simultaneously, the latent image is developed into a visible image in the following manner. Here, the different conditions are cases where toners in the same color are accommodated in the first and second developing devices 1 and 2, respectively, and the speed ratio of the second developing device 2 is smaller than that of the first developing device 1, so that the developer packaged density (F) at the developing region $X_2$ is lower than that (F) at the developing region $X_1$.

First, after an operation for forming an electrostatic latent image on the surface of the drum 100 is executed, the toner in the first developing device 1 is supplied to the latent image on the drum 100 by the first developing device 1 at the developing region $X_1$.

Here, as described above, since the speed ratio in the device 1 is set to be larger than the speed ratio in the device 2, the developer in the device 1 frequently is contacted with the latent image to be sufficiently supplied thereto for development, as compared with that in the device 2. The toner attached to an electrostatic latent image of a line image is often scraped off by the magnetic brush and thus the little toner is attached to the latent image of the line image passed through the developing region $X_1$. After the toner attached to the latent image is scraped off, the latent image has still been maintained in a charging state.

Next, the toner in the second developing device 2 is supplied to the latent image transported to the developing region $X_2$ by the second developing device 2 to be supplied to the toner image formed at the developing region $X_1$.

Then, the toner in the device 2 is supplied to the latent image of the line image by the device 2 to which the toner attached is scraped off by the magnetic brush at the developing region $X_1$.

Since the value of the packaged density (F) at the developing region $X_2$ is smaller than that (F) at the region $X_1$, the toner attached to the latent image is seldom scraped off by the magnetic brush. Then, the latent image of the line image passes through the developing region $X_2$ while the toner sufficient to be developed into a visible image is attached to the latent image of the line image.

Therefore, most of literal images and solid images are reproduced with the sufficient density thereof and the line image is reproduced as a line image sufficient to be visible.

Sequentially, the devices 1 and 2 set to the experimental condition described above, that is, the speed ratios of the devices 1 and 2 are, respectively, set to 1.75 and 1.25, are simultaneously driven to form a reproduced image corresponding to the same original image under the different condition by each of the devices 1 and 2, and thus the resulting reproducibility RSI and RLI of the density of the solid image and the line image will be explained below.

The developing conditions III and IV in FIG. 13, respectively, show cases where each of the devices 1 and 2 is solely driven in the manner described above, respectively. The speed ratio in the device 1 is 1.75 in the developing condition III, and the speed ratio is 1.25 in the developing condition IV. The reproducibility of the density of the reproduced solid image formed by the first developing device 1 with high packaged density (F) is about 1.4 and the reproducibility of the density of the reproduced line image formed thereby lies in the range of 0.9–1.2. On the other hand, the reproducibility of the density of the reproduced solid image formed by the second developing device 2 with lower packaged density (F) than that (F) of the device 1 is about 0.8 and the reproducibility of the density of the reproduced line image formed thereby lies in the range of 0.4–0.6.

Here, the developing condition V in FIG. 13 shows a case where both of the devices 1 and 2 are simultaneously driven to develop the same latent image by each of the devices 1 and 2 at each of the developing regions $X_1$ and $X_2$. As shown in the condition V, the reproducibility of the density of the reproduced solid image is about 1.4 and the reproducibility of the density of the reproduced line image lies in the range of 0.4–0.6.

That is, the result in the developing condition III done by the first developing device 1 and the result in the developing condition V done by both of the devices 1 and 2 are the same reproducibility RSI of the density RSI of the solid image. The result in the developing condition case IV done by the second developing device 2 and the result in the developing condition V done by both of the devices 1 and 2 are the same reproducibility of the density of the line image. Then, tne developing conditions V may cause both of the reproducibility RSI and RLI of the density of the solid image and the line image to improve simultaneously.

Then, in the image forming apparatus according to the third embodiment of the present invention, when it is judged that the toners accommodated in the devices 1 and 2 have had the same color, the speed ratio in the device 2 is set to be smaller than that in the device 1 so that the packaged density (F) at the region $X_2$ becomes lower than that (F) at the region $X_1$, and then, both of the devices 1 and 2 are simultaneously driven to obtain the high quality image with the improved reproducibility RSI and RLI of the density of the solid image and the line image In order to obtain the high quality image, the image forming apparatus has the toner color judging mechanism, the drive transmission mechanism, and a speed changing mechanism as described below. Since both the toner color judging mechanism and the drive transmission mechanism are the same as those of the first embodiment, the explanation of them will be omitted and only the speed changing mechanism will be explained below.

II. Speed changing mechanism

Figure 21:
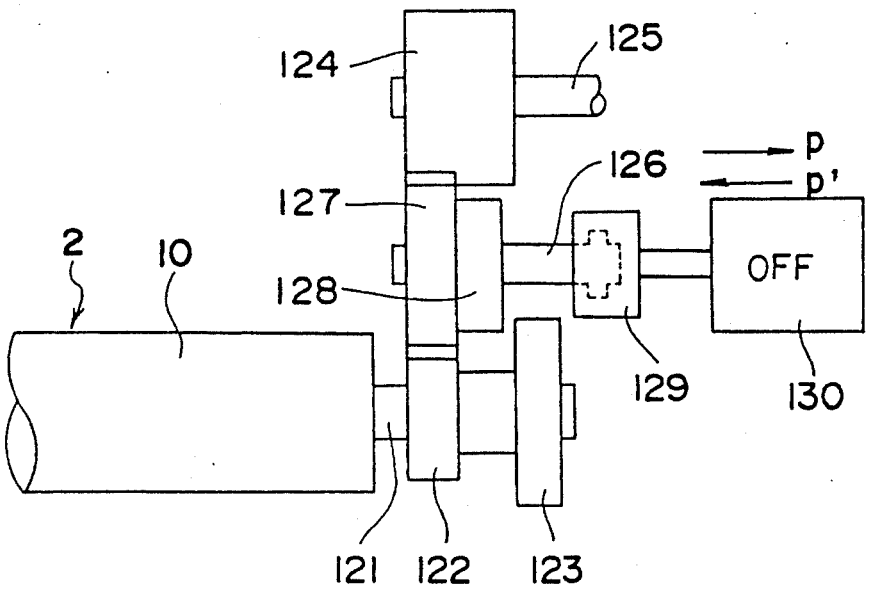
FIGS. 21 and 22 are side views of a speed changing mechanism of an image forming apparatus according to the third embodiment of the present invention.
Figure 22:
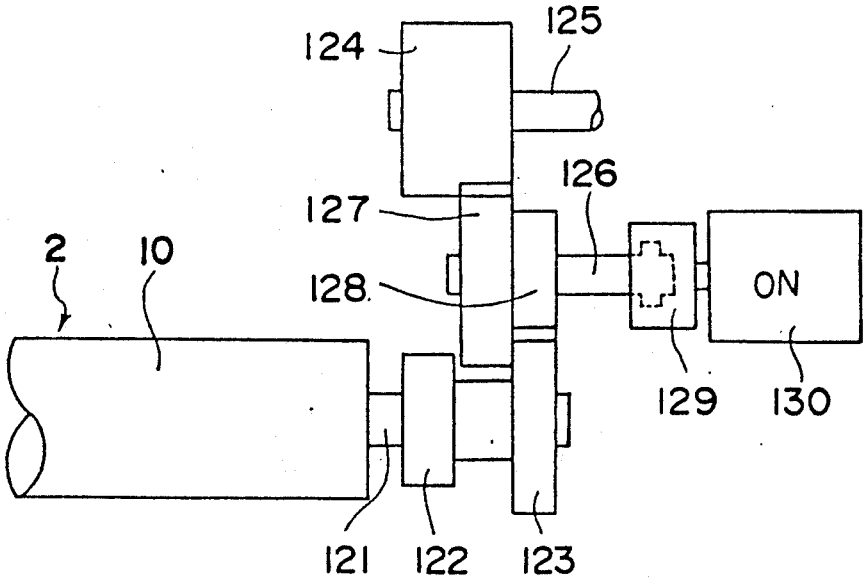
Figure 23:
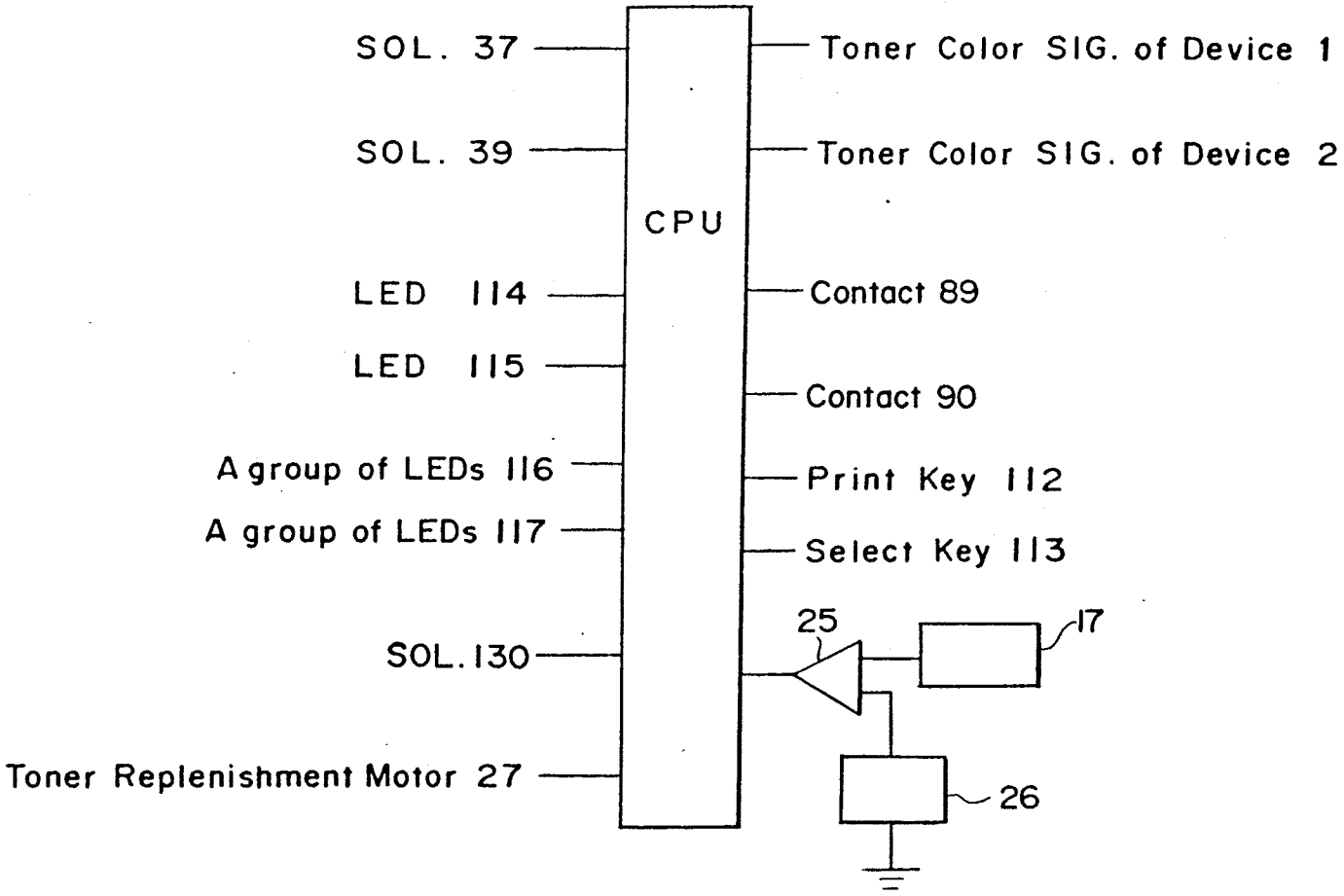
FIG. 23 is a control circuit diagram in the apparatus of the third embodiment.

FIGS. 21–23 show the speed changing mechanism.

A small high speed gear 122 with number of teeth $n_1$ and a larger low speed gear 123 with number of teeth $n_2$ are fixed to one end of a support shaft 121 of the sleeve 10. The number of teeth $n_2$ is larger than that $n_1$.

A gear 124 is fixed to one end of a shaft 125 operatively connected with the shaft 33 shown in FIGS. 4–6.

Furthermore, a larger high speed gear 127 with number of teeth $n_3$ and a smaller low speed gear 128 with number of teeth $n_4$ are fixed to one end of a shaft 126 to rotate the gears 127 and 128 with the shaft 126. The gear 128 is integrally fixed to the gear 127. The number of teeth $n_3$ is larger than that $n_4$. The shaft 126 is connected with a plunger of a solenoid 130 through a connecting device 129. The solenoid 130 is controlled to be driven by a central processing CPU unit as shown in FIG. 23.

According to the arrangement of the mechanism described above, as shown in FIG. 21, in the state where the solenoid 130 is turned off, the high speed gear 127 engages with the gear 124 and the high speed gear 122 to transmit the drive force outputted from the shaft 125 to the support shaft 121 of the sleeve 10 through the gears 124, 127, and 122. In this state, the sleeve 10 in the device 2 is driven for rotation at the same speed as the sleeve 10 in the device 1.

Next, when the solenoid 130 is turned on from the state shown in FIG. 21, the shaft 126 moves in a direction shown in an arrow (p) to release only the engagement between the gears 127 and 122 while the gear 127 engages with the gear 124 and to engage the low speed gear 128 with the gear 123 as shown in FIG. 22. Therefore, the rotary power of the shaft 125 is transmitted to the support shaft 121 of the sleeve 10 through the gears 124, 127, 128, and 123.

Here, the numbers of teeth of the gears 122 and 123 are $n_1$ and $n_2$, respectively, and the former $n_1$ is smaller than the latter $n_2$. The numbers of teeth of the gears 127 and 128 are $n_3$ and $n_4$, respectively, and the former $n_3$ is larger than the latter $n_4$. Therefore, when the solenoid 130 is changed from the turning-off state to the turning-on state according to the signal outputted from the CPU unit, the sleeve 10 in the device 2 is driven for rotation at lower peripheral speed as compared with the sleeve 10 in the device 1. Conversely, when the solenoid 130 is changed from the turning-on state to the turning-off state according to the signal outputted from the CPU unit, the sleeve 10 in the device 2 is driven for rotation at higher peripheral speed as compared with the sleeve 10 in the device 1.

III. Control operation

The main routine and the subroutine for controlling the copy operation of the third embodiment are the same as those of the first embodiment but the subroutine for controlling the developing mode of the third embodiment is different from that of the first embodiment. Therefore, the subroutine for controlling the developing mode thereof will be explained hereinafter, referring to FIG. 24.

Figure 24:
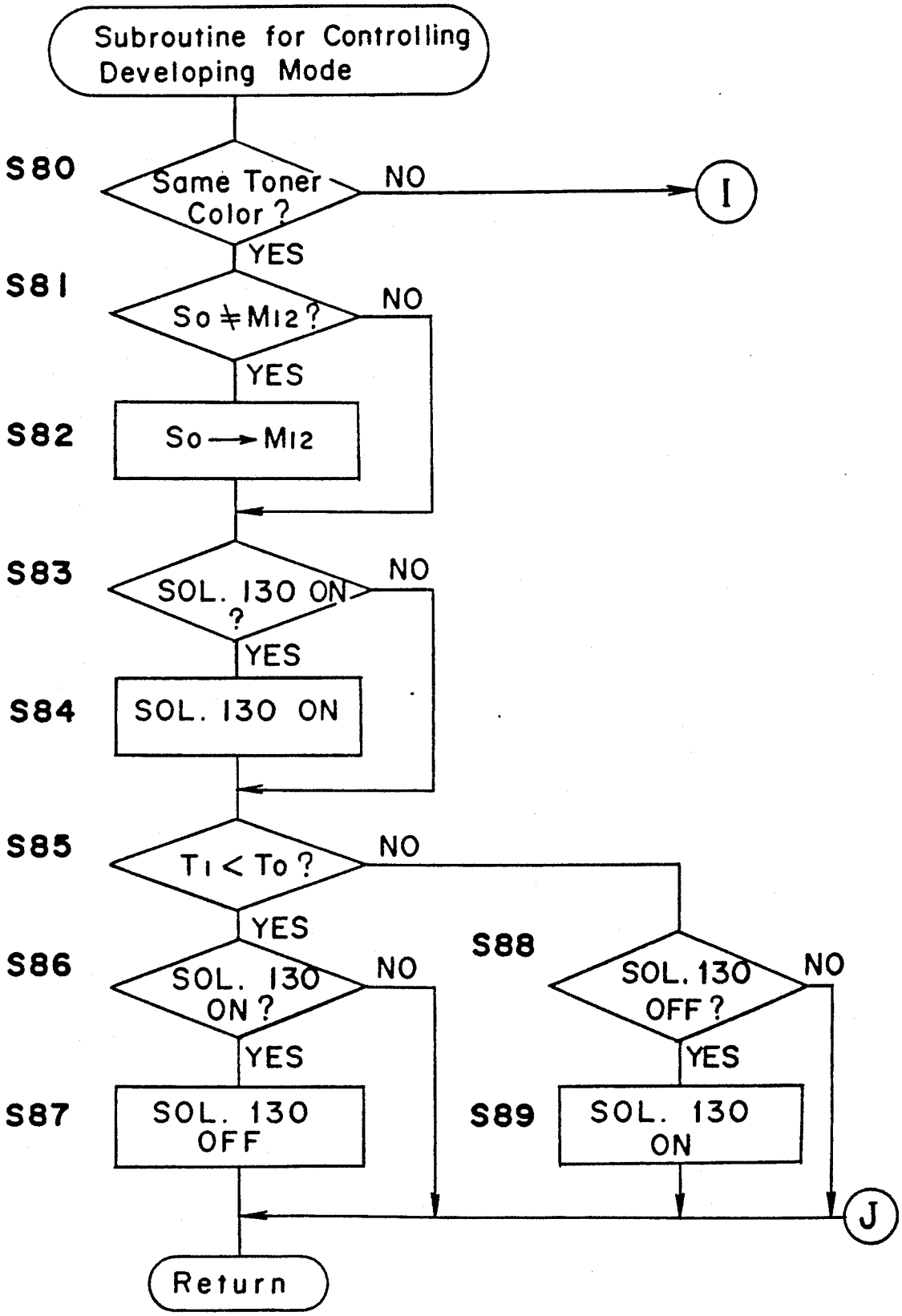
FIG. 24 is a flow chart showing the content of a subroutine for controlling a developing mode in the third embodiment.

Subroutine for controlling the developing mode (referred to FIG. 24)

This subroutine is a routine for controlling the drive transmission mechanism and the speed changing mechanism in correspondence with the colors of the toners accommodated in the devices 1 and 2 and the selected developing mode. At step S80, it is determined whether the color of the toner accommodated in the device 1 has been the same as that in device 2. The judgment is executed by detecting the toner color signal outputted from the toner color judging mechanism to the CPU-unit.

The program advances step S81 when the color of the toner in the device 1 is the same as that in the device 2 at step S80.

At step S81, it is judged whether the drive change mode (So) has been $M_{12}$, that is, both the devices 1 and 2 have been in operatable states. When the drive change mode (So) is not $M_{12}$, the mode (So) is changed into $M_{12}$ at step S82. When the mode (So) is $M_{12}$, the program advances step S83 without executing the operation at step S82. That is, both the devices 1 and 2 are set in the operatable states by the above control process.

At step S83, it is judged whether the solenoid 130 in the speed changing mechanism in the device 2 has been turned on to rotate the sleeve 10 at lower peripheral speed. When the solenoid 130 is turned off, the solenoid 130 is turned on to rotate the sleeve 10 at lower peripheral speed.

In this state, when the print key 112 is depressed and the copy operation is executed, the devices 1 and 2 are driven together. At that time, the peripheral speed of the sleeve 10 of the device 2 is lower than that of the sleeve 10 in the device 1 to set the packaged density (F) at the region $X_2$ to a smaller value than that (F) at the region $X_1$ in order to obtain a reproduced image with the improved reproducibility RSI and SLI of the density of the solid image and the line image.

Sequentially, at steps S85–S89, a control process is executed in which the lower peripheral speed of the sleeve 10 in the device 2 set in order to form a high quality image is changed into the higher peripheral speed thereof in order to obtain the density required to a reproduced image in the device 2, in a case where the value of the toner density $T_1$ in the device 1, which has serious effects on the reproducibility RSI of the density of the solid image, is smaller than the reference value $T_0$ even though the developing mode for obtaining the high quality image has been selected.

That is, first, at step S85, it is judged whether the value of the toner density $T_1$ in the device 1 has been smaller than the reference value $T_0$.

Then, when it is judged that the value of the toner density $T_1$ in the device 1 has been smaller than the reference value $T_0$ at step S85 and the solenoid 130 is turned on at step S86, the solenoid 130 is changed into the turning-off state at step S87 to return the sleeve 10 to be in the higher peripheral speed state. While, when it is judged that the value of the toner density $T_1$ in the device 1 has not been smaller than the reference value $T_0$, the solenoid 130 is maintained in the turning-on state at steps S88 and S89 to keep the sleeve 10 to be in the lower peripheral speed state.

After completion of the above steps, the program returns the subroutine for controlling the copy operation (referred to FIG. 15) to execute the operation at step S17.

When it is judged the color of the toner in the device 1 is different from that in the device 2 at step S80, the device 1 is driven so that it is judged whether the first developing device drive mode for driving the device 1 to develop has been selected at step S90.

Then, when the first developing device drive mode is selected, it is judged whether the drive change mode (So) has not been $M_1$, that is, the mode (So) has been set to either $M_2$ or $M_{12}$ at step S91. When the mode (So) is either $M_2$ or $M_{12}$, the mode (So) is changed into $M_1$ at step S92. When the mode (So) is $M_1$, the program returns to the subroutine for controlling the copy operation to execute the operation at step S17.

According to the process, when the developing mode for using only the device 1 is selected, only the device 1 is driven under the condition where the drive change mode (So) is $M_1$ and the device 2 is maintained in a non-operating state. Thus, an image is reproduced by only the device 1.

On the other hand, when it is judged the first developing device drive mode is not selected at step S90, that is, the second developing device drive mode for using only the device 2 is selected, it is judged whether the drive change mode (So) has not been $M_2$ at step S93, that is, the drive change mode (So) has been either $M_1$ or $M_{12}$. When the drive change mode (So) is either $M_1$ or $M_{12}$, the mode (So) is changed into $M_2$ at step S94.

At step S95, it is judged whether the peripheral speed of the sleeve 10 in the device 2 has been set to the lower peripheral speed state. When the peripheral speed of the sleeve 10 in the device 2 is in the lower peripheral speed state, the solenoid 130 is turned off to change the sleeve 10 in the device 2 into the higher peripheral speed state.

As described above, when the developing mode for using only the device 2 is selected, the drive change mode (So) is $M_2$. Thus, only the device 2 is driven for rotation at higher peripheral speed of the sleeve 10 thereof, the device 1 is maintained in the non-operating state, and the image is reproduced by only the device 2.

IV. Modifications

Though two developing devices 1 and 2 are arranged around the drum 100 in the third embodiment, three or more developing devices may be arranged therearound to execute the operations described above.

For example, in a case where three devices are arranged therearound and the colors of the toners in all of the devices are the same, the peripheral speeds of the sleeves in the devices may be set to be gradually larger from the device arranged at the upstream side to that arranged at the downstream side of the drum, respectively, and then, all of the devices may be simultaneously driven for development.

According to the arrangements of the first, second, and third embodiments and the modifications, since the image forming apparatus comprises plural devices each accommodated toners in the same color to form a reproduced image by the toners, the device 1 arranged at the upstream side of the drum and having high developer packaged density and the device 2 arranged at the downstream side of the drum and having lower developer packaged density are simultaneously driven to develop the same electrostatic latent image on the drum by each of the devices 1 and 2.

Then, an original solid image and an original normal literal image may be reproduced with sufficient density by the device 1 with first priority for development order and an original line image may be clearly reproduced by the device 2 with the second priority for development order.

Therefore, the present invention may be provided the apparatus by which the reproducibility of the density of the solid image and the line image is improved.

Furthermore, when the value of the density of the toner in the device 1 with the first priority therefor becomes smaller than the reference value, a mode in which both the devices are driven for development is changed into other mode in which the device 2 with the second priority therefor is solely driven for development to have priority the reproducibility of the density of the reproduced solid image, and then a reproduced image with sufficient density may be obtained.

Fourth embodiment

Figure 25:
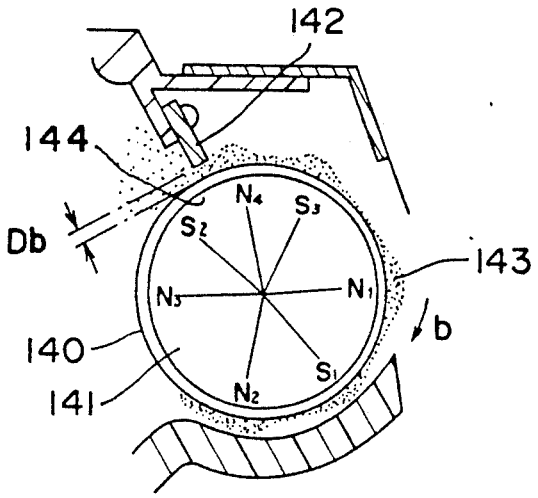
FIGS. 25 and 26 are partially sectional views of developing devices in an image forming apparatus according to the forth embodiment of the present invention.
Figure 26:
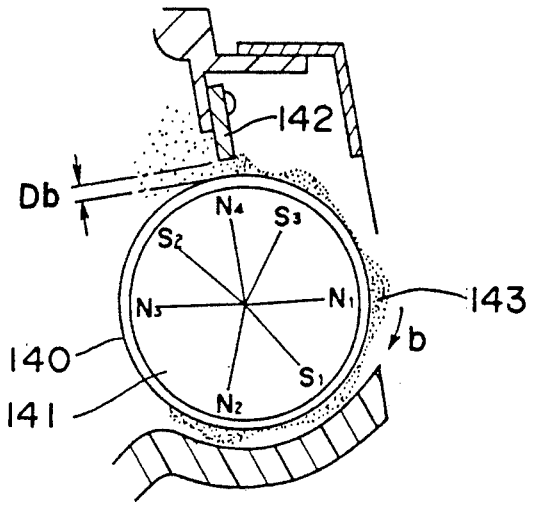
Figure 27:
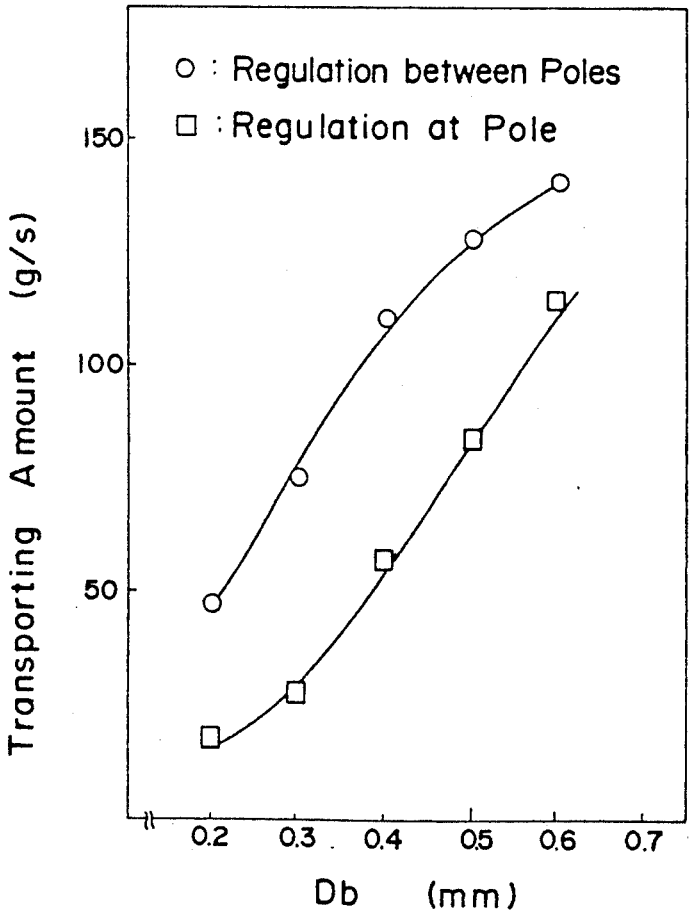
FIG. 27 is a graph showing a relation between a height regulating gap and developer transporting amount in the forth embodiment.

FIGS. 25-27 show the fourth embodiment of the present invention in which the devices 1 and 2 are simultaneously driven for development and the height regulating member 12 in the device 1 is arranged at a portion confronting with the middle of the poles and the member 12 in the device 2 is arranged at a portion confronting with the pole, so that the developer packaged density (F) in the device 1 is smaller than that (F) in the device 2. The fourth embodiment may be preferably applied to the apparatus of the third embodiment.

I. Construction and operation of developing unit

In the developing unit 6, the developing sleeve 10 for being driven for rotation in the direction shown by the arrow (b) around the magnetic element 11 is arranged at the drum 10 while confronting therewith. In the magnetic element 11, plural magnetic poles $N_1$-$N_4$ and $S_1$-$S_3$ each extending along the axial direction of the element 11 are so arranged that the poles S and N are alternately positioned thereat except for a portion confronting with the transporting path 7. At the portion confronting with the path 7, the same poles $N_3$ and $N_2$ are arranged adjacently as shown in FIG. 1.

In the device 1, the distal end of the height regulating member 12, exactly the back face theref where confronts with the path 7, is arranged to confront with the developing sleeve 10 through the height regulating gap $Db_1$ at the middle portion 144 between the adjacent two poles $S_2$ and $N_4$. In the device 2, the distal end of member 12 is arranged to confront with the sleeve 10 through the height regulating gap $Db_2$ at a portion confronting with a center of the pole $N_4$, that is, a position where the maxim magnetic force acts along the normal direction of the pole $N_4$.

Here, in the magnetic brush type developing device, as shown in FIGS. 25 and 26, a brush-like developer 143 held on the outer circumferential portion of a developing sleeve 140 is in a non-dense state, where the developer 143 stands in the radius direction of the sleeve 140, at a portion confronting with poles such as $N_1$ and $S_1$ of a magnetic element 141 accommodated in the sleeve 140. On the other hand, the developer 143 is in a dense state, where it 143 fell to overlap along the outer circumferential portion of the sleeve 140, at a portion confronting with the middle 144 between adjacent magnetic poles, for example, the magnetic poles $S_2$ and $N_4$.

Therefore, there is a difference between when a height regulating member for regulating an amount of the developer 143 transported along the outer circumferential portion of the sleeve 140 is arranged to confront with the magnetic poles and when the member is arranged to confront with the middle between the adjacent magnetic poles, which is the difference of the amounts of the developers transported in a direction shown by the arrow (b) on the basis of rotation of the sleeve 140, as shown in FIG. 27. In FIG. 27, 0 shows a case where the distal end of member is arranged to confront with the middle of the magnetic poles as shown in FIG. 25 and □ shows a case where the member is arranged to confront with the magnetic pole such as $N_4$ as shown in FIG. 26.

As described in FIGS. 25 and 26, in a case where the height regulating gaps Db in the devices are the same, the developer transporting amount at the middle of the magnetic poles is larger than that at the magnetic pole.

Then, as described previously, in a case where a high quality image is obtained by developing the same latent image by each device, when the developer packaged density (F) at the developing region $X_2$ is set to be lower to regulate the developer between the poles while the height regulating member in the second developing device is arranged to confront with the middle of the poles and the second developing device is driven for the improved reproducibility of the density of the line image, the height regulating gap $Db_2$ thereof should be set to a very small value such as about 0.1 mm. However, there are some problems as described below; It is impossible to set the height regulating gap Db to such a value. The fluctuation in the developer transporting amount caused by both any adjusting error and any dimensional tolerance of the gap produces bad effects on the whole transporting amount. The smaller height regulating gap Db results in the clogging of the foreign material and the developer, the bad transportation of the developer, and the overflow of the developer from the developing device.

Next, in the case where the height regulating member is arranged to confront with the magnetic pole, when the height regulating gap Db is set to lie in the range of 0.2 mm–0.3 mm, the fluctuation area of the developer transporting amount in correspondence with the fluctuation in the height regulating gap becomes smaller and stable. However, when the height regulating gap Db is set to be larger than that, the transporting amount is greatly changed in correspondence with the slight fluctuation in the gap. On the other hand, in the case where the distal end of the member is arranged to confront with the middle of the poles, when the height regulating gap Db is set to lie in the range of 0.4 mm–0.6 mm, the fluctuation area of the developer transporting amount in correspondence with the fluctuation in the height regulating gap becomes smaller and stable. However, when the height regulating gap Db is set to be smaller than that, the transporting amount is greatly changed in correspondence with the slight fluctuation in the gap.

Therefore, the height regulating member is preferably arranged to confront with the middle of the poles in order to stably transport lots of amount of the developer as shown in FIG. 25, and the member is preferably arranged to confront with the pole in order to stably transport a small amount of the developer as shown in FIG. 26.

Then, according to the consideration, if $Vd_1$ and $Vd_2$ denote the amounts of the developers passed through the height regulating gaps per hour, respectively, there is such a relation between the gaps $Db_1$ and $Db_2$ that the amount $Vd_1$ is larger than that $Vd_2$. As a result, it is preferably set so that the developer packaged density (F) at the developing region $X_1$ is preferably set to be larger than that (F) at the region $X_2$, speaking concretely, the height regulating gap $Db_1$ is set to lie in the range of 0.4 mm–0.6 mm and the height regulating gap $Db_2$ is set to lie in the range of 0.2 mm–0.3 mm.

Then, the member 12 in the device 1 is arranged to confront with the middle 144 between the poles $S_2$ and $N_4$ and the height regulating gap $Db_1$ is set to lie in the range of about 0.4 mm–0.6 mm. Therefore, the fluctuation in the developer transporting amount in correspondence with the setting error of the height regulating gap $Db_1$ becomes smaller and stable.

On the other hand, the member 12 in the device 2 is arranged to confront with the pole $N_4$ and the height regulating gap $Db_2$ is set to lie in the range of about 0.2 mm–0.3 mm. Therefore, the fluctuation in the developer transporting amount in correspondence with the setting error of the height regulating gap $Db_2$ becomes smaller and stable. Since the developer transporting amount may be regulated to a very small value in the range of about 30–60 g/s by the height regulating gap $Db_2$ set in the range of 0.2 mm–0.3 mm, the gap $Db_2$ with such a value is hardly clogged with the foreign material included in the developer.

As compared with this, for example, when the member is arranged to confront with the middle of the poles to obtain the amount in the range of about 30–60 g/s, the gap $Db_2$ seems to be set to about 0.1 mm. However, it is difficult to set such a very small value and the slight adjusting error would result in the clogging of the developer.

Other operations for forming an electrostatic latent image and developing the image are the same as those described previously.

As is clear from the foregoing description, according to the fourth embodiment of the present invention, the height regulating member is arranged to confront with the middle of the poles in the upstream device with respect to rotation of the drum and the member is arranged to confront with the pole in the downstream device so that the developer packaged density (F) at the portion, confronting the sleeve with the drum, in the upstream device is larger than that (F) in the downstream device and both the devices are simultaneously driven.

Therefore, it may prevent the great fluctuation in the amount in correspondence with the slight adjusting error of the gap in the device, and thus, the developer may be stably transported.

Furthermore, since the developer transporting amount in the device 2 may become smaller without setting the gap to the very small value, it may prevent the clogging of the foreign material and the developer in the gap, and thus, the developer may be smoothly transported.

Therefore, a high quality image with the improved reproducibility RSI and RLI of the density of the solid image and the line image may be stably obtained by the apparatus of the fourth embodiment.

Fifth embodiment

FIGS. 28 - 32 show the fifth embodiment of the present invention in which the transporting direction of the transporting path in the device 1 is different from that of the path in the device 2 so that interpolation of the devices 1 and 2 may result in uniform reproducibility RSI of the density of a solid image as a whole. The fifth embodiment may be applied to the apparatus of the other embodiments and modifications.

Figure 28:
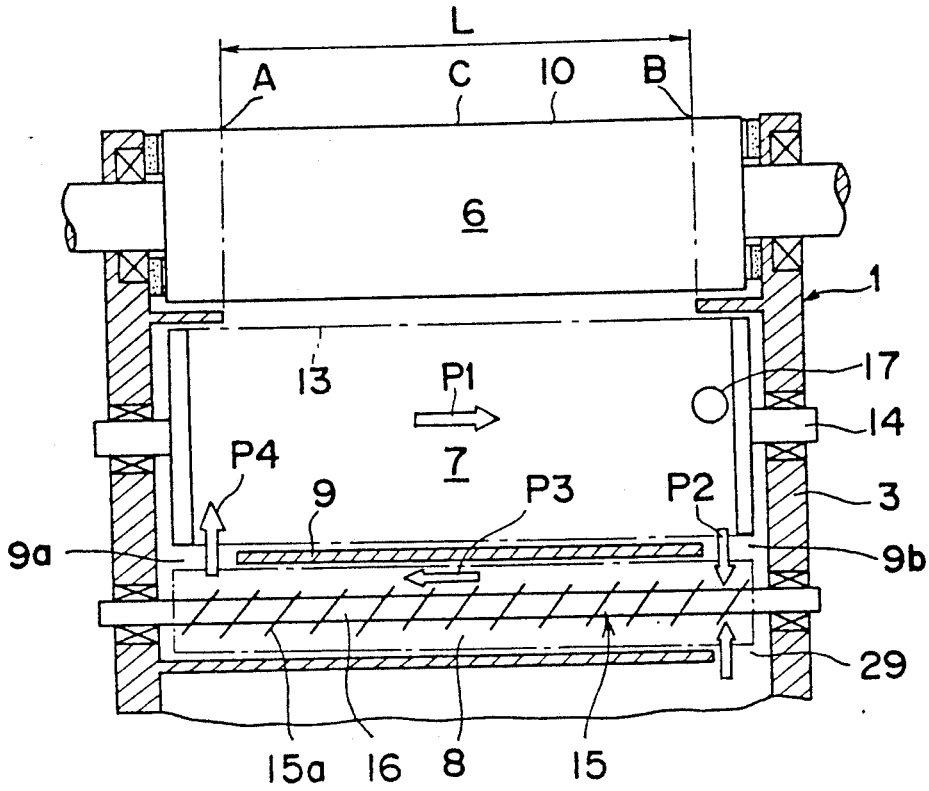
FIG. 28 is a cross-sectional view of a first developing device in an image forming apparatus according to the fifth embodiment of the present invention.
Figure 29:
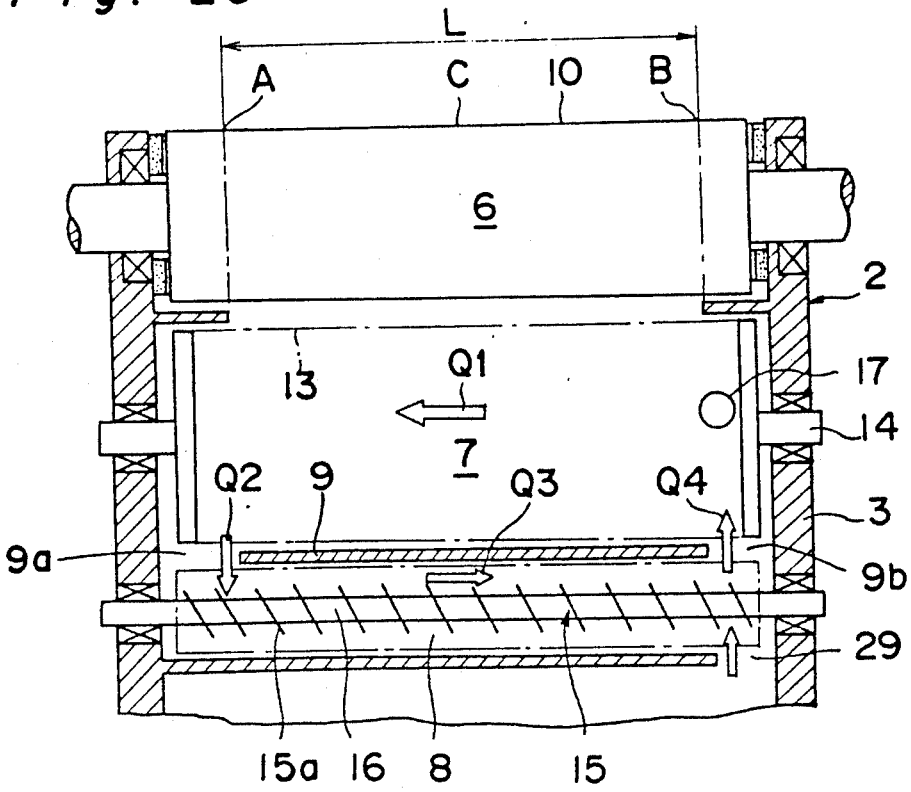
FIG. 29 is a cross-sectional view of a second developing device in the apparatus in the fifth embodiment.

As shown in FIGS. 28 and 29, the transporting path 7 in the devices 1 and 2 is formed parallel to the sleeve 10. The transporting path 8 in the device 1 is formed to be inclined upwardly from righthand side to lefthand side in FIG. 28 in which the screw 15 having transporting vanes 15*a* on the shaft 16 is arranged to rotate. in the direction shown by the arrow (d) in FIG. 1. On the other hand, the path 8 in the device 2 is formed to be inclined downwardly from righthand side to lefthand side in FIG. 29 in which the screw 15 having transporting vanes 15*a* on the shaft 16 is arranged to rotate in the direction shown by the arrow (d) in FIG. 1. In the bucket roller 13 and the screw 15, the inclination angle of the vane 15*a* to the shaft 16 in the device 1 is different from that in the device 2, so that when the screw 15 in the device 1 and the screw 15 in the device 2 rotate in the same direction, the developers are designed to be transported in the different direction with each other.

Then, each developer in each device is circularly transported in the paths 7 and 8 through paths 9*a* and 9*b* on the basis of rotation of the bucket roller 13 and the screw 15.

Speaking concretely, as shown in FIG. 28, in the device 1, the developer in the path 7 is transported from lefthand side to righthand side by the bucket roller 13 in a direction shown in an arrow (P1) and is transported at the end of righthand side through the path 9*b* on a direction shown in an arrow (P2) into the path 8. The developer in the path 8 is transported from righthand side to lefthand side by the screw 15 in a direction shown in an arrow (P3) and is transported at the end of lefthand side through the path 9*a* on a direction shown in an arrow (P4) into the path 7.

On the other hand, as shown in FIG. 29, in the device 2, the developer in the path 7 is transported from righthand side to lefthand side by the bucket roller 13 in a direction shown in an arrow (Q1) and is transported at the end of lefthand side through the path 9*a* on a direction shown in an arrow (Q2) into the path 8. The developer in the path 8 is transported from lefthand side to righthand side by the screw 15 in a direction shown in an arrow (Q3) and is transported at the end of righthand side through the path 9*b* on a direction shown in an arrow (Q4) into the path 7.

Therefore, the transporting direction of the developer in the device 1 is the opposite of that in the device 2. Such a transportation results in different charge of the toner and the carrier while contacting frictionally with each other of which the developer is composed.

Other operations for forming an electrostatic latent image and developing the image are the same as those described previously in the embodiments.

During the operations, when the toner is replenished in the device, the screw 22 is driven for rotation to replenish the toner in the path 8 through an opening 29.

Then, in the device 1, the toner replenished in the path 8 is mixed and agitated with the developer transported from the path 7. The toner is transported in the direction shown by the arrow (P3) while contacting with the carrier to highly charge. After that, the toner is supplied to the path 7 through the path 9*a* to be transported in the direction shown by the arrow (P1).

Figure 30:
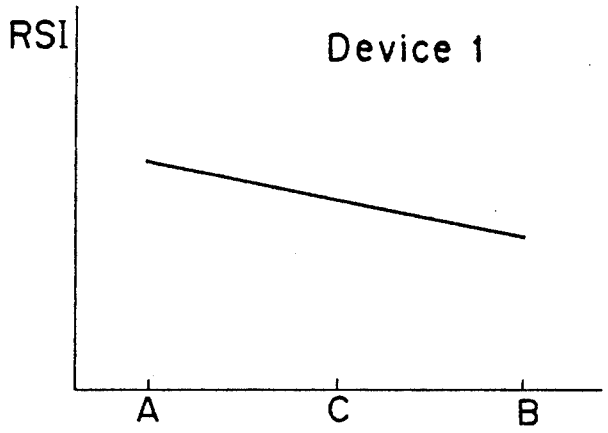
FIG. 30 is a graph showing gradient of image density in the first developing device shown in FIG. 28.

Therefore, when the toner is replenished in the device 1, the toner density is progressively higher from lefthand side to righthand side. Then, when an image is reproduced by using only the device 1, as shown in FIG. 30, the reproducibility of the density of the reproduced solid image is highest at a point (A) in lefthand side, the reproducibility RSI is progressively lower from lefthand side to righthand side and is lowest at a point (B) in righthand side. A point (C) denotes the middle between the points (A) and (B).

On the other hand, in the device 2, the toner replenished in the path 8 is mixed and agitated with the developer transported from the path 7. The toner is transported in the direction shown by the arrow (Q3) while contacting with the carrier to highly charge. After that, the toner is supplied to the path 7 through the path 9*b* to be transported in the direction shown by the arrow (Q1) in which is the opposite of that (P1) in the device 1.

Figure 31:
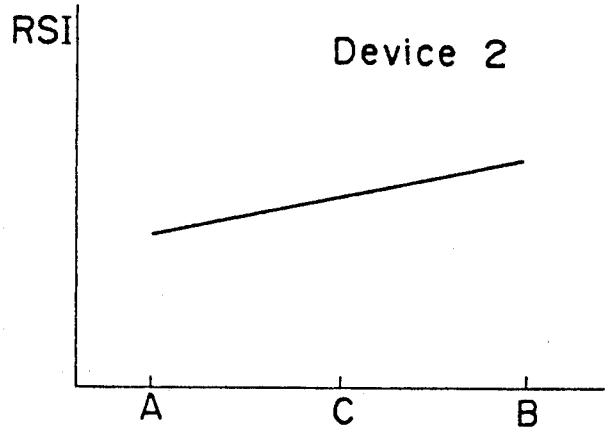
FIG. 31 is a graph showing gradient of image density in the second developing device shown in FIG. 29.

Therefore, as shown in FIG. 31, when the toner is replenished in the device 1, the toner density is progressively lower from lefthand side to righthand side. Therefore, when an image is reproduced by using only the device 1, the reproducibility of the density of the reproduced solid image is lowest at the point (A) in lefthand side, the reproducibility RSI is progressively higher from lefthand side to righthand side and is highest at the point (B) in righthand side.

According to the description, such a replenishment of the toner results in the gradient of progressively lower density from upstream side to downstream side in the toner transporting direction in the path 7 of the devices 1 and 2 to form a graduation of the reproducibility RSI shown in FIGS. 30 and 31 according to the graduation of the toner density.

The graduation of the toner density is produced not only after the replenishment of the toner but also normal development. The reason is that the toner is gradually consumed during transportation of the toner in the path 7.

Figure 32:
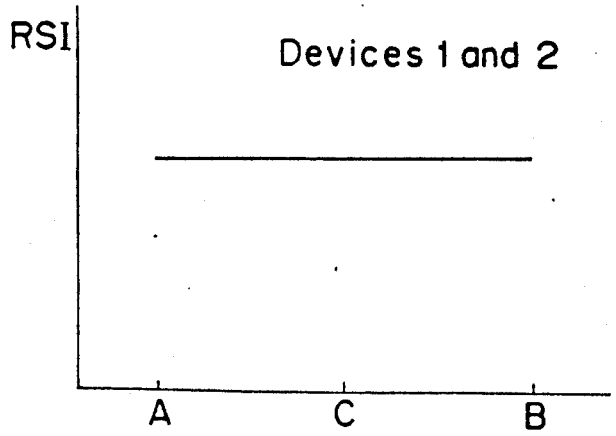
FIG. 32 is a graph showing gradient of image density in a case where an electrostatic latent image is developed by the devices shown in FIGS. 28 and 29.

However, as described previously, when the same electrostatic latent image is developed by each of the devices 1 and 2 driven simultaneously, since the toner, in the device 2, in the same color as that in the device 1 is supplied to the toner image formed by the device 1 while overlapping, lots of amount of the toner in the device 2 is supplied to a portion, where the toner in the device 1 is hardly supplied, of the latent image, while the little amount of the toner in the device 2 is supplied a portion, where the toner in the device 1 is sufficiently supplied. Then, the interpolation of the devices 1 and 2 may result in uniform reproducibility RSI of density of a reproduced image as a whole, as shown in FIG. 32.

As is clear from the description, according to the fifth embodiment, since the toner transporting direction in the path adjacently arranged at the developing sleeve in the device 1 is the opposite of that in the device 2, the interpolation of the devices 1 and 2 may result in reproduction of an image with average toner density as a whole. Therefore, an excellent quality image with uniform density and non-fog may be reproduced by the apparatus.

Sixth embodiment

FIGS. 33–36 show the sixth embodiment of the present invention in which an angles of the main pole to the drum in each device is set to a specified value in order to obtain a reproduced image with the improvement of reproducibility of density of a reproduced solid image and a reproduced line image. The sixth embodiment may be applied to other embodiments and modifications.

By the way, generally, in such an apparatus that the magnetic elements 11 are fixed to the sleeve 10 so that the developers are supplied to the developing regions by only rotation of the sleeves 10 in the devices 1 and 2, respectively, either any drifts of the elements 11 caused by any tolerance not to avoid in manufacturing or any drifts of the height regulating gaps in setting results in the fluctuation in the developer transporting amount in each device.

As described previously, the amount has a great effect on the reproducibility RSI and RLI of the density of the solid image and the line image. Then, the fluctuation thereof is not avoided by the drifts caused in manufacturing and setting.

Therefore, in the apparatus, it is preferable to set such a developing condition that the fluctuation has less effect on the quality of the reproduced image.

Then, in order to achieve the purpose, the apparatus is so designed that the reproduced image with the improved reproducibility RSI of the density of the solid image is formed by the upstream device 1 and the image with the improved reproducibility RLI of the density of the line image is formed by the downstream device 2, as described below.

The developing transporting amount which is an amount of the developer transported to the developing unit per hour is employed as a parameter and then the reproducibility RSI and RLI of the density of the reproduced solid image and the reproduced line image are detected at each position confronting with the main pole to be used in developing. The result shows in FIGS. 34–36.

Figure 34:
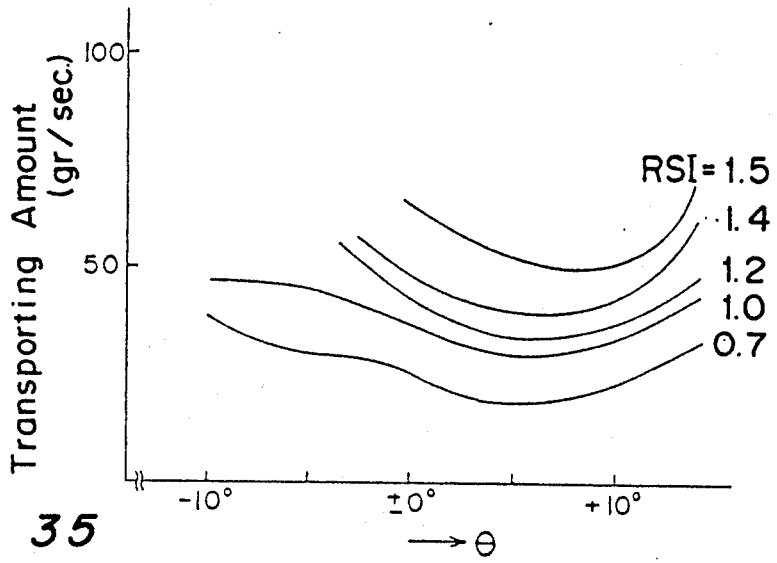
FIG. 34 is a graph showing a relation between an angle $\theta$ and developer transporting amount in a case where reproducibility RSI of density of a reproduced solid image is used as a parameter in the sixth embodiment.

In FIG. 34, the transporting amount (gr/sec) of the developer for obtaining the same reproducibility RSI of the density of the reproduced image is detected at each of the positions thereof and the points gotten as the result are connected with each other by a curve line, and the lines show, respectively, the RSI lines in correspondence with the amounts. As is clear from the FIG. 34, in the case where the angle $\theta$ lies in the range of $+5°$ to $+10°$, the same reproducibility thereof as those of the other angles may be obtained by a small amount of the developer as compared with the other angles. Then, the case has the advantage of the excellent reproducibility RSI thereof.

Figure 35:
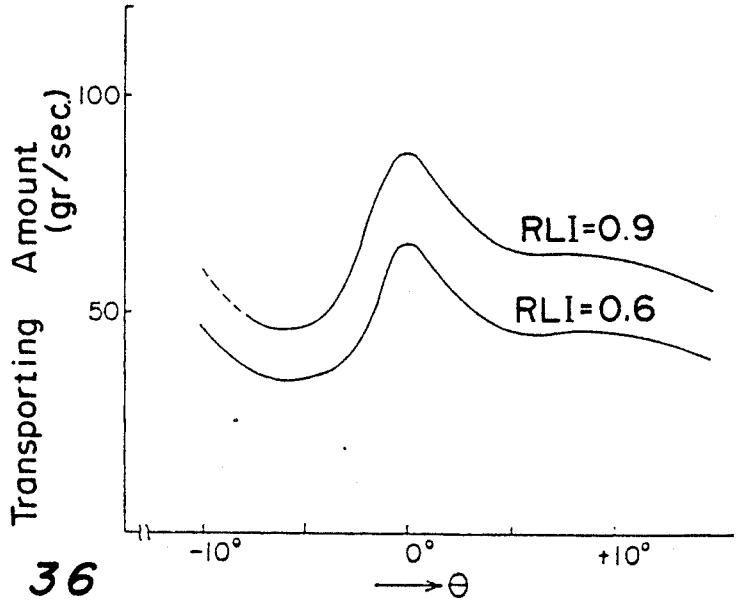
FIG. 35 is a graph showing a relation between an angle $\theta$ developer transporting amount in a case where reproducibility RLI of density of a reproduced line image is used as a parameter in the sixth embodiment.
Figure 36:
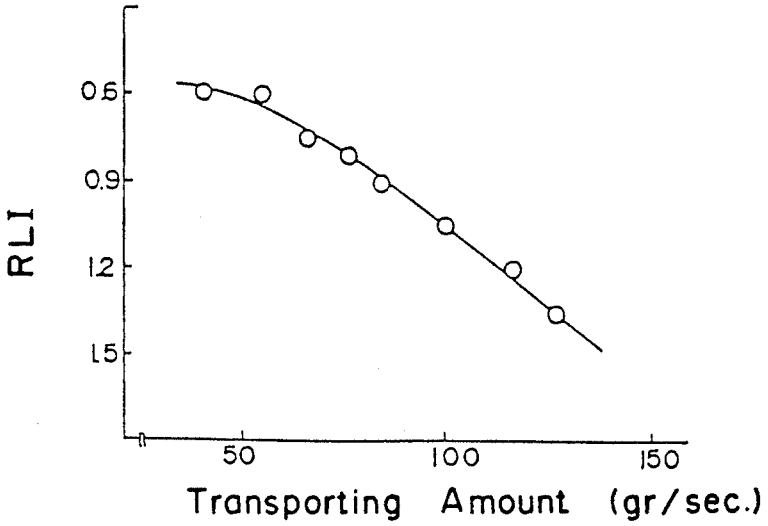
FIG. 36 is a graph showing a relation between developer transporting amount and reproducibility RLI of density of a reproduced line image in the sixth embodiment.

FIG. 35 shows a relation between the transporting amounts of the developer for obtaining the reproducibility of the density of the reproduced line image and the reproducibility RLI, and the curve lines in the FIG. 35 show, respectively, lines in correspondence with the amounts. As is clear from the Figure, the lines have the maxim amounts thereof at about $\pm 0°$, exactly about $-2°$ to about $+2°$. As shown in FIG. 36, the increase in the amounts results in the decrease of the reproducibility of the density of the reproduced line image. The reason is that after the toners are taken from the carriers to develop the latent image at the distal end of the region, the carriers without toner are existed at the end of the downstream of the developing region, so that the toners attached to the latent image on the drum 100 intends to be taken from the image by the carriers. The fact that the lines in FIG. 35 each have the maxim amounts thereof at the point where the angle $\theta$ is about $\pm 0°$ shows that the improved reproducibility RLI may be obtained by even lots of the transporting amounts of the developer as compared with the other points. Then, the case has the advantage of the excellent reproducibility RLI.

Then, in the apparatus according to the sixth embodiment, the height regulating gaps $Ds_1$ and $Ds_2$ and each developing gap Db are set to specified values corresponded with the experimental result, respectively, in order to obtain a high quality image with the improved reproducibility of the density of the reproduced solid image by the device 1 and by the device 2. That is, lots of amounts of the developer is supplied to the latent image by the device 1 in order to obtain the improved reproducibility RSI and smaller amounts of the developer than that in the device 1 is supplied to the latent image by the device 2 in order to obtain the improved reproducibility RLI.

Figure 33:
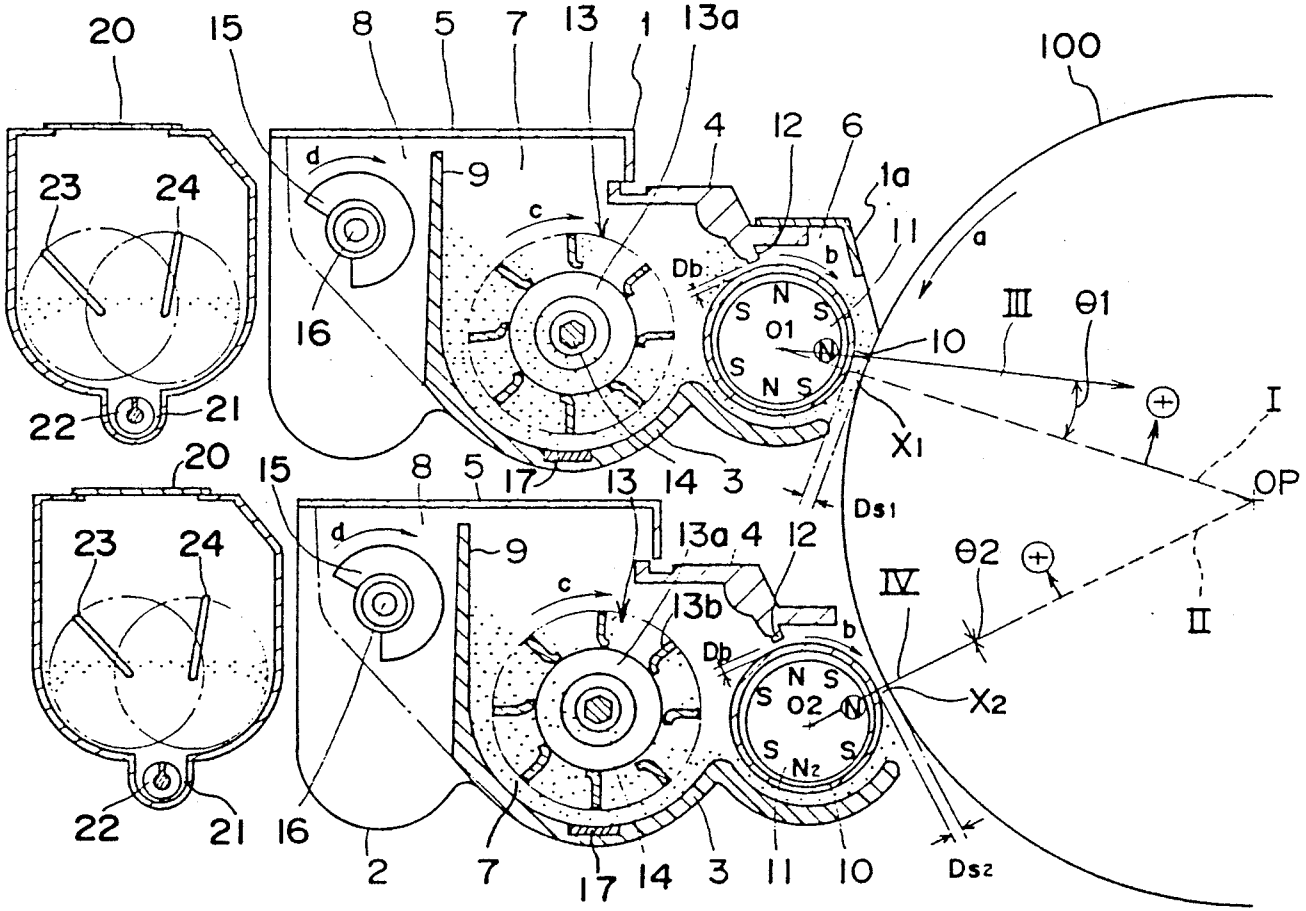
FIG. 33 is a sectional view of a developing unit of an image forming apparatus according to the sixth embodiment of the present invention.

That is, as shown in FIG. 33, each counterclockwise direction around the centers 01 and 02 of the sleeves 10 is defined as positive one on the basis of straight dotted lines I and II passed through the centers 01 and 02 of the sleeves 10 and the center OP of the drum 100. Angles at which the lines I and II intersect with solid lines III and IV passed through the centers 01 and 02 of the sleeve 10 and the center of the main pole N surrounding by a circle, which is used in developing, denote $\theta 1$ and $\theta 2$, respectively. In the apparatus, the main pole in the device 1 is so arranged that the angle $\theta 1$ is positive value, preferably falling in the range of $+5°$ to $+10°$. The main pole in the device 2 is so arranged that the angle $\theta 2$ is about $\pm 0°$, preferably falling in the range of $-2°$ to $+2°$.

In the description, though it is explained about the apparatus with only two developing device, the embodiment may be applied to any apparatus having three or more devices to develop the same latent image by each device.

As is clear from the foregoing description, according to the sixth embodiment, the apparatus is so constructed that plural magnetic brush type developing devices each of which has the developing sleeve and the same color toner are arranged at portions near the surface of the drum along an operating direction of the drum, respectively, so that the sleeves in the devices are simultaneously driven for rotation to develop the same electrostatic latent image formed on the surface of the drum by each device. Then, the center of the main pole of the magnetic poles in the sleeve in the downstream device of the operating direction of the drum is positioned on the straight line passed through the center of the sleeve and the center of the drum, and the center of the main pole of the magnetic poles in the sleeve in the upstream device of the operating direction of the drum is positioned at the position where is located at the upstream side of the straight line passed through the center of the sleeve and the center of the drum.

Therefore, a high quality image with the improved reproducibility RSI of the density of the solid image is stably reproduced by the upstream device and the improved reproducibility RLI of the density of the line image may be stably obtained by the downstream device without bad effect produced between the devices in correspondence with the fluctuation in the amount in each device which is caused in manufacturing and setting.

Seventh embodiment

Figure 37:
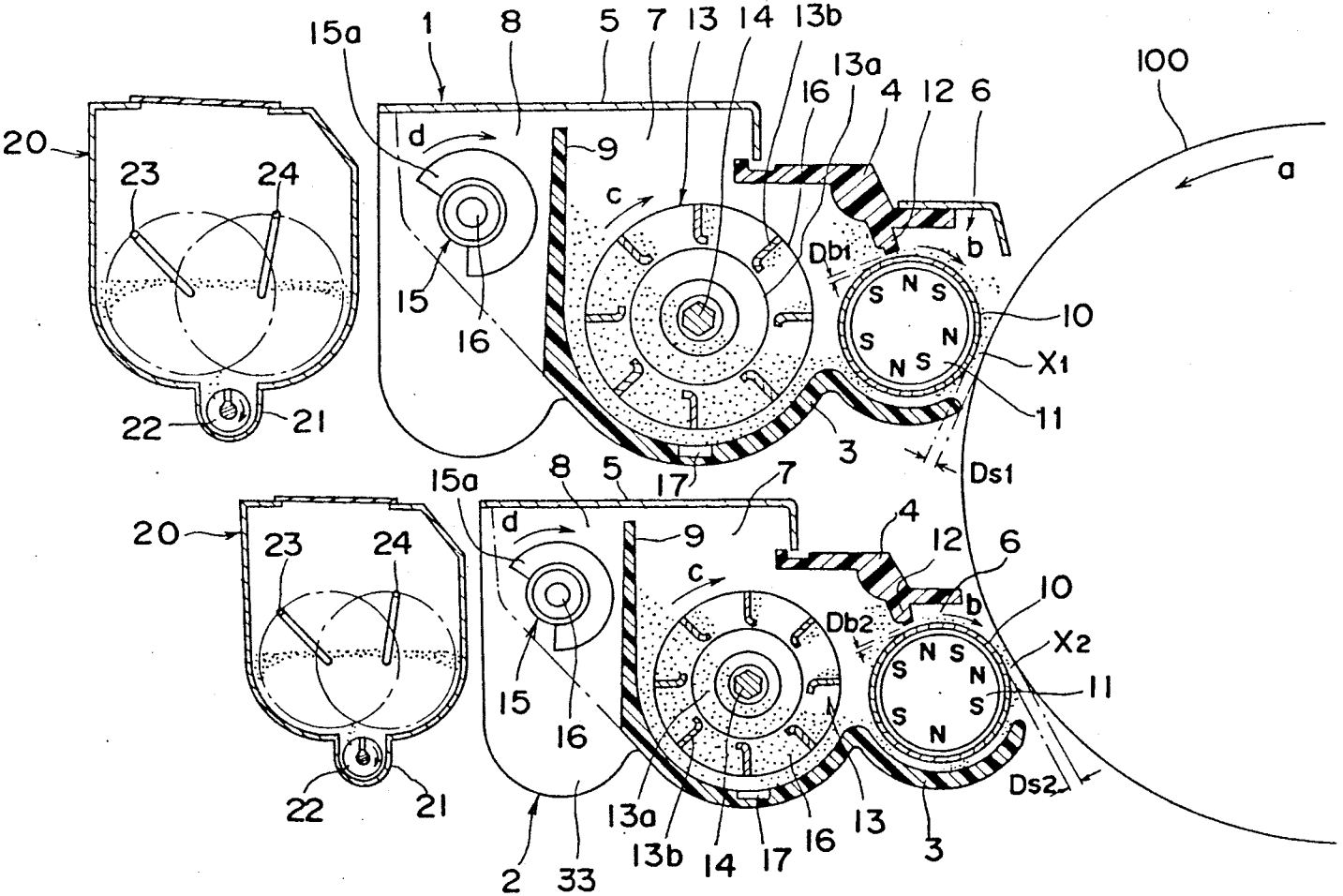
FIG. 37 is a longitudinal sectional view of a developing device in an image forming apparatus according to the seventh embodiment of the present invention.
Figure 38:
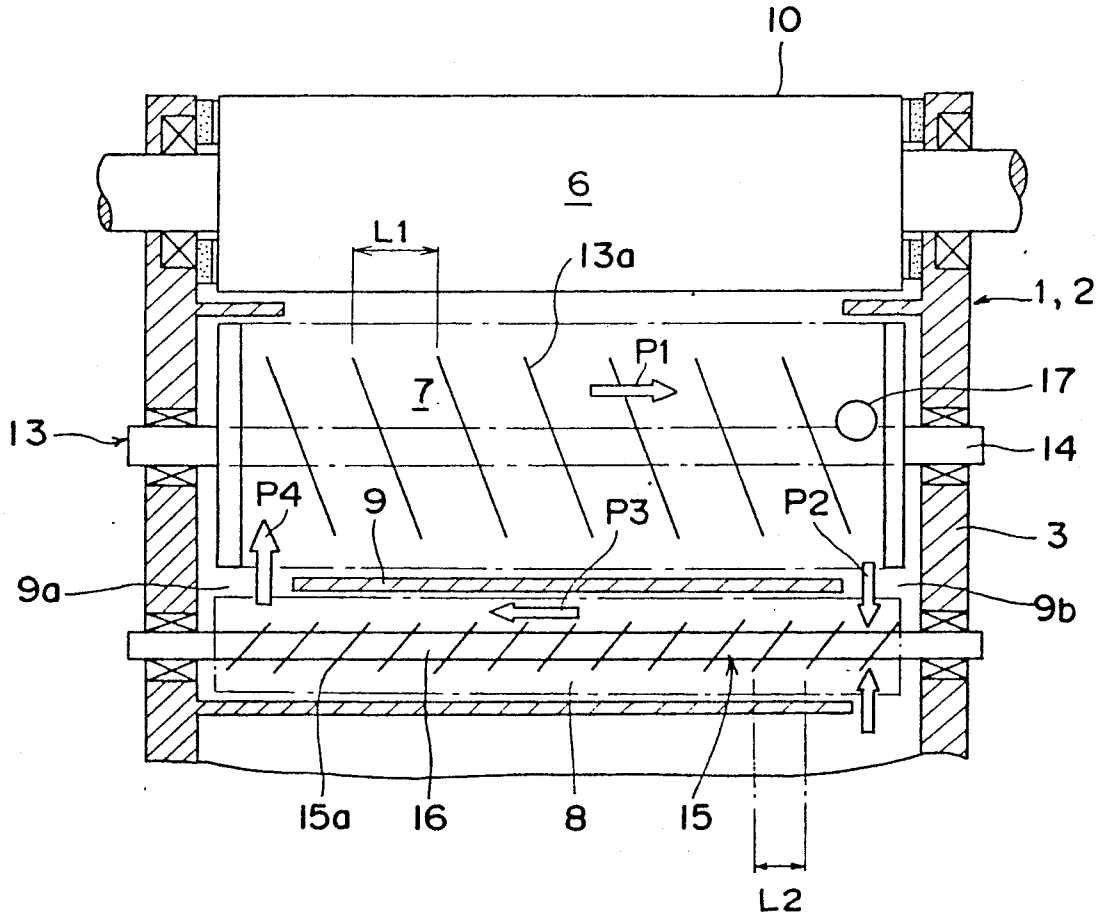
FIG. 38 is a cross-sectional view thereof in the seventh embodiment.
Figure 39:
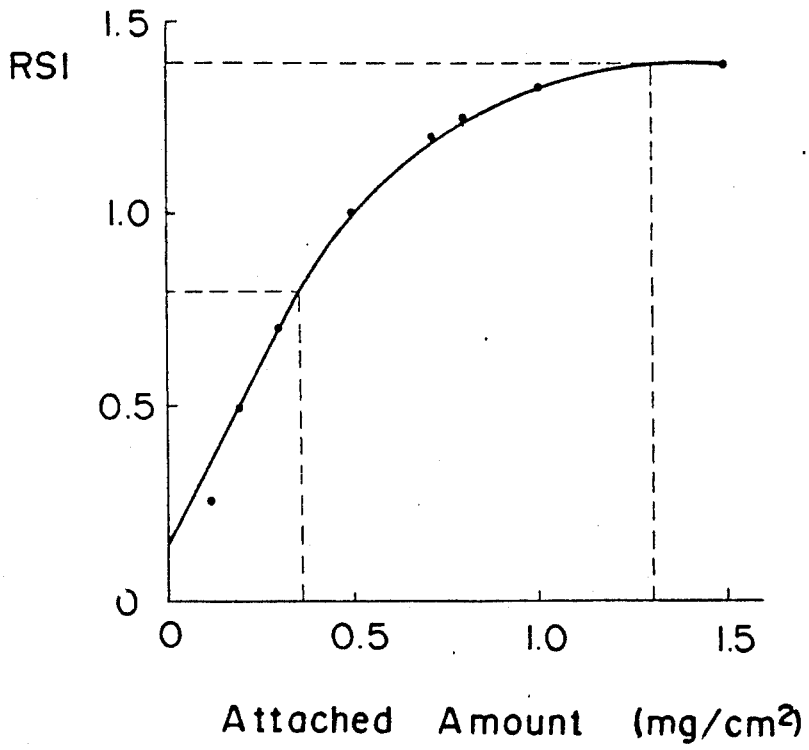
FIG. 39 is a graph showing a relation between toner attached amount and reproducibility RSI of density of a reproduced solid image in the seventh embodiment.

FIGS. 37–39 show the seventh embodiment according to the present invention in which the developer consumption amount of the upstream device of the drum is designed to be larger than that of the downstream device of the drum, so that the images with sufficient density may be reproduced by the upstream device.

As shown in FIG. 37, only sizes of the transporting paths 7 and 8, the bucket roller 13, and the screw 15 in the second developing device 2 are smaller than those in the first developing device 1. Then, the amount of the developer accommodated in the device 2 is smaller than that in the device 1. Similarly, the size of the toner replenishment tank 20 in the device 2 is smaller than that in the device 1. Then, the replenishment amount of the toner per hour which is accommodated in the tank 20 of the device 2 is smaller than that in the device 1. However, the size and the peripheral speed of the sleeve 10 in the device 2 are the same as those in the device 1.

In such an apparatus, in the case where the size of the developing gap $Ds_2$ in the device 2 is larger than that $Ds_1$ in the device 1 and the height regulating gap $Db_2$ in the device 2 is the same as that $Db_1$ in the device 1, since the developer packaged density (F) is defined by the equation which is;

F=(the amount of the developer transported to the developing region) / (the developing gap), the density (F) at the region $X_1$ in the device 1 is larger than that (F) at the region $X_2$ in the device 2.

As shown in FIG. 38, a distance L1 between the vanes 13*a* and 13*a* of the bucket roller 13 in the device 1 is smaller than that L1 in the device 2. A distance L2 between the vanes 15*a* and 15*a* of the screw 15 in the device 1 is smaller than that L2 in the device 2.

Therefore, since developer transportation in the device 1 becomes better than that in the device 2 by the arrangement, the transporting speeds of the developers in the paths 7 and 8 in the device 1 are the same as that in the device 2 even though the developer amount in the device 1 is larger than that in the device 2. On the other hand, as described previously, since the reproducibility RSI of the density of the solid image is obtained by the device 1, the toner consumption amount in the device 1 is larger than that in the device 2. However, since the capacities in the paths 7 and 8 in the device 1 are larger than those in the device 2 and the transporting speed in the device 1 is higher than that in the device 2 so that the mixing and agitating operations of the developer in the device 1 are the almost same as those in the device 2, the toner is sufficiently replenished in the device 1 even though lots of amount of the toner is consumed for development in the device 1. Thus, the excellent reproducibility RSI may be obtained by the device 1.

FIG. 39 shows a relation between the reproducibility RSI of the density of the solid image and the toner attached amount in which the reproducibility of the density of the reproduced solid image of 1.4 and 0.8 correspond to the toner attached amount of about 1.4 $mg/cm^2$ and 0.35 $mg/cm^2$, respectively.

Therefore, when an image to be reproduced has a half part for developing by the device 1 and the remain for developing by the device 2, the toner consumption amount of the device 1 is about four times larger than that of the device 2.

Then, in the case where the capacities and the developer accommodating amount, the toner accommodating amount, and the ability for transporting the developer of the paths 7 and 8 in the device 1 are designed to be about four times than those of the device 2. Thus, even if the toner replenishment amount in the device 1 is about four times than that in the device 2, the probability for contacting the toner with the carrier in the device 1 may be the same as that in the device 2.

As is clear from the foregoing description, according to the apparatus of the seventh embodiment which has plural developing devices each for supplying the developer in the same color toner to the same latent image formed on the surface of the drum, the developer consumption amount of the upstream device of the drum is designed to be larger than that of the downstream device of the drum. Therefore, even if images each with lots of solid parts are sequentially developed by the upstream device, the images with sufficient density may be reproduced by the upstream device.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An image forming apparatus having plural developing devices, comprising:

a photosensitive member arranged rotatably in one direction and holding an electrostatic latent image corresponding to an original image;

a developing sleeve rotatably arranged in each developing device at a position confronting said photosensitive member to transport a developer;

means for simultaneously driving for rotation of each of said developing sleeves in said developing devices; and an adjusting mechanism for adjusting operation of said developing devices so that in a region where said developing sleeves confront with said photosensitive member, a developer packaged density (F) in said developing device arranged at an upstream side in a rotational direction of said member is larger than that of said developing device arranged at a downstream side in the rotational direction of said member, which is $$F=Vd/Ds,$$

where Vd is an amount of the developer passing between said developing sleeve and said photosensitive member per hour, and Ds is a distance between said developing sleeve of said developing device and said photosensitive member.

2. An image forming apparatus as claimed in claim 1, wherein the developer in each of said developing devices has the same color.

3. An image forming apparatus comprising:

a photosensitive member arranged rotatably in one direction;

a first developing device arranged at a distance around said member and accommodating a developer of a specified color, said first developing device having a developing sleeve arranged to confront with a surface of said member at a specified distance to transport the developer in said device to a position thereon where the developer confronts with said member;

a second developing device arranged at a downstream side of the first developing device in a rotational direction of said member while confronting with said member and accommodating a developer of the same color as that of the developer in said first developing device, said second developing device having a developing sleeve rotatably arranged to confront with a surface of said member at a distance larger than the specified distance between the sleeve of said first developing device and said member to transport the developer in said second developing device to a position thereon where the developer confronts with said member; and a driving transmission mechanism for transmitting a driving force produced from a driving device to said first developing device and said second developing device for simultaneous rotation of the developing sleeve in said first developing device and the developing sleeve in said second developing device at the same peripheral speed.

4. An image forming apparatus as claimed in claim 3, wherein said mechanism comprising;

a gear fixed to one end of a shaft of each of the sleeves;

a driving gear fixed to one end of a driving shaft of the driving device;

a first solenoid for selectively transmitting the driving force from the driving device to the sleeve of said first developing device;

a transmitting gear rotatably attached to one end of a plunger of the first solenoid, wherein when the first solenoid is turned on the transmitting gear is engaged with the gear of the sleeve in said first developing device and the driving gear and when the first solenoid is turned off the transmitting gear is disengaged from the gear of the sleeve in said first developing device and the driving gear, and;

a second solenoid selectively transmitting the driving force from the driving device to the sleeve of said second developing device;

a transmitting gear rotatably attached to one end of a plunger of the second solenoid, wherein when the second solenoid is turned off the transmitting gear is engaged with the gear of the sleeve in said second developing device and the driving gear and when the second solenoid is turned on the transmitting gear is disengaged from the gear of the sleeve in said second developing device and the driving gear.

5. An image forming apparatus as claimed in claim 3, wherein an amount of the developer accommodated in said first developing device is larger than that in said second developing device.

6. An image forming apparatus as claimed in claim 3, further comprising:

a transporting path having a developer transporting member for transporting the developer which is formed rotatably in one direction behind each sleeve in each developing device, and a driving transmission means for transmitting to the developer transporting members driving forces for driving the members to transport the developer in said paths in different transporting directions with each other, respectively.

7. An image forming apparatus comprising:

a photosensitive member arranged rotatably in one direction;

a first developing device arranged at a distance around said member and accommodating a developer in a specified color, said first developing device having a developing sleeve arranged to confront with a surface of said member at a distance to transport the developer in said device to a position thereon where the developer confronts with said member;

a second developing device arranged at a downstream side of the first developing device in a rotational direction of said member while confronting with said member and accommodating a developer of the same color as that of the developer in said first developing device, said second developing device having a developing sleeve rotatably arranged to confront with a surface of said member at the same distance as that between said first developing device and said member to transport the developer in said second developing device to a position thereon where the developer confronts with said member; and a driving transmission mechanism for transmitting a driving force produced from a driving device to said first developing device and said second developing device to simultaneously rotate the developing sleeve in said first developing device and the developing sleeve in said second developing device, peripheral speed of the sleeve in said first developing device rotating at a peripheral speed and the sleeve in said second developing device rotating at a peripheral speed slower than that of the sleeve of said first developing device.

8. An image forming apparatus as claimed in claim 7, wherein said mechanism comprising;

a driving gear fixed to one end of a driving shaft of the driving device;

a first gear and a second gear fixed to one end of a shaft of the sleeve of said second developing device, respectively, a number of teeth of the first gear being smaller than that of the second gear;

a solenoid for changing the peripheral speed of the sleeve of said second developing device; and a first transmitting gear and a second transmitting gear rotatably attached to one end of a plunger of the solenoid, respectively, a number of teeth of the first transmitting gear being larger than that of the second transmitting gear, the first transmitting gear always being engaged with the driving gear, and the first transmitting gear is engaged with the first gear of the sleeve in turning-off of the solenoid, while the second transmitting gear is engaged with the second gear of the sleeve in turning-on of the solenoid.

9. An image forming apparatus as claimed in claim 7, wherein an amount of the developer accommodated in said first developing device is larger than that in said second developing device.

10. An image forming apparatus as claimed in claim 7, further comprising:

a transporting path having a developer transporting member for transporting the developer which is formed rotatably in one direction behind each sleeve in each developing device, and a driving transmission means for transmitting to the developer transporting members driving forces for driving the members to transport the developer in said paths in different transporting directions with each other, respectively.

11. An image forming apparatus comprising:

a photosensitive member arranged rotatably in one direction;

a first developing device arranged at a distance around said member and accommodating a developer of a specified color, said first developing device having a developing sleeve arranged to confront with a surface of said member at a distance to transport the developer in said device to a position thereon where the developer confronts with said member, and a developer height regulating member arranged at a specified distance to confront with an outer circumferential surface of the sleeve to regulate an amount of the developer transporting through a surface of the sleeve;

a second developing device arranged at a downstream side of the first developing device in a rotational direction of said member while confronting with said member and accommodating a developer of the same color as that of the developer in said first developing device, said second developing device having a developing sleeve rotatably arranged to confront with a surface of said member at a distance to transport the developer in said device to a position thereon where the developer confronts with said member, and a developer height regulating member arranged to confront with an outer circumferental surface of the sleeve at a smaller distance than the specified distance between the regulating member in said first developing device and said photosensitive member to regulate an amount of the developer transporting through a surface of the sleeve; and a driving transmission mechanism for transmitting a driving force produced from a driving device to said first developing device and said second developing device for simultaneous rotation of the developing sleeve in said first developing device and the developing sleeve in said second developing device at the same peripheral speed.

12. An image forming apparatus as claimed in claim 11, wherein a magnetic roller with plural magnetic poles is fixed into each of the sleeves, the regulating member in said first developing device is arranged to confront with a portion of an outer circumferential surface of the sleeve in said first developing device, at which the regulating member confronts with a middle of the adjacent magnetic poles of the roller, and the regulating member in said second developing device is arranged to confront with a portion of an outer circumferential surface of the sleeve in said second developing device, at which the regulating member confronts with the pole of the roller.

13. An image forming apparatus as claimed in claim 11, wherein said mechanism comprising;

a gear fixed to one end of a shaft of each of the sleeves;

a driving gear fixed to one end of a driving shaft of the driving device;

a first solenoid for selectively transmitting the driving force from the driving device to the sleeve of said first developing device;

a transmitting gear rotatably attached to one end of a plunger of the first solenoid, wherein when the first solenoid is turned on the transmitting gear is engaged with the gear of the sleeve in said first developing device and the driving gear and when the first solenoid is turned off the transmitting gear is disengaged from the gear of the sleeve in said first developing device and the driving gear, and;

a second solenoid selectively transmitting the driving force from the driving device to the sleeve of said second developing device;

a transmitting gear rotatably attached to one end of a plunger of the second solenoid, wherein when the second solenoid is turned off the transmitting gear is engaged with the gear of the sleeve in said second developing device and the driving gear and when the second solenoid is turned on the transmitting gear is disengaged from the gear of the sleeve in said second developing device and the driving gear.

14. An image forming apparatus as claimed in claim 11, wherein an amount of the developer accommodated in said first developing device is larger than that in said second developing device.

15. An image forming apparatus as claimed in claim 11, further comprising:

a transporting path having a developer transporting member for transporting the developer which is formed rotatably in one direction behind each sleeve in each developing device, and a driving transmission means for transmitting to the developer transporting members driving forces for driving the members to transport the developer in said paths in different transporting directions from each other.

16. An image forming apparatus comprising:

a photosensitive member supported rotatably in one direction;

a first developing device arranged at a distance around said member and accommodating a developer therein and having a developing sleeve arranged at a distance to confront with a surface of said member to transport the developer in said device to a position thereon where the developer confronts with said member;

a second developing device arranged at a downstream side of the first developing device in a rotational direction of said member while confronting with said member and accommodating a developer therein and having a developing sleeve arranged at a distance to confront with a surface of said member to transport the developer in said device to a position thereon where the developer confronts with said member;

a toner color judging means for detecting each color of the developers accommodated into said devices and judging whether or not both colors of the developers in said devices are the same;

a distance changing means arranged in said second developing device and selectively changing a distance between the sleeve of said second developing device and said member into one of a first distance which is the same as that formed between the sleeve in said first developing device and said member and a second distance larger than the first distance;

a driving transmission mechanism for selecting one of a first driving system for selectively transmitting a driving force to either the sleeve in said first developing devices or the sleeve in said second developing device, and a second driving system for transmitting the driving force to both the sleeves in said first and second developing devices; and a control means for controlling operations of said distance changing means and said driving transmission mechanism, wherein said control means selects said second driving system and controls said distance changing means so that the distance between the sleeve of said second developing device and said member is set at said second distance when said judging means determines that the colors of the developers in said devices are the same, while said control means selects said first driving system and controls said distance changing means so that the distance between the sleeve of said second developing device and said member is set at said first distance when said judging means determines that the colors of the developers in said devices are different from each other.

17. An image forming apparatus as claimed in claim 16, further comprising:

a toner density detecting means for detecting toner density in each developer accommodated into each developing device; and control means for changing the second distance into the first distance in a case where the first distance is selected by said distance changing means when said density detecting means detects that the toner density in said first developing device is lower than a reference value.

18. An image forming apparatus comprising:

a photosensitive member supported rotatably in one direction;

a first developing device arranged at a distance around said member and accommodating a developer therein, said device having a developing sleeve rotatably arranged to confront with a surface of said member at a distance to transport the developer in said device to a position thereon where the developer confronts with said member, and a developer height regulating member arranged at a distance to confront with an outer circumferential surface of the sleeve to regulate an amount of the developer transporting through a surface of the sleeve;

a second developing device arranged at a downstream side of the first developing device in a rotational direction of said member while confronting with said member and accommodating a developer in the same color as that of the developer in said first developing device, said second developing device having a developing sleeve rotatably arranged to confront with a surface of said member at a distance to transport the developer in said device to a position thereon where the developer confronts with said member, and a developer height regulating member arranged to confront with an outer circumferential surface of the sleeve at a distance to regulate an amount of the developer transporting through a surface of the sleeve; and a toner color judging means for detecting each color of the developers accommodated into said devices and judging whether or not both colors of the developers in said devices have been the same;

a distance changing means arranged in said second developing device and selectively changing a distance between the sleeve of said second developing device and said photosensitive member into one of a first distance which is the same as that formed between the sleeve in said first developing device and said regulating member and a second distance smaller than the first distance;

a driving transmission mechanism for selecting one of a first driving system for selectively transmitting a driving force to either the sleeve in said first developing devices or the sleeve in said second developing device, and a second driving system for transmitting the driving force to both the sleeves in said first and second developing devices; and a control means for controlling operations of said distance changing means and said driving transmission mechanism, wherein said control means selects said second driving system and controls said distance changing means so that the distance between the sleeve of said second developing device and said photosensitive member is set at said second distance when said judging means determines that the colors of the developers in said devices are the same, while said control means selects said first driving system and controls said distance changing means so that the distance between the sleeve of said second developing device and said photosensitive member is set at said first distance when said judging means determines that the colors of the developers in said devices are different from each other.

19. An image forming apparatus as claimed in claim 18, further comprising:

a toner density detecting means for detecting toner density in each developer accommodated into each developing device; and control means for changing the second distance into the first distance in a case where the second distance is selected by said distance changing means when said density detecting means detects that the toner density in said first developing device is lower than a reference value.

20. An image forming apparatus comprising:

a photosensitive member supported rotatably in one direction;

a first developing device arranged at a distance around said member and accommodating a developer therein and having a developing sleeve arranged at a distance to confront with a surface of said member to transport the developer in said device to a position thereon where the developer confronts with said member;

a second developing device arranged at a downstream side of the first developing device in a rotational direction of said member while confronting with said member and accommodating a developer therein and having a developing sleeve arranged at a distance to confront with a surface of said member to transport the developer in said device to a position thereon where the developer confronts with said member;

a toner color judging means for detecting each color of the developers accommodated into said devices and judging whether or not both colors of the developers in said devices have been the same;

a peripheral speed changing means arranged at said second developing device and selectively changing a peripheral speed of the sleeve in said second developing device into one of a first peripheral speed the same as the speed of the sleeve in said first developing device, and a second peripheral speed slower than the first peripheral speed;

a driving transmission mechanism for selecting one of a first driving system for selectively transmitting a driving force to either the sleeve in said first developing devices or the sleeve in said second developing device, and a second driving system for transmitting the driving force to both the sleeves in said first and second developing devices; and a control means for controlling operations of said changing means and said driving transmission mechanism, wherein said control means controls said driving transmission mechanism to select the second driving system and controls said changing means to set the speed of the sleeve of said second developing device to the second peripheral speed when said judging means determines that both of the colors in said devices are the same, while said control means controls said driving transmission mechanism to select the first driving system and controls said changing means to set the speed of the sleeve of said second developing device to the first peripheral speed when said judging device determines that both of the colors of the developers in said devices are different from each other.

21. An image forming apparatus as claimed in claim 20, further comprising:

a toner density detecting means for detecting toner density in each developer accommodated into each developing device; and control means for changing the second peripheral speed into the first peripheral speed in a case where the second peripheral speed is selected by said changing means when said density detecting means detects that the toner density in said first developing device is lower than a reference value.

22. An image forming apparatus comprising:

a photosensitive member arranged rotatably in one direction and holding an electrostatic latent image corresponding to an original image;

a first developing device arranged at a distance around said member and accommodating a developer in a specified color, said first developing device having a developing sleeve arranged to confront with a surface of said member at a distance to transport the developer in said device to a position thereon where the developer confronts with said member, and a magnetic roller with plural magnetic poles arranged fixedly in the sleeve, the pole to be used in developing being biased on an upstream side of a line passed through rotary centers of said member and the roller in a rotational direction of said member;

a second developing device arranged at a downstream side of the first developing device in a rotational direction of said member while confronting with said member and accommodating a developer in the same color as that of the developer in said first developing device, said second developing device having a developing sleeve rotatably arranged to confront with a surface of said member at a distance to transport the developer in said device to a position thereon where the developer confronts with said member, and a magnetic roller with plural magnetic poles arranged fixedly in the sleeve, the pole to be used in developing being positioned on a line passed through the rotary center of said member and a rotary center of the roller; and a control means for driving said first developing device to develop the latent image on said member before driving said second developing device to develop the latent image developed by said first developing device.

23. An image forming apparatus as claimed in claim 22, wherein the distance between the sleeve of said second developing device and said member is larger than the distance between the sleeve of said first developing device and said member.

24. An image forming apparatus comprising:

a photosensitive member;

a first developing device arranged at a distance around said member and a second developing device arranged at a downstream side of said first developing device in a rotational direction of said member, wherein an amount of a developer accommodated in said first developing device is larger than that in said second developing device;

a developing sleeve rotatably arranged in each developing device;

means for simultaneously rotatably driving each of said developing sleeves in said developing devices; and a setting means for setting the condition of said developing devices so that in a region where said developing sleeves confront with said photosensitive member, developer packaged density (F) in said first developing device is larger than that of said second developing device, which is $$F = Vd/Ds,$$

where Vd is an amount of the developer passing through between said developing sleeve and said photosensitive member per hour, and Ds is a distance between said developing sleeve of said developing device and said photosensitive member.

25. An image forming apparatus as claimed in claim 24, wherein the developer in each of said developing devices has the same color.

26. An image forming apparatus comprising:

a photosensitive member;

first and second developing devices arranged at predetermined distances from said member, respectively;

a developing sleeve rotatably arranged in each developing device;

a transporting path having a developer transporting member which is formed rotatably in one direction behind the sleeve of each of said first and second devices developing;

a driving transmission means for transmitting to the developer transporting members driving forces for driving the members to transport the developer in said paths in different transporting directions with each other, respectively; and means for simultaneously rotatably driving each of said developing sleeves so as to develop the same latent image formed on said photosensitive member during one image forming cycle.

27. An image forming apparatus as claimed in claim 26, wherein developer consumption amounts in said developing devices are different each other.

* * * * *